US008708537B2

(12) United States Patent
Takahashi

(10) Patent No.: US 8,708,537 B2
(45) Date of Patent: Apr. 29, 2014

(54) LIGHTING APPARATUS, HEADLAMP, AND MOBILE BODY

(75) Inventor: Koji Takahashi, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 231 days.

(21) Appl. No.: 13/220,370

(22) Filed: Aug. 29, 2011

(65) Prior Publication Data

US 2012/0051074 A1 Mar. 1, 2012

(30) Foreign Application Priority Data

| | | |
|---|---|---|
| Aug. 31, 2010 | (JP) | 2010-193357 |
| Aug. 31, 2010 | (JP) | 2010-193358 |
| Jul. 11, 2011 | (JP) | 2011-152517 |
| Jul. 11, 2011 | (JP) | 2011-152518 |

(51) Int. Cl.
*F21V 13/00* (2006.01)

(52) U.S. Cl.
USPC ..... 362/509; 362/259; 362/514; 362/516; 362/296.01; 362/327; 362/487

(58) Field of Classification Search
None
See application file for complete search history.

(56) References Cited

U.S. PATENT DOCUMENTS

| | | | | |
|---|---|---|---|---|
| 7,648,262 | B2 * | 1/2010 | Tanaka | 362/509 |
| 2007/0070638 | A1 * | 3/2007 | Fukawa et al. | 362/475 |
| 2008/0285297 | A1 * | 11/2008 | Ishida | 362/539 |
| 2009/0231874 | A1 * | 9/2009 | Kishimoto et al. | 362/538 |
| 2011/0032722 | A1 * | 2/2011 | Ishida et al. | 362/538 |
| 2011/0235356 | A1 * | 9/2011 | Sato et al. | 362/510 |
| 2011/0249460 | A1 | 10/2011 | Kushimoto | |
| 2012/0026721 | A1 * | 2/2012 | Kurt et al. | 362/84 |

FOREIGN PATENT DOCUMENTS

| | | |
|---|---|---|
| JP | 2003-295319 | 10/2003 |
| JP | 2011-134619 | 7/2011 |
| JP | 2011-222238 | 11/2011 |

* cited by examiner

*Primary Examiner* — Ashok Patel
(74) *Attorney, Agent, or Firm* — Morrison & Foerster LLP

(57) ABSTRACT

A lighting apparatus is provided that, while suppressing an increase in size, can change the illuminating direction. The lighting apparatus has: a laser generator which emits laser light; a light emitting member which is irradiated with the laser light emitted from the laser generator to emit light; an irradiated position changer which moves and thereafter stops an irradiated position at which the light emitting member is irradiated with the laser light; and a light projecting member which projects the light emitted from the light emitting member.

18 Claims, 45 Drawing Sheets

LIGHTING APPARATUS, HEADLAMP, AND MOBILE BODY

This nonprovisional application claims priority under 35 U.S.C. §119(a) on Patent Applications Nos. 2010-193357 and 2010-193358 filed in Japan on Aug. 31, 2010, and Patent Applications Nos. 2011-152517 and 2011-152518 filed in Japan on Jul. 11, 2011, the entire contents of all of which are hereby incorporated by reference.

BACKGROUND OF THE INVENTION

1. Field of the Invention

The present invention relates to lighting (illuminating) apparatus, headlamps, and mobile bodies, and more particularly to those employing a laser generator which emits laser light.

2. Description of Related Art

There are conventionally known lighting apparatus employing a laser generator which emits laser light. Such lighting apparatus are disclosed in, for example, JP-A-2003-295319.

JP-A-2003-295319 mentioned above discloses a light source apparatus (lighting apparatus) provided with an ultraviolet LD device (laser generator) which functions as a laser light source, a phosphor (fluorescent member) which converts the laser light emitted from the ultraviolet LD device into visible light, and a reflector (light projecting member) which reflects the visible light emitted from the phosphor.

In this light source apparatus, providing the reflector which reflects the visible light emitted from the phosphor makes it possible to illuminate a predetermined region in front of the light source apparatus.

On the other hand, in automobiles (mobile bodies), headlamps (lighting apparatus) are often so controlled as to change the illuminating direction in accordance with the traveling condition of the automobile. For example, by use of a technology called AFS (adaptive, or advanced, front-lighting system), the headlamps are controlled to change the illuminating direction so as to point in the direction in which the automobile is traveling.

Inconveniently, however, when the light source apparatus of JP-A-2003-295319 mentioned above is applied to the headlamps of an automobile, changing the illuminating direction of the light source apparatus requires changing the orientation of the reflector (light projecting member). This necessitates a member for changing the orientation of the reflector, inconveniently making the headlamps as a whole larger.

Moreover, in automobiles (mobile bodies), headlamps (lighting apparatus) are also often so controlled as to change the area of the illuminated region in accordance with the traveling condition of the automobile. For example, while the automobile is traveling in an urban area or the like, passing beams (low beam, meeting beams) are used to illuminate a comparatively broad region; by contrast, for example, while the automobile is traveling on an expressway, driving beams (high beams, full beams) are used to illuminate a comparatively narrow region.

Inconveniently, however, with the light source apparatus of JP-A-2003-295319 mentioned above, it is difficult to change the area of the illuminated region. Thus, when the light source apparatus of JP-A-2003-295319 mentioned above is applied to the headlamps of an automobile, it is necessary to separately provide a light source apparatus for passing beams and a light source apparatus for driving beams. This inconveniently makes the headlamps as a whole larger.

SUMMARY OF THE INVENTION

The present invention has been devised to solve the inconveniences mentioned above, and it is an object of the invention to provide, while suppressing an increase in size, a lighting apparatus, a headlamp, and a mobile body that can change the illuminating direction.

It is another object of the invention to provide, while suppressing an increase in size, a lighting apparatus, a headlamp, and a mobile body that can change the area (size) of the illuminated region.

To achieve the above objects, according to a first aspect of the invention, a lighting apparatus is provided with: a laser generator which emits laser light; a light emitting member which is irradiated with the laser light emitted from the laser generator to emit light; an irradiated position changer which moves and thereafter stops the irradiated position at which the light emitting member is irradiated with the laser light; and a light projecting member which projects the light emitted from the light emitting member.

In this lighting apparatus according to the first aspect, as described above, there is provided an irradiated position changer which moves and thereafter stops the irradiated position at which the light emitting member is irradiated with laser light. Thus, simply by changing, with the irradiated position changer, the irradiated position on the light emitting member, it is possible to change the illuminating direction of the lighting apparatus (the direction in which light is emitted outside the lighting apparatus). Thus, there is no need to provide an extra member for changing the orientation of the light projecting member for the purpose of changing the illuminating direction of the lighting apparatus, and thus it is possible to suppress an increase in the size of the lighting apparatus as a whole.

Here, "moving and thereafter stopping the irradiated position" means, instead of keeping the irradiated position scanned with laser light, moving the irradiated position to a desired position and then keeping it substantially at rest there. Here, "keeping it substantially at rest" includes swinging the irradiated position at the movement destination within a range smaller than the movement distance. The phrase even embraces, for example, keeping the irradiated position momentarily at rest at the movement destination and then moving it back.

All that has to be done to change the irradiated position on the light emitting member is to change the traveling direction of laser light, and this makes it possible to make the irradiated position changer compact.

Moreover, in the lighting apparatus according to the first aspect, as described above, by use of the laser generator, it is possible to easily narrow down (reduce) the irradiated region in which the light emitting member is irradiated with laser light. Thus, by changing the traveling direction of laser light, it is possible to easily change (move) the irradiated position on the light emitting member.

In the above-described lighting apparatus according to the first aspect, preferably, the light projecting member includes a first reflector having a reflective surface which reflects the light emitted from the light emitting member.

In the above-described lighting apparatus according to the first aspect, preferably, the light projecting member includes a light projecting lens which controls the light emitted from the light emitting member.

In the above-described lighting apparatus according to the first aspect, preferably, the light emitting member includes a fluorescent member.

In the above-described lighting apparatus in which the light projecting member includes the first reflector, preferably, the light emitting member is so formed as to extend in a predetermined direction crossing the depth direction of the reflective surface, and the irradiated position on the light emitting member is changed at least in the predetermined direction by the irradiated position changer. With this design, by changing the irradiated position on the light emitting member, it is possible to easily change the illuminating direction of the lighting apparatus.

In the above-described lighting apparatus in which the light projecting member includes the first reflector, preferably, the reflective surface is formed in a shape having a focal point, and the light emitting member is disposed in a region including the focal point of the reflective surface or near the focal point of the reflective surface. With this design, by changing (moving) the irradiated position on the light emitting member, for example, from the focal point (or near the focal point) of the reflective surface to a position different from the focal point, it is possible to easily change the illuminating direction of the lighting apparatus.

Moreover, by locating the irradiated position on the light emitting member at the focal point of the reflective surface, it is possible to easily make the light (illumination light) emitted outside the lighting apparatus into, for example, a parallel or convergent beam.

In the above-described lighting apparatus in which the light emitting member is disposed in a region including the focal point of the reflective surface or near the focal point of the reflective surface, preferably, the irradiated position changer changes the irradiated position on the light emitting member in such a way as to change the distance from the focal point of the reflective surface to the irradiated position on the light emitting member. With this design, it is possible to easily change the illuminating direction of the lighting apparatus.

In the above-described lighting apparatus in which the light emitting member is disposed in a region including the focal point of the reflective surface or near the focal point of the reflective surface, preferably, the reflective surface is so formed as to include at least part of either a paraboloid or an ellipsoid. With this design, by locating the irradiated position on the light emitting member at the focal point of the reflective surface, it is possible to easily make the light (illumination light) emitted outside the lighting apparatus into a parallel or convergent beam.

In the above-described lighting apparatus according to the first aspect, preferably, there is further provided a light guide member which guides the laser light emitted from the laser generator to the light emitting member, and the irradiated position changer changes the irradiated position on the light emitting member by changing the angle of the light guide member. With this design, by changing the angle of the light guide member, it is possible to easily change the illuminating direction of the lighting apparatus.

All that has to be done to change the irradiated position on the light emitting member is to change the angle of the light guide member such as a lens. Thus, it is possible to easily make the irradiated position changer compact.

In the above-described lighting apparatus provided with the light guide member, preferably, the light guide member includes at least one of a lens which transmits laser light or a second reflector which reflects laser light. With this design, all that has to be done to change the irradiated position on the light emitting member is to change the angle of the lens or the second reflector. Thus, it is possible to make the irradiated position changer sufficiently compact.

In the above-described lighting apparatus in which the light guide member includes the lens, preferably, the light guide member includes a collimator lens which makes the laser light emitted from the laser generator into a parallel beam. With this design, it is possible to easily narrow down (reduce) the irradiated region on the light emitting member.

In the above-described lighting apparatus in which the light projecting member includes the first reflector, preferably, the reflective surface is formed in a shape having a focal point and a vertex, the focal point of the reflective surface is located near the vertex of the reflective surface, and the light emitting member is disposed near the vertex of the reflective surface. With this design, it is possible to easily change to one side the direction in which the light reflected from the first reflector is emitted outside.

Moreover, by locating the focal point of the reflective surface near the vertex of the reflective surface, it is possible to form the reflective surface in the shape of a deep hole having a vertex (focal point) located deep and having a small diameter at the opening (the part where the illumination light is emitted outside). In this way, a large part of the light emitted from the light emitting member can be reflected on the reflective surface and then emitted outside. Thus, it is possible to control the direction (illuminating direction) in which the large part of the light emitted from the light emitting member is emitted outside. Moreover, it is possible to suppress an increase in the fanning angle (spread angle) of the light that is emitted outside without striking the first reflector.

In the above-described lighting apparatus in which the light projecting member includes the first reflector, preferably, the light emitting member is disposed at the boundary between the inside and outside of the first reflector. With this design, it is possible to easily change to one side the direction in which the light reflected from the first reflector is emitted outside.

In the above-described lighting apparatus in which the light projecting member includes the first reflector, preferably, the light emitting member is so formed as to extend in the depth direction of the reflective surface, and the irradiated position on the light emitting member is changed at least in the depth direction by the irradiated position changer. With this design, by changing the irradiated position on the light emitting member, it is possible to easily change the illuminating direction of the lighting apparatus.

In the above-described lighting apparatus in which the light projecting member includes the first reflector, preferably, there is further provided a holding member which has a holding surface to which the light emitting member is fitted, the reflective surface is formed in the shape of either a paraboloid or an ellipsoid divided on a plane crossing the axis through the focal point and the vertex, and the holding surface of the holding member is so formed as to extend in a predetermined direction crossing the axis through the focal point and the vertex.

In that case, preferably, the holding member is so designed as to transmit the light emitted from the light emitting member. With this design, it is possible to use as illumination light the light transmitted through the holding member.

In the above-described lighting apparatus in which the light projecting member includes the first reflector, preferably, there is further provided a holding member which has a holding surface to which the light emitting member is fitted, the reflective surface is formed in the shape of either a paraboloid or an ellipsoid divided on a plane crossing the axis through the focal point and the vertex and further divided on a plane parallel to the axis through the focal point and the vertex, and the holding surface of the holding member is so formed as to extend in the direction in which the axis through the focal point and the vertex extends. With this design, it is possible to make the first reflector and hence the lighting apparatus compact.

In that case, preferably, the holding member is made of metal. With this design, it is possible to reject the heat generated in the light emitting member to the holding member, and thus it is possible to suppress the light emitting member becoming hot.

In the above-described lighting apparatus according to the first aspect, preferably, there is further provided an output adjuster which adjusts the output of the laser generator, and the output adjuster adjusts the output of the laser generator in synchronism with the change of the irradiated position on the light emitting member. With this design, it is possible to control the illuminance in the illuminated region (the region illuminated by the lighting apparatus), and thus it is possible to suppress the illuminated region becoming too dim (or bright).

In the above-described lighting apparatus according to the first aspect, preferably, there is further provided an irradiated area changer which changes the area (size) of the irradiated region in which the light emitting member is irradiated with the laser light. With this design, it is possible to change also the area of the illuminated region of the lighting apparatus.

In the above-described lighting apparatus according to the first aspect, preferably, the laser generator includes a semiconductor laser device. With this design, it is possible to easily make the lighting apparatus compact.

According to a second aspect of the invention, a headlamp is provided with a lighting apparatus as described above. With this design, it is possible to realize, while suppressing an increase in size, a headlamp that can change the illuminating direction.

According to a third aspect of the invention, a mobile body is provided with a headlamp as described above. With this design, it is possible to realize, while suppressing an increase in size, a mobile body that can change the illuminating direction.

According to a fourth aspect of the invention, a lighting apparatus is provided with: a laser generator which emits laser light; a light emitting member which is irradiated with the laser light emitted from the laser generator to emit light; an irradiated area changer which changes the area (size) of the irradiated region in which the light emitting member is irradiated with the laser light; and a light projecting member which projects the light emitted from the light emitting member.

In this lighting apparatus according to the fourth aspect, as described above, there are provided an irradiated area changer which changes the area of the irradiated region in which the light emitting member is irradiated with laser light; and a light projecting member which projects the light emitted from the light emitting member. Thus, by changing, with the irradiated area changer, the area of the irradiated region on the light emitting member, it is possible to change the area of the illuminated region of the lighting apparatus (the region illuminated by the lighting apparatus). Thus, there is no need to provide a plurality of lighting apparatus separately (for example, a headlamp for a passing beam and a headlamp for a driving beam) for the purpose of changing the area of the illuminated region of the lighting apparatus. Thus, it is possible to suppress an increase in the size of the lighting apparatus as a whole.

All that has to be done to change the area of the irradiated region on the light emitting member is to change the fanning angle of laser light, and this makes it possible to make the irradiated area changer compact.

Moreover, in the lighting apparatus according to the fourth aspect, as described above, by use of the laser generator, it is possible to easily narrow down (reduce) the irradiated region on the light emitting member. That is, it is easy to irradiate only part of the light emitting member. This makes it possible to easily change the area of the irradiated region on the light emitting member.

In the above-described lighting apparatus according to the fourth aspect, preferably, the light projecting member is provided with a reflector having a reflective surface which reflects the light emitted from the light emitting member.

In the above-described lighting apparatus according to the fourth aspect, preferably, the light projecting member is provided with a light projecting lens which controls the light emitted from the light emitting member.

In the above-described lighting apparatus according to the fourth aspect, preferably, the light emitting member is provided with a fluorescent member.

In the above-described lighting apparatus in which the light projecting member includes the reflector, preferably, the light emitting member is so formed as to extend in a predetermined direction crossing the depth direction of the reflective surface, and the area of the irradiated region on the light emitting member is changed by the irradiated area changer changing the length, at least in the predetermined direction, of the irradiated region. With this design, by changing the length, at least in the predetermined direction, of the irradiated region on the light emitting member, it is possible to easily change the area of the illuminated region of the lighting apparatus.

In the above-described lighting apparatus in which the light projecting member includes the reflector, preferably, the reflective surface is formed in a shape having a focal point, and the light emitting member is disposed in a region including the focal point of the reflective surface or near the focal point of the reflective surface. With this design, by changing the area of the irradiated region on the light emitting member, it is possible to easily change the area of the illuminated region of the lighting apparatus.

Moreover, by locating the irradiated position (for example, the center position of the irradiated region) on the light emitting member at the focal point of the reflective surface, and in addition narrowing down (reducing) the irradiated region on the light emitting member, it is possible to easily make the light (illumination light) emitted outside the lighting apparatus into, for example, an approximately parallel or convergent beam. Moreover, by locating the irradiated position on the light emitting member at the focal point of the reflective surface, it is possible to suppress the illuminated region of the lighting apparatus becoming doughnut-shaped (disc-shaped) or extremely dim.

In the above-described lighting apparatus in which the light emitting member is disposed in a region including the focal point of the reflective surface or near the focal point of the reflective surface, preferably, the reflective surface is so formed as to include at least part of either a paraboloid or an ellipsoid. With this design, by locating the irradiated position on the light emitting member at the focal point of the reflective surface, and in addition narrowing down (reducing) the irradiated region on the light emitting member, it is possible to easily make the light (illumination light) emitted outside the lighting apparatus into a substantially parallel or convergent beam.

In the above-described lighting apparatus according to the fourth aspect, preferably, there is further provided a lens which transmits the laser light emitted from the laser generator, and the irradiated area changer changes the area of the irradiated region on the light emitting member by moving the lens in the optical axis direction. By moving the lens in the optical axis direction in this way, it is possible to easily change the fanning angle of laser light, and thus it is possible to easily change the area of the irradiated region on the light emitting member.

All that has to be done to change the area of the irradiated region on the light emitting member is to move the lens in the optical axis direction, and this makes it possible to make the irradiated area changer sufficiently compact.

In the above-described lighting apparatus provided with the lens, preferably, the lens includes a collimator lens which makes the laser light emitted from the laser generator into a parallel beam. With this design, it is possible to more easily narrow down (reduce) the irradiated region on the light emitting member. That is, it is easier to irradiate only part of the light emitting member.

In the above-described lighting apparatus in which the light projecting member includes the reflector, preferably, the light emitting member is so formed as to extend in the depth direction of the reflective surface, and the area of the irradiated region on the light emitting member is changed by the irradiated area changer changing the length, at least in the depth direction, of the irradiated region. With this design, by changing the length, at least in the depth direction, of the irradiated region on the light emitting member, it is possible to easily change the area of the illuminated region of the lighting apparatus.

In the above-described lighting apparatus in which the light projecting member includes the reflector, preferably, there is further provided a holding member which has a holding surface to which the light emitting member is fitted, the reflective surface is formed in the shape of either a paraboloid or an ellipsoid divided on a plane crossing the axis through the focal point to the vertex, and the holding surface of the holding member is so formed as to extend in a predetermined direction crossing the axis through the focal point to the vertex.

In that case, preferably, the holding member is so designed as to transmit the light emitted from the light emitting member. With this design, it is possible to use as illumination light the light transmitted through the holding member as well.

In the above-described lighting apparatus in which the light projecting member includes the reflector, preferably, there is further provided a holding member which has a holding surface to which the light emitting member is fitted, the reflective surface is formed in the shape of either a paraboloid or an ellipsoid divided on a plane crossing the axis through the focal point and the vertex and further divided on a plane parallel to the axis through the focal point and the vertex, and the holding surface of the holding member is so formed as to extend in the direction in which the axis through the focal point and the vertex extends. With this design, it is possible to make the reflector and hence the lighting apparatus compact.

In that case, preferably, the holding member is made of metal. With this design, it is possible to reject the heat generated in the light emitting member to the holding member, and thus it is possible to suppress the light emitting member becoming hot.

In the above-described lighting apparatus according to the fourth aspect, preferably, there is further provided an output adjuster which adjusts the output of the laser generator, and the output adjuster adjusts the output of the laser generator in synchronism with the change of the area of the irradiated region on the light emitting member. With this design, it is possible to control the illuminance in the illuminated region, and thus it is possible to suppress the illuminated region becoming too dim (or bright).

In the above-described lighting apparatus in which the light projecting member includes the reflector, preferably, the reflective surface is formed in a shape having a focal point and a vertex, the focal point of the reflective surface is located near the vertex of the reflective surface, and the light emitting member is disposed near the vertex of the reflective surface. With this design, it is possible to form the reflective surface in the shape of a deep hole having a vertex (focal point) located deep and having a small diameter at the opening (the part where the illumination light is emitted outside). In this way, a large part of the light emitted from the light emitting member can be reflected on the reflective surface and then emitted outside. Thus, it is possible to effectively change the area of the illuminated region of the lighting apparatus. Moreover, it is possible to suppress an increase in the fanning angle of the light that is emitted outside without striking the reflector.

In the above-described lighting apparatus in which the light projecting member includes the reflector, preferably, the light emitting member is disposed at the boundary between the inside and outside of the reflector.

In the above-described lighting apparatus according to the fourth aspect, preferably, there is further provided an irradiated position changer which changes the irradiated region at which the light emitting member is irradiated with the laser light. With this design, it is possible to change also the illuminating direction of the lighting apparatus (the direction in which the lighting apparatus illuminates).

In the above-described lighting apparatus provided with the irradiated position changer, preferably, the irradiated position changer moves and thereafter stops the irradiated position on the light emitting member.

Here, "moving and thereafter stopping the irradiated position" means, instead of keeping the irradiated position scanned with laser light, moving the irradiated position to a desired position and then keeping it substantially at rest there. Here, "keeping it substantially at rest" includes swinging the irradiated position at the movement destination within a range smaller than the movement distance. The phrase even embraces, for example, keeping the irradiated position momentarily at rest at the movement destination and then moving it back.

In the above-described lighting apparatus according to the fourth aspect, preferably, the laser generator includes a semiconductor laser device. With this design, it is possible to easily make the lighting apparatus compact.

According to a fifth aspect of the invention, a headlamp is provided with a lighting apparatus as described above. With this design, it is possible to realize, while suppressing an increase in size, a headlamp that can change the area of the illuminated region.

According to a sixth aspect of the invention, a mobile body is provided with a headlamp as described above. With this design, it is possible to realize, while suppressing an increase in size, a mobile body that can change the area of the illuminated region.

BRIEF DESCRIPTION OF THE DRAWINGS

FIG. 21 is a plan view illustrating the illuminated region of the headlamp shown in

FIG. 13;

DETAILED DESCRIPTION OF PREFERRED EMBODIMENTS

Hereinafter, embodiments of the present invention will be described with reference to the accompanying drawings. For the sake of easy understanding, sectional views are occasionally presented without hatching, and views other than sectional views are occasionally presented with hatching.

Embodiment 1

First, with reference to FIGS. 1 to 5, the design of an automobile 1 provided with a headlamp 2 according to a first embodiment (Embodiment 1) of the invention will be described.

Figure 1:
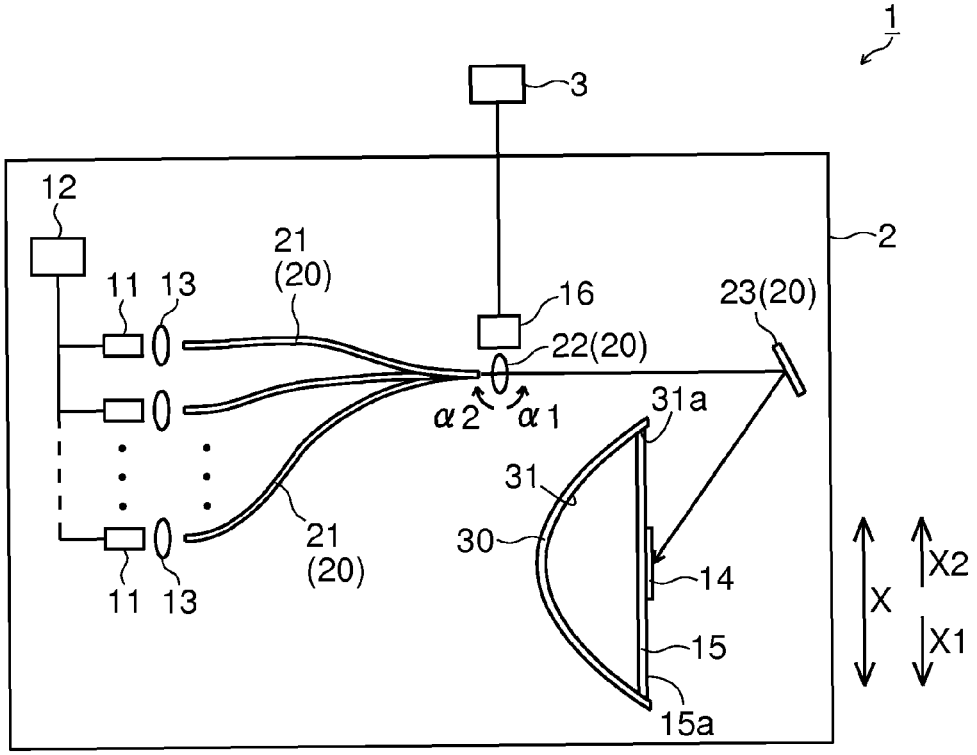
FIG. 1 is a plan view schematically showing an overall design of an automobile provided with a headlamp according to Embodiment 1 of the invention.

As shown in FIG. 1, the automobile 1 according to Embodiment 1 is provided with a headlamp 2 which illuminates forward in the traveling direction during traveling at night, for instance, and a steering angle detector 3 which detects the steering angle of the automobile 1 from a steering wheel or wheels (unillustrated). The automobile 1 is an example of a "mobile body" according to the invention, and the headlamp 2 is an example of a "lighting apparatus" according to the invention.

The headlamp 2 includes: a plurality of (for example, ten) semiconductor laser devices 11 which function as a laser light source; an output adjuster 12 which adjusts the output of the semiconductor laser devices 11; light guide members 20 which are provided on the laser light exit side of the semiconductor laser devices 11 respectively to guide laser light; condenser lenses 13 which are provided between the semiconductor laser devices 11 and the light guide members 20 respectively; a fluorescent member 14 which is irradiated with the laser light guided through the light guide members 20; a holding member 15 which holds the fluorescent member 14; and a reflector (reflective minor) 30 which has a concave reflective surface 31 which reflects forward the light emitted from the fluorescent member 14. The semiconductor laser devices 11 are an example of a "laser generator" according to the invention, and the fluorescent member 14 is an example of a "light emitting member" according to the invention. The reflector 30 is an example of a "light projecting member" and a "first reflector" according to the invention.

For example, two of the headlamps 2 are provided at the front end of the automobile 1, one on the left and the other on the right.

The semiconductor laser devices 11 have the function of emitting coherent laser light. The semiconductor laser devices 11 are each housed in a package with a diameter of, for example, about 5.6 mm. The semiconductor laser devices 11 are designed to emit blue laser light with a center wavelength of, for example, about 445 nm. Moreover, the semiconductor laser devices 11 are designed to yield a high output of about 1 W or more each by CW (continuous wave) driving.

The output adjuster 12 is designed to adjust the electric power supplied to the semiconductor laser devices 11 and thereby adjust the output of the laser light emitted from the semiconductor laser devices 11. The output adjuster 12 may be so designed as to be connected to a controller (unillustrated) which controls the entire headlamp 2 so that, in accordance with a control signal from the controller, the output adjuster 12 adjusts the electric power supplied to the semiconductor laser devices 11.

As will be described later, the output adjuster 12 has the function of adjusting the output of the semiconductor laser devices 11 in synchronism with the change of the irradiated position on the fluorescent member 14 at which it is irradiated with laser light.

The condenser lenses 13 have the function of condensing (make into a convergent beam) the laser light emitted from the semiconductor laser devices 11 to make it enter optical fibers 21 which constitute the light guide members 20.

The light guide members 20 are composed of a plurality of optical fibers 21 which are disposed opposite the condenser lenses 13, a collimator lens 22 which is disposed opposite the laser light exit faces of the optical fibers 21, and a reflector (reflective mirror) 23 which is disposed in the optical path of the laser light that has passed through the collimator lens 22. The collimator lens 22 is an example of a "lens" and a "collimator lens" according to the invention.

The optical fibers 21 are each composed of a core portion with a diameter of, for example, about 125 μm and a cladding portion which covers the outer circumferential surface of the core portion. The optical fibers 21 are, at their laser light exit ends, bundled together.

Figure 2:
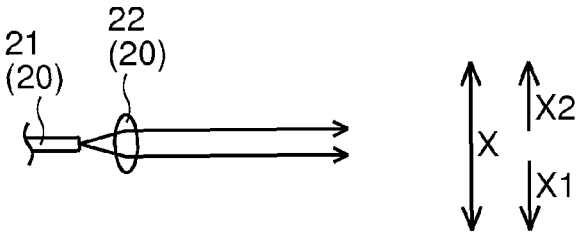
FIG. 2 is a plan view illustrating the laser light passing through the collimator lens shown in FIG. 1.

The collimator lens 22 has a diameter of, for example, 6 mm. Moreover, as shown in FIG. 2, the collimator lens 22 has the function of making the laser light emitted from the optical fibers 21 into a parallel beam while transmitting it. Moreover, as shown in FIG. 1, the collimator lens 22 is so arranged as to be rotatable, by an actuator 16, within a predetermined range of angles in the left/right direction (in the $\alpha 1$ and $\alpha 2$ directions). The actuator 16 is an example of an "irradiation position changer" according to the invention.

The actuator 16 is electrically connected to the steering angle detector 3, and has the function of adjusting the angle of the collimator lens 22 with respect to the axial direction of the optical fibers 21 in accordance with the steering angle detected by the steering angle detector 3. Between the actuator 16 and the steering angle detector 3, a controller (unillustrated) which controls the entire headlamp 2 may be provided so that the controller outputs a control signal to the actuator 16 in accordance with a detection signal from the steering angle detector 3.

Moreover, in Embodiment 1, as will be described later, the actuator 16 also has the function of moving (changing), and thereafter stopping (maintaining), the irradiated position on the fluorescent member 14 at which it is irradiated with laser light in the horizontal direction (X direction) so as to vary the distance from the focal point F1 (see FIG. 3) of the reflective surface 31 of the reflector 30 to the irradiated position on the fluorescent member 14. The X direction is an example of a "predetermined direction" according to the invention.

Here, "moving and thereafter stopping the irradiated position" means, instead of keeping the irradiated position scanned with laser light, moving the irradiated position to a desired position and then keeping it substantially at rest there. Here, "keeping it substantially at rest" includes swinging the irradiated position at the movement destination within a range smaller than the movement distance. The phrase even embraces, for example, keeping the irradiated position momentarily at rest at the movement destination and then moving it back.

The reflector 23 has the function of reflecting the laser light from the collimator lens 22 toward the fluorescent member 14.

Moreover, in Embodiment 1, the reflector 23 is disposed forward of the fluorescent member 14 (on the light exit side of the reflector 30). That is, the laser light from the semiconductor laser devices 11 is applied to the fluorescent member 14 from in front. Thus, even if the fluorescent member 14 happens to come off the holding member 15, the laser light is prevented from being emitted forward intact.

Figure 3:
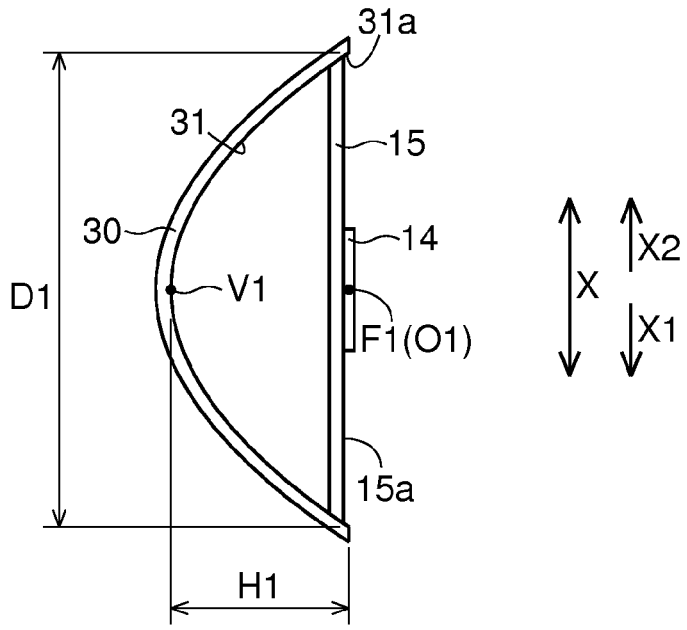
FIG. 3 is a sectional view showing the structure of the reflector and the fluorescent member shown in FIG. 1 as seen from above.
Figure 4:
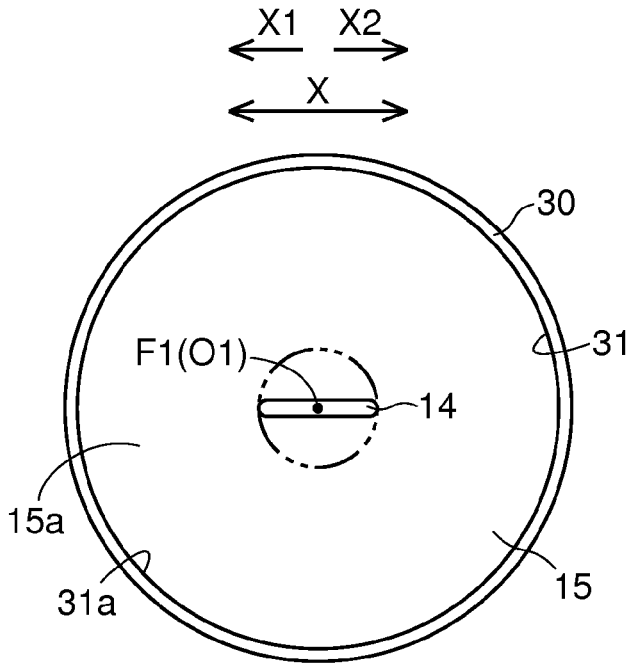
FIG. 4 is a front view showing the structure of the reflector and the fluorescent member shown in FIG. 1.

As shown in FIG. 3, the fluorescent member 14 is so formed as to extend in the direction perpendicular to (crossing) the depth direction of the reflective surface 31 of the reflector 30 (the direction in which the axis through the vertex V1 and the focal point F1 of the reflective surface 31 extends). Moreover, as shown in FIG. 4, the fluorescent member 14 is formed in an elongate shape extending in the left/right direction (horizontal direction, X direction) as seen from in front. The fluorescent member 14 may instead be formed, for example, in a circular shape as seen from in front as indicated by a dash-dot-dot line in FIG. 4.

Moreover, in Embodiment 1, as will be described later, the irradiated position on the fluorescent member 14 at which it is irradiated with laser light (for example, the center position of the irradiated region on the fluorescent member 14 in which it is irradiated with laser light) is changed (moved) in the X direction in accordance with the traveling condition of the automobile 1.

The light emitted from the fluorescent member 14 is emitted in all directions from the fluorescent member 14, and accordingly part of the light is emitted forward (outside) without striking the reflector 30. The present specification, however, mainly discusses the light that is emitted forward by way of the reflector 30.

Moreover, as shown in FIG. 3, the fluorescent member 14 is disposed at the boundary between the inside and outside of the reflective surface 31 (reflector 30). Moreover, as shown in FIGS. 3 and 4, the fluorescent member 14 is disposed in a region that includes the focal point F1 of the reflective surface 31 of the reflector 30, and the center O1 of the fluorescent member 14 approximately coincides with the focal point F1 of the reflective surface 31. The fluorescent member 14 may instead be disposed near the focal point F1 of the reflective surface 31 of the reflector 30.

Moreover, the fluorescent member 14 is formed by dispersing, in UV-curing resin, about 15% by weight of powder of phosphor particles of $(Y,Gd)_3Al_5O_{12}$:Ce, then applying the UV-curing resin on the holding member 15 in a layer with a thickness of about 0.5 mm, and then curing the UV-curing resin.

The phosphor $(Y,Gd)_3Al_5O_{12}$:Ce has the function of converting part of the laser light from the semiconductor laser devices 11 into yellow light (visible light). The yellow light mixes with the blue light that has remained unconverted by the phosphor to produce white light.

The holding member 15 is formed of a light transmitting (transparent or translucent) material, for example a sheet of glass. The holding member 15 has only to have the function of transmitting at least the light emitted from the fluorescent member 14.

Moreover, as shown in FIG. 3, the holding member 15 has a holding surface 15*a* to which the fluorescent member 14 is fitted. The holding surface 15*a* is so formed as to extend in the direction (X direction) perpendicular to (crossing) the depth direction of the reflective surface 31 of the reflector 30. The holding member 15 is fitted to the opening (brim) 31*a* of the reflective surface 31 of the reflector 30.

The reflector 30 includes the reflective surface 31 which has the opening 31*a* at the front. The reflective surface 31 is coated with, for example, silver, aluminum, or the like.

Moreover, as will be described later, the reflective surface 31 is so designed that, as the irradiated position on the fluorescent member 14 is changed, the direction in which the light reflected from the reflective surface 31 is emitted outside is changed. Specifically, the reflective surface 31 is formed in the shape of, for example, a paraboloid. In other words, the reflective surface 31 is formed in the shape of a paraboloid divided on a plane perpendicular to (crossing) the axis through the focal point F1 and the vertex V1.

Moreover, as shown in FIG. 3, the reflective surface 31 has a diameter (=D1) of about 90 mm and a depth (=H1) of about 22.5 mm. Moreover, the reflective surface 31 has a focal point F1 and a vertex V1, the focal point F1 being about 22.5 mm apart from the vertex V1.

Figure 5:
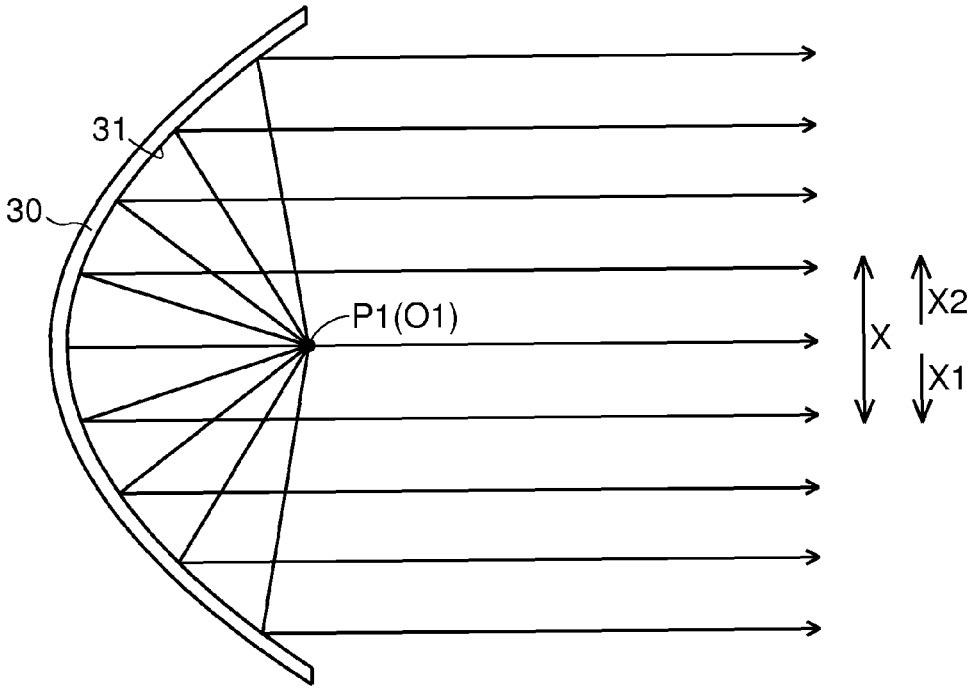
FIG. 5 is a sectional view showing the light reflected on the reflective surface of the reflector shown in FIG. 1 as seen from above.

Moreover, as shown in FIG. 5, the reflector 30 is so formed as to make the light from the center O1 of the fluorescent member 14 (see FIG. 3) (the portion of the fluorescent member 14 located at the focal point F1 (see FIG. 3) of the reflective surface 31) into a parallel beam while reflecting it forward.

In reality, however, the light emitting portion of the fluorescent member 14 (the irradiated region on the fluorescent member 14 in which it is irradiated with laser light) has a certain size (for example, with a diameter of about 2 mm), and therefore the light emitted from the reflector 30 is not a perfectly parallel beam; even so, in the present specification, for the sake of simple description, the light emitted from the reflector 30 is occasionally mentioned as a parallel beam.

Next, with reference to FIGS. 1, 2, and 5 to 12, how the headlamp 2 operates will be described.

Figure 6:
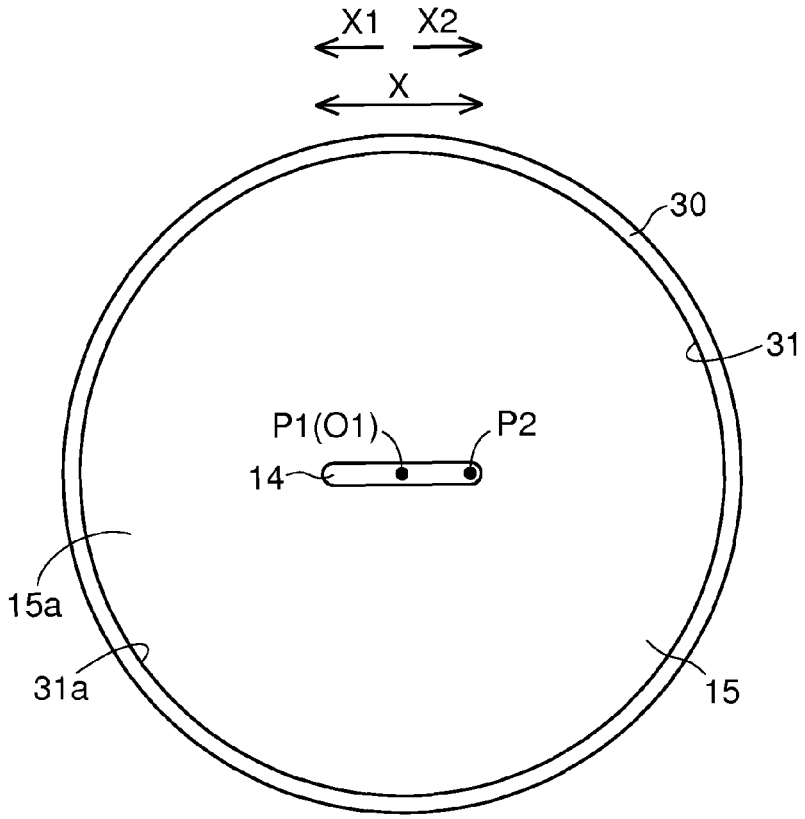
FIG. 6 is a front view showing the structure of the reflector and the fluorescent member shown in FIG. 1.
Figure 7:
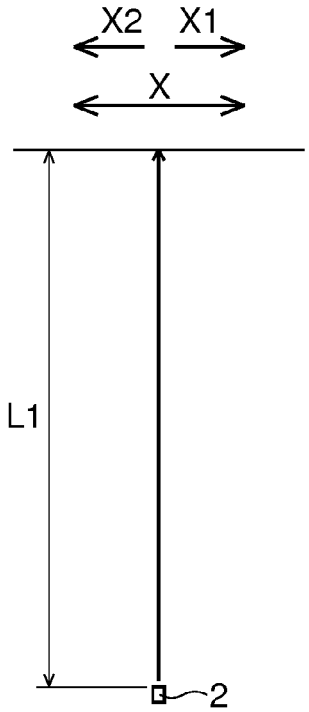
FIG. 7 is a plan view illustrating the illuminating direction of the headlamp shown in FIG. 1.

When the automobile 1 is traveling straight forward, as shown in FIGS. 1 and 6, the laser light emitted from the semiconductor laser devices 11 and guided through the light guide members 20 is applied to the center O1 of the fluorescent member 14 (the irradiated position P1 on the fluorescent member 14). Thus, as shown in FIGS. 5 and 7, the light reflected from the reflector 30 is made into an approximately parallel beam and emitted forward with respect to the automobile 1 (in the direction perpendicular to the X direction).

Figure 8:
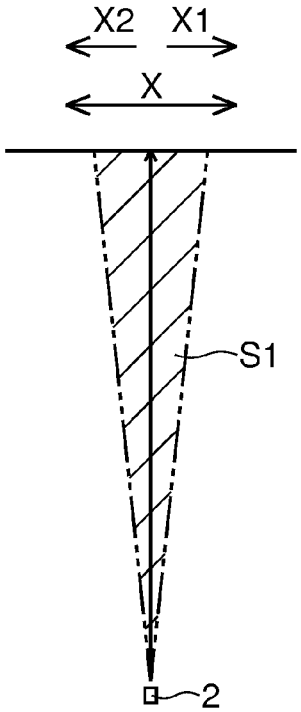
FIG. 8 is a plan view illustrating the illuminated region of the headlamp shown in FIG. 1.
Figure 9:
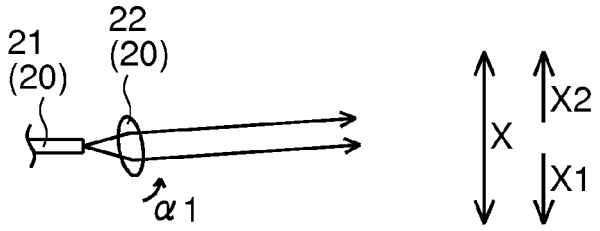
FIG. 9 is a plan view illustrating the laser light passing through the collimator lens shown in FIG. 1.

Since, in practice, the fluorescent member 14 has a certain size as described above, the light reflected from the reflector 30 illuminates an illuminated region S1 (the hatched region) in FIG. 8.

By contrast, when the automobile 1 turns right, for instance, the driver operates the steering wheel (unillustrated) to give the automobile 1 a steering angle. The steering angle detector 3 (see FIG. 1) then detects the steering angle of the automobile 1. In accordance with the steering angle detected by the steering angle detector 3, the angle of the collimator lens 22 (see FIG. 1) is changed by the actuator 16 (see FIG. 1).

Specifically, when the automobile 1 is given a steering angle to the right (in the X1 direction), the angle of the collimator lens 22 is changed to the left (in the $\alpha$1 direction (see FIG. 1)) by the actuator 16. That is, the angle of the collimator lens 22 is changed from that shown in FIG. 2 to that shown in FIG. 9. This changes the traveling direction of the laser light.

Figure 10:
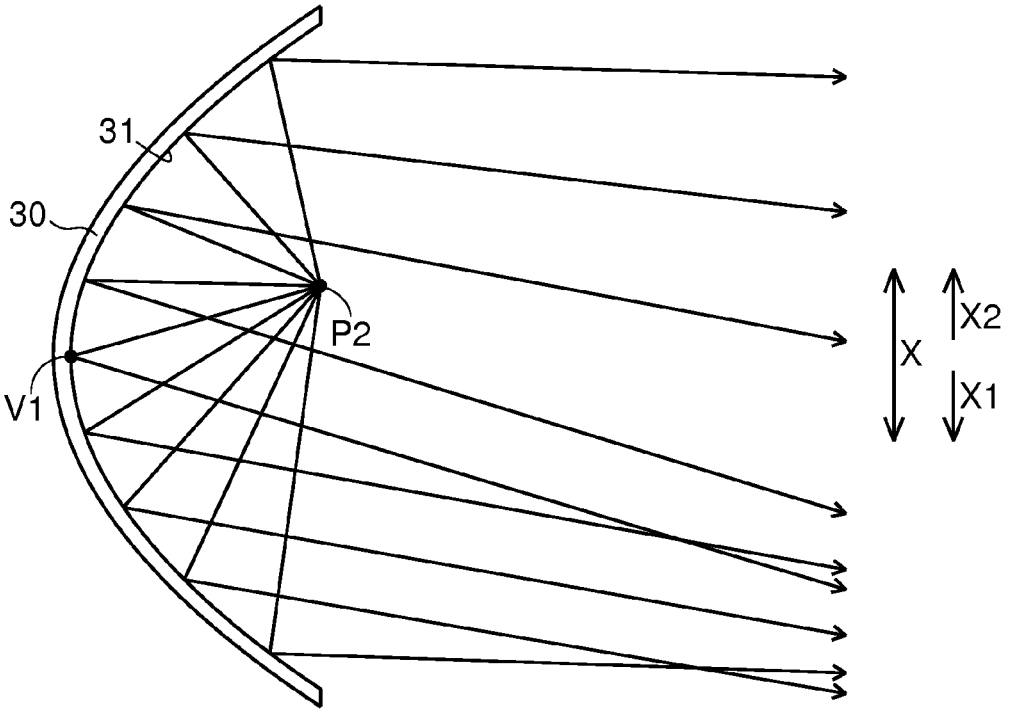
FIG. 10 is a sectional view showing the light reflected on the reflective surface of the reflector shown in FIG. 1 as seen from above.
Figure 11:
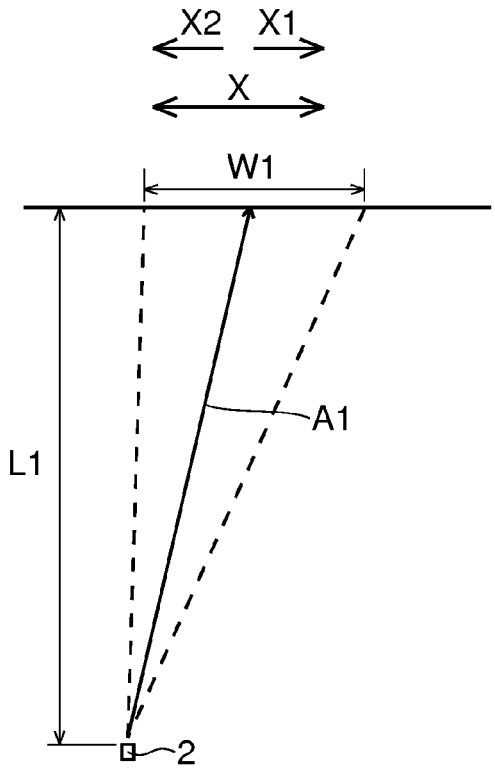
FIG. 11 is a plan view illustrating the illuminating direction of the headlamp shown in FIG. 1.

As a result, the irradiated position on the fluorescent member 14 is changed (moved) from P1 to P2 (see FIG. 6), across a distance of about 10 mm, and is then stopped at P2. That is, the irradiated position on the fluorescent member 14 is changed (moved) in the X2 direction (the direction opposite to the X1 direction), and in addition the distance from the focal point F1 of the reflective surface 31 to the irradiated position on the fluorescent member 14 changes. As shown in FIGS. 10 and 11, the light reflected from the reflector 30 is now emitted obliquely forward right. In FIG. 11, arrow A1 represents the optical axis of the light reflected from the reflector 30 (of the light emitted from the reflector 30, the portion with the greatest luminous flux).

Moreover, as shown in FIG. 10, in the headlamp 2 according to Embodiment 1, the light reflected near the vertex V1 of the reflective surface 31 has its angle changed most greatly, namely about 24 degrees to the right (in the X1 direction). Thus, as shown in FIG. 11, the light reflected from the reflector 30 is so emitted as to illuminate, at about 10 m (=L1) ahead of the headlamp 2 (automobile 1), a region ranging from straight ahead to about 4.4 m (=W1) to the right.

Figure 12:
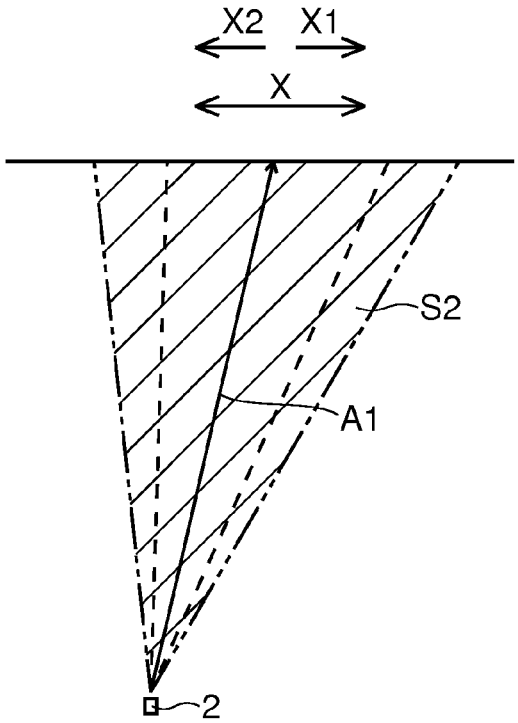
FIG. 12 is a plan view illustrating the illuminated region of the headlamp shown in FIG. 1.

Moreover, since, in practice, the fluorescent member 14 has a certain size as described above, the light reflected from the reflector 30 illuminates an illuminated region S2 (the hatched region) in FIG. 12.

In this way, as the irradiated position on the fluorescent member 14 is changed, not only is the illuminating direction changed, but also the area (size) of the illuminated region is changed. Thus, the change from the state in FIG. 7 (FIG. 8) to the state in FIG. 11 (FIG. 12) increases the area of the illuminated region and accordingly dims the illuminated region S2. To cope with this, in Embodiment 1, in synchronism with the change (movement) of the irradiated position on the fluorescent member 14, the output adjuster 12 increases the output of the laser light emitted from the semiconductor laser devices 11 to keep the illuminance in the illuminated region approximately constant.

In Embodiment 1, as described above, by changing the irradiated position on the fluorescent member 14 by use of the actuator 16, it is possible to change the illuminating direction of the headlamp 2 (the direction in which light is emitted from the headlamp 2 outside). Thus, there is no need to provide an extra member for changing the orientation of the reflector 30 for the purpose of changing the illuminating direction of the headlamp 2, and thus it is possible to suppress an increase in the size of the headlamp 2 as a whole.

Moreover, in Embodiment 1, as described above, by using laser light as excited light, it is possible to easily narrow down (reduce) the irradiated region on the fluorescent member 14. Thus, by changing the traveling direction of the laser light, it is possible to easily change the irradiated position on the fluorescent member 14.

Moreover, in Embodiment 1, as described above, the fluorescent member 14 is disposed in a region that includes the focal point F1 of the reflective surface 31. Thus, by changing (moving) the irradiated position on the fluorescent member 14 from the focal point F1 of the reflective surface 31 (the irradiated position P1) to a position (the irradiated position P2) different from the focal point F1, it is possible to easily change the illuminating direction of the headlamp 2.

Moreover, in a case where the irradiated position on the fluorescent member 14 is located at the focal point F1 of the reflective surface 31 (the irradiated position P1), it is possible to easily make the light (illumination light) emitted outside from the headlamp 2 into a parallel beam.

Moreover, in Embodiment 1, as described above, the irradiated position on the fluorescent member 14 is changed by the actuator 16 in such a way as to vary the distance from the focal point F1 of the reflective surface 31 to the irradiated position on the fluorescent member 14. This makes it possible to easily change the illuminating direction of the headlamp 2.

Moreover, in Embodiment 1, simply by changing the angle of the collimator lens 22, it is possible to easily change the illuminating direction of the headlamp 2.

All that has to be done to change the irradiated position on the fluorescent member 14 is to change the angle of the collimator lens 22, and thus it is possible to easily make the actuator 16 compact.

Moreover, in Embodiment 1, as described above, the light guide members 20 are provided with the collimator lens 22 which makes the laser light emitted from the semiconductor laser devices 11 into a parallel beam. This makes it possible to easily narrow down (reduce) the irradiated region on the fluorescent member 14.

Embodiment 2

As a second embodiment (Embodiment 2) of the invention, with reference to FIGS. 13 to 21, a description will be given of a case where, as distinct from in Embodiment 1 described previously, the focal point F101 of the reflective surface 131 is located near the vertex V101.

First, with reference to FIGS. 13 to 16, the design of an automobile 101 provided with a headlamp 102 according to Embodiment 2 will be described.

Figure 13:
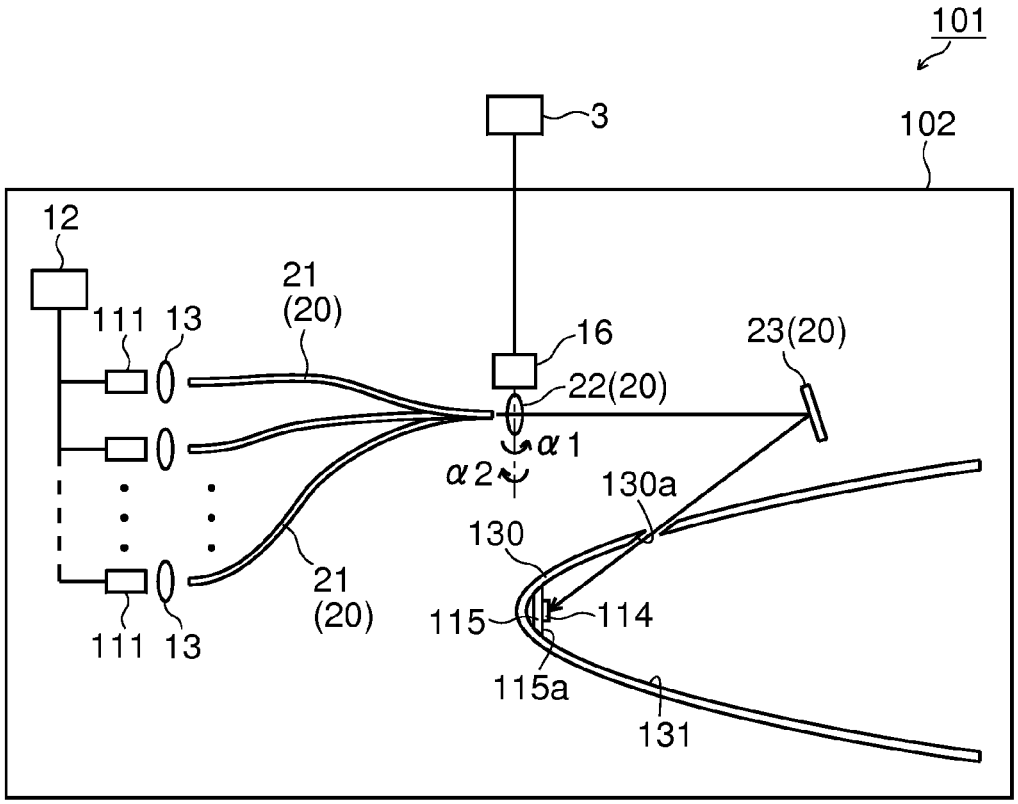
FIG. 13 is a side view schematically showing an overall design of an automobile provided with a headlamp according to Embodiment 2 of the invention.

As shown in FIG. 13, the automobile 101 according to Embodiment 2 is provided with a headlamp 102 and a steering angle detector 3 which detects the steering angle of the automobile 101. The automobile 101 is an example of a "mobile body" according to the invention, and the headlamp 102 is an example of a "lighting apparatus" according to the invention.

The headlamp 102 includes: a plurality of (for example, ten) semiconductor laser devices 111; an output adjuster 12; light guide members 20; condenser lenses 13; a fluorescent member 114; a holding member 115; and a reflector 130 which has a reflective surface 131. The semiconductor laser devices 111 are an example of a "laser generator" according to the invention, and the fluorescent member 114 is an example of a "light emitting member" according to the invention. The reflector 130 is an example of a "light projecting member" and a "first reflector" according to the invention.

The semiconductor laser devices 111 are designed to emit blue-violet laser light with a center wavelength of, for example, about 405 nm.

Figure 14:
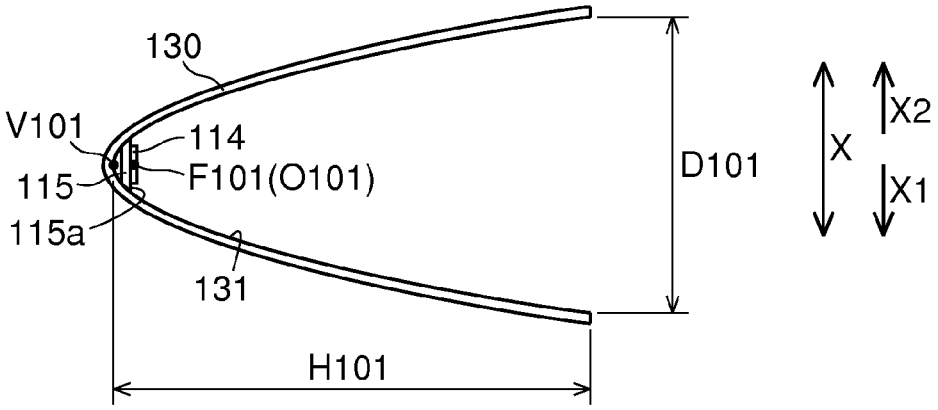
FIG. 14 is a sectional view showing the structure of the reflector and the fluorescent member shown in FIG. 13 as seen from above.

As shown in FIG. 14, the fluorescent member 114 is so formed as to extend in the direction perpendicular to (crossing) the depth direction of the reflective surface 131 of the reflector 130 (the direction in which the axis through the vertex V101 and the focal point F101 of the reflective surface 131 extends). Moreover, as shown in FIG. 15, the fluorescent member 114 is formed in an elongate shape extending in the left/right direction (horizontal direction, X direction) as seen from in front.

Figure 15:
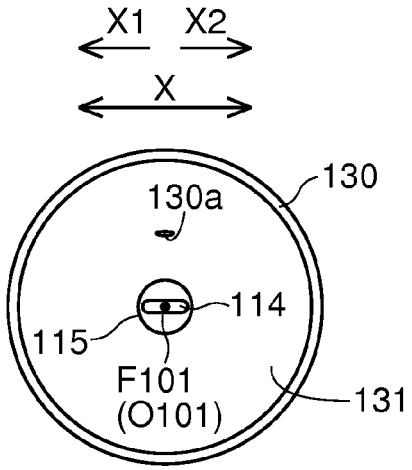
FIG. 15 is a front view showing the structure of the reflector and the fluorescent member shown in FIG. 13.

Moreover, as shown in FIGS. 14 and 15, the fluorescent member 114 is disposed in a region that includes the focal point F101 of the reflective surface 131 of the reflector 130, and the center O101 of the fluorescent member 114 approximately coincides with the focal point F101 of the reflective surface 131.

Moreover, the fluorescent member 114 is formed by dispersing, in UV-curing resin, about 30% by weight of mixed powder of phosphor particles of $Ce^{3+}$-activated α-SiAlON and phosphor particles of $CaAlSiN_3:Eu^{2+}$, then applying the UV-curing resin on the holding member 115 in a layer with a thickness of about 0.2 mm, and then curing the UV-curing resin.

The phosphor $Ce^{3+}$-activated α-SiAlON has the function of converting the laser light from the semiconductor laser devices 111 into blue-green light (visible light) with a center wavelength of about 520 nm. On the other hand, the phosphor $CaAlSiN_3:Eu^{2+}$ has the function of converting the laser light from the semiconductor laser devices 111 into red light (visible light) with a center wavelength of about 630 nm. The light of these different colors mixes to produce white light.

The holding member 115 is formed of a sheet of metal with high thermal conductivity such as aluminum or copper, and has the function of conducting the heat generated in the fluorescent member 114 to the reflector 130. The holding surface 115*a* of the holding member 115 may be plated with silver or the like so as to have the function of reflecting the light emitted from the fluorescent member 114.

Moreover, in Embodiment 2, as shown in FIG. 14, the holding member 115 is fitted near the vertex V101 of the reflective surface 131 of the reflector 130.

Here, in Embodiment 2, the reflective surface 131 of the reflector 130 is formed in the shape of a deep hole with an aspect ratio (depth-to-diameter ratio) of 1 or more. Specifically, the reflective surface 131 has a diameter (=D101) of about 60 mm and a depth (=H101) of about 80 mm. Moreover, the focal point F101 of the reflective surface 131 is located near the vertex V101 of the reflective surface 131 (the portion of the reflective surface 131 about 2.8 mm apart from the vertex V101). That is, the fluorescent member 114 is disposed near the vertex V101 of the reflective surface 131 (reflector 130).

Moreover, as shown in FIG. 13, the reflector 130 has a through hole 130*a* formed in it, and through the through hole 130*a*, laser light is applied to the fluorescent member 114.

Moreover, in Embodiment 2, the reflector 130 is so formed as to reflect forward the light emitted from the fluorescent member 114 in the direction from which it is irradiated with laser.

Figure 16:
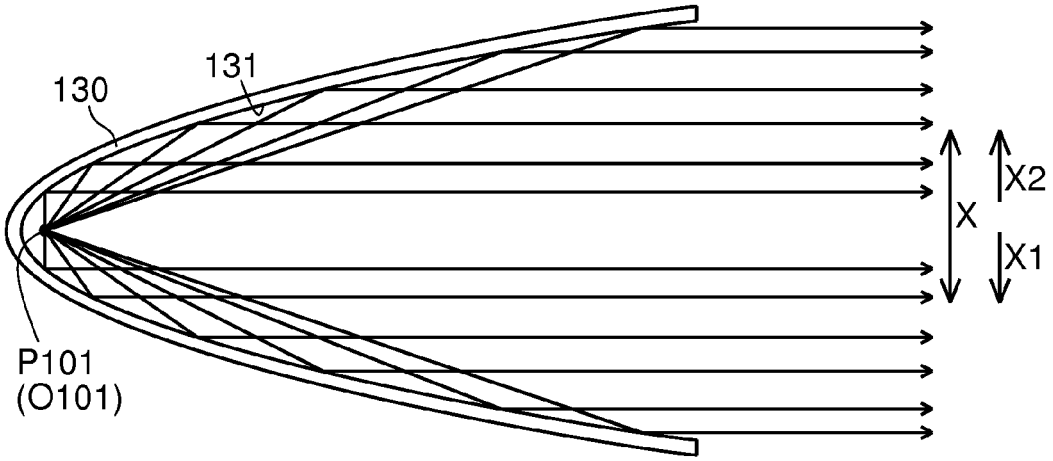
FIG. 16 is a sectional view showing the light reflected on the reflective surface of the reflector shown in FIG. 13 as seen from above.

Moreover, as shown in FIG. 16, the reflector 130 is so formed as to make the light from the center O101 of the fluorescent member 114 (the portion of the fluorescent member 114 located at the focal point F101 of the reflective surface 131) into a parallel beam while reflecting it forward.

In other respects, the design in Embodiment 2 is similar to that in Embodiment 1 described previously.

Next, with reference to FIGS. 13 and 16 to 21, how the headlamp 102 operates will be described.

Figure 17:
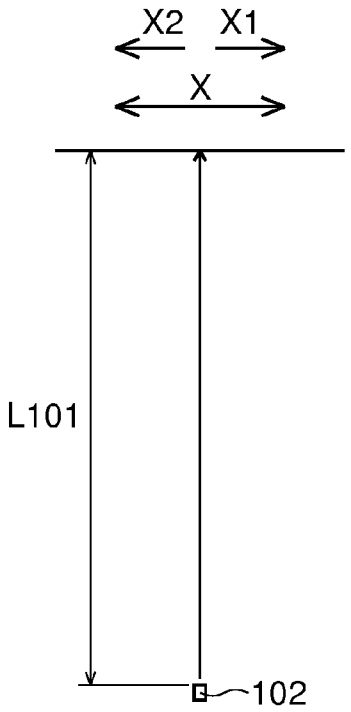
FIG. 17 is a plan view illustrating the illuminating direction of the headlamp shown in FIG. 13.

When the automobile 101 is traveling straight forward, as shown in FIGS. 13 and 16, the laser light emitted from the semiconductor laser devices 111 and guided through the guide members 20 is applied to the center O101 of the fluorescent member 114 (the irradiated position P101 on the fluorescent member 114). Thus, as shown in FIGS. 16 and 17, the light reflected from the reflector 130 is made into an approximately parallel beam and emitted forward with respect to the automobile 101 (in the direction perpendicular to the X direction).

Figure 18:
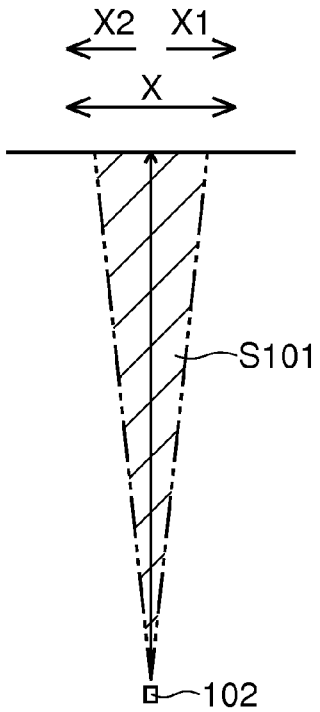
FIG. 18 is a plan view illustrating the illuminated region of the headlamp shown in FIG. 13.

Since, in practice, the fluorescent member 114 has a certain size, the light reflected from the reflector 130 illuminates an illuminated region S101 (the hatched region) in FIG. 18.

By contrast, when the automobile 101 turns right, for instance, the driver operates the steering wheel (unillustrated) to give the automobile 101 a steering angle. The steering angle detector 3 (see FIG. 13) then detects the steering angle of the automobile 101. In accordance with the steering angle detected by the steering angle detector 3, the angle of the collimator lens 22 (see FIG. 13) is changed by the actuator 16 (see FIG. 13).

Specifically, when the automobile 101 is given a steering angle to the right (in the X1 direction), the angle of the collimator lens 22 is changed to the right (in the α2 direction (see FIG. 1)) by the actuator 16. Thus, the traveling direction of the laser light is changed.

Figure 19:
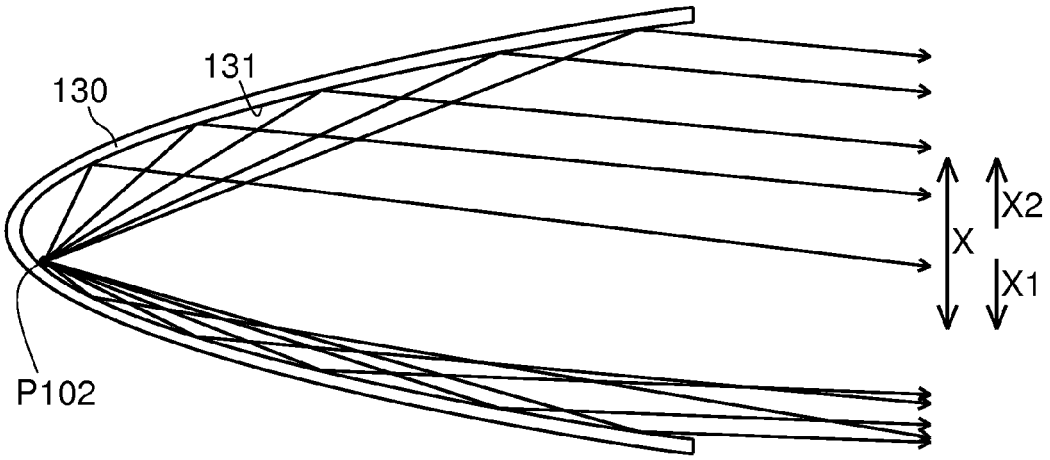
FIG. 19 is a sectional view showing the light reflected on the reflective surface of the reflector shown in FIG. 13 as seen from above.
Figure 20:
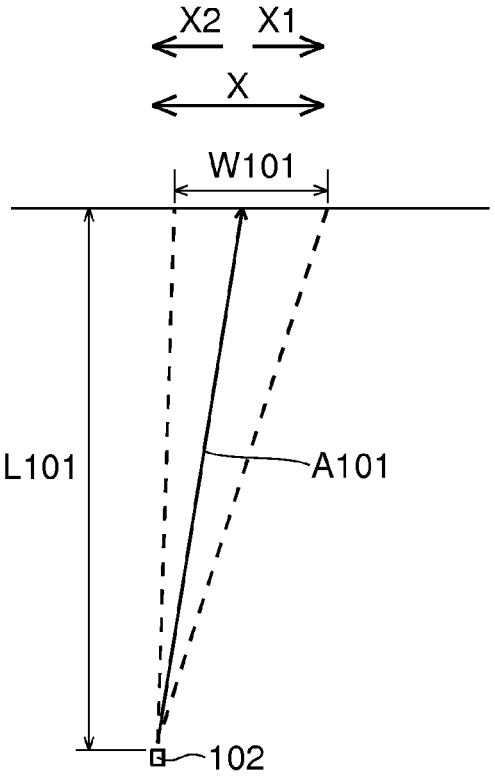
FIG. 20 is a plan view illustrating the illuminating direction of the headlamp shown in FIG. 13.

As a result, the irradiated position on the fluorescent member 114 is changed from P101 (see FIG. 16) to P102 (see FIG. 19), across a distance of about 5 mm. As shown in FIGS. 19 and 20, the light reflected from the reflector 130 is now emitted obliquely forward right. In FIG. 20, arrow A101 represents the optical axis of the light reflected from the reflector 130 (of the light emitted from the reflector 130, the portion with the greatest luminous flux).

Moreover, in the headlamp 102 according to Embodiment 2, the light of which the angle is changed most greatly by the reflective surface 131 has its angle changed by about 9.4 degrees to the right (in the X1 direction). Thus, as shown in FIG. 20, the light reflected from the reflector 130 is so emitted as to illuminate, at about 10 m (=L101) ahead of the headlamp 102 (automobile 101), a region from straight ahead to about 1.7 m (=W101) to the right.

Figure 21:
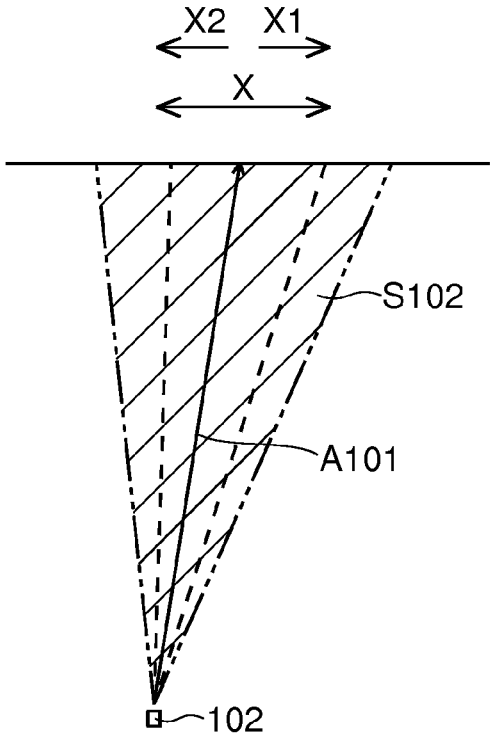

Moreover, since, in practice, the fluorescent member 114 has a certain size, the light reflected from the reflector 130 illuminates an illuminated region 5102 (the hatched region) in FIG. 21.

In other respects, the operation in Embodiment 2 is similar to that in Embodiment 1 described previously.

In Embodiment 2, as described above, the focal point F101 of the reflective surface 131 is located near the vertex V101 of the reflective surface 131, and the fluorescent member 114 is disposed near the vertex V101 of the reflective surface 131. This makes it possible to easily change to one side the direction in which the light reflected from the reflector 130 is emitted outside.

Moreover, by locating the focal point F101 of the reflective surface 131 near the vertex V101 of the reflective surface 131, it is possible to form the reflective surface 131 in the shape of a deep hole having a vertex V101 (focal point F101) located deep and having a small diameter (=D101). This permits a large part of the light emitted from the fluorescent member 114 to be reflected on the reflective surface 131 and then emitted outside. In this way, it is possible to control the direction (illuminating direction) in which a large part of the light emitted from the fluorescent member 114 is emitted outside. Moreover, it is possible to suppress an increase in the fanning angle (spread angle) of the light emitted outside without striking the reflector 130.

Moreover, in Embodiment 2, as described above, the holding member 115 is made of metal, and this makes it possible to reject the heat generated in the fluorescent member 114 to the holding member 115. Thus, it is possible to suppress the fluorescent member 114 becoming hot.

Moreover, in Embodiment 2, as described above, the light emitted from the fluorescent member 114 in the direction (forward) from which it is irradiated with laser light is reflected on the reflector 130. The fluorescent member 114 is brightest, and hence emits the largest amount of light, in its portion where it is irradiated with laser light. Thus, by reflecting on the reflector 130 the light emitted from the fluorescent member 114 in the direction (forward) from which it is irradiated with laser light, it is possible to achieve improved light use efficiency as compared with in Embodiment 1 described previously (where the light emitted from the fluorescent member 14 in the direction (backward) opposite from the direction from which it is irradiated with laser light is reflected on the reflector 30).

In other respects, the benefits of Embodiment 2 are similar to those of Embodiment 1 described previously.

Embodiment 3

As a third embodiment (Embodiment 3) of the invention, with reference to FIG. 22, a description will be given of a case where, as distinct from in Embodiment 1 described previously, laser light is applied to the fluorescent member 214 from behind.

Figure 22:
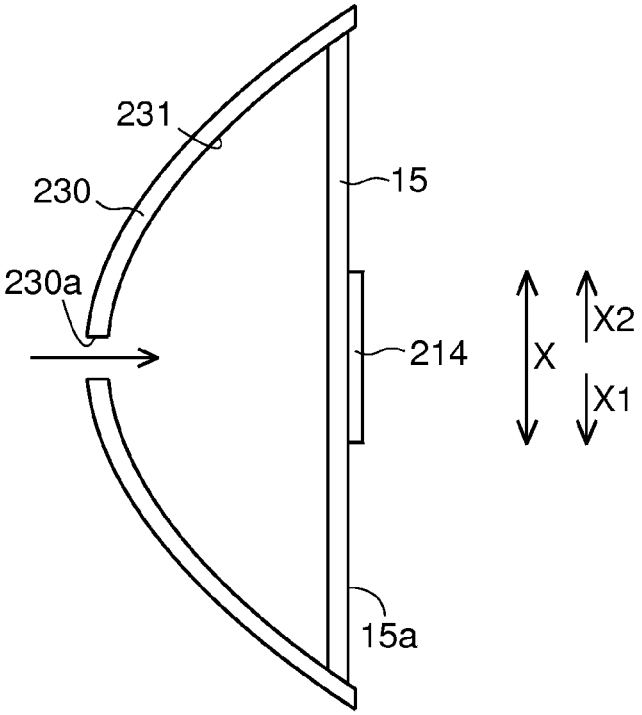
FIG. 22 is a sectional view showing the structure of the reflector and the fluorescent member in a headlamp according to Embodiment 3 of the invention as seen from above.

In the headlamp according to Embodiment 3, as shown in FIG. 22, in a portion of the reflector 230 including the vertex of the reflective surface 231, an opening 230*a* is formed. The reflector 230 is an example of a "light projecting member" and a "first reflector" according to the invention.

The fluorescent member 214 here is, like the fluorescent member 114 in Embodiment 2 described previously, formed by dispersing, in UV-curing resin, about 30% by weight of mixed powder of phosphor particles of $Ce^{3+}$-activated α-SiAlON and phosphor particles of $CaAlSiN_3:Eu^{2+}$, then applying the UV-curing resin on the holding member 15 in a layer with a thickness of about 0.2 mm, and then curing the UV-curing resin. The fluorescent member 214 is an example of a "light emitting member" according to the invention.

In Embodiment 3, as in Embodiment 2 described previously, semiconductor laser devices 111 are used as a laser light source.

In Embodiment 3, laser light is applied through the opening 230*a* in the reflector 230 to the fluorescent member 214.

In other respects, the design in Embodiment 3 is similar to that in Embodiment 1 described previously.

The operation in and benefits of Embodiment 3 are similar to those in and of Embodiment 1 described previously.

Embodiment 4

As a fourth embodiment (Embodiment 4) of the invention, with reference to FIG. 23, a description will be given of a case where, as distinct from in Embodiment 2 described previously, laser light is applied to the fluorescent member 314 from behind.

Figure 23:
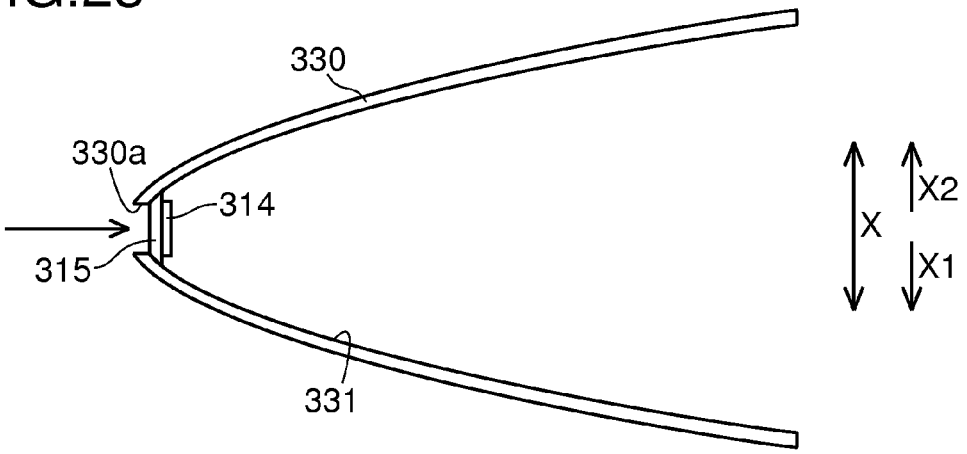
FIG. 23 is a sectional view showing the structure of the reflector and the fluorescent member in a headlamp according to Embodiment 4 of the invention as seen from above.

In the headlamp according to Embodiment 4, as shown in FIG. 23, in a portion of the reflector 330 including the vertex of the reflective surface 331, an opening 330*a* is formed. The reflector 330 is an example of a "light projecting member" and a "first reflector" according to the invention.

The fluorescent member 314 here is, like the fluorescent member 14 in Embodiment 1 described previously, formed, for example, by dispersing, in UV-curing resin, about 15% by weight of powder of phosphor particles of $(Y,Gd)_3Al_5O_{12}:Ce$, then applying the UV-curing resin on the holding member 115 in a layer with a thickness of about 0.5 mm, and then curing the UV-curing resin. The fluorescent member 314 is an example of a "light emitting member" according to the invention.

In Embodiment 4, as in Embodiment 1 described previously, semiconductor laser devices 11 are used as a laser light source.

Moreover, the holding member 315 is formed of a light transmitting material, for example a sheet of glass. The holding member 315 has only to have the function of transmitting at least laser light.

In Embodiment 4, laser light is applied through the opening 330*a* in the reflector 330 to the fluorescent member 314.

In other respects, the design in Embodiment 4 is similar to that in Embodiment 2 described previously.

The operation in and benefits of Embodiment 4 are similar to those of Embodiments 1 and 2 described previously.

Embodiment 5

As a fifth embodiment (Embodiment 5) of the invention, with reference to FIGS. 24 and 25, a description will be given of a case where, as distinct from in Embodiment 2 described previously, no reflector 430 is provided below the fluorescent member 414.

Figure 24:
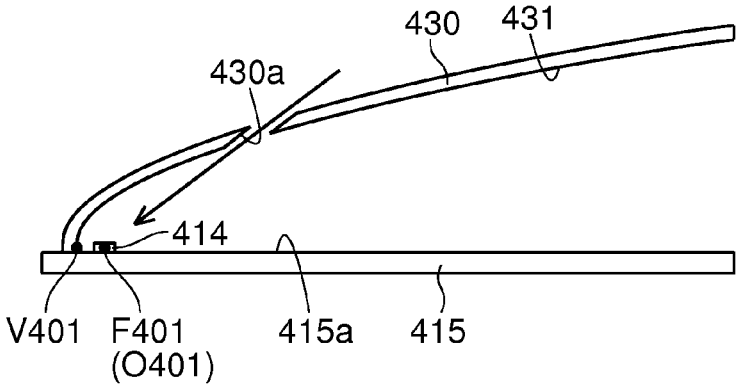
FIG. 24 is a sectional view showing the structure of the reflector and the fluorescent member in a headlamp according to Embodiment 5 of the invention as seen from a side.

In the headlamp according to Embodiment 5, as shown in FIG. 24, the reflective surface 431 of the reflector 430 is formed in the shape of a paraboloid divided on a plane perpendicular to (crossing) the axis through the vertex V401 and the focal point F401 and further divided on a plane parallel to the axis through the vertex V401 and the focal point F401

That is, the reflector 430 is formed in the shape of the reflector 130 in Embodiment 2 described previously with its approximately the lower half cut off. Thus, no portion of the reflector 430 lies below the fluorescent member 414. The fluorescent member 414 is an example of a "light emitting member" according to the invention, and the reflector 430 is an example of a "light projecting member" and a "first reflector" according to the invention.

Moreover, the reflector 430 has a through hole 430*a* formed in it, and through the through hole 430*a*, laser light is applied to the fluorescent member 414.

Moreover, in Embodiment 5, the holding member 415 is disposed so as to cover the bottom of the reflector 430. That is, the holding surface 415*a* of the holding member 415 is so formed as to extend both in the depth direction of the reflective surface 431 of the reflector 430 (the direction in which the axis through the vertex V401 and the focal point F401 extends) and in the X direction (see FIG. 25).

Moreover, the holding member 415 is formed of a sheet of metal, and has the function of rejecting, and conducting to the reflector 430, the heat generated in the fluorescent member 414. The holding surface 415*a* of the holding member 415 may be given the function of reflecting the light emitted from the fluorescent member 414.

Figure 25:
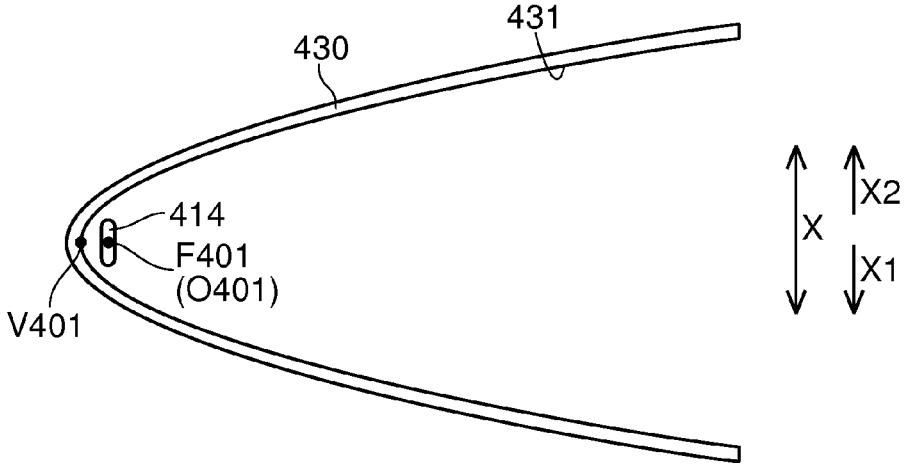
FIG. 25 is a sectional view showing the structure of the reflector and the fluorescent member shown in FIG. 24 as seen from above.

As shown in FIG. 25, the fluorescent member 414 is formed in an elongate shape extending in the left/right direction (horizontal direction, X direction).

Moreover, as shown in FIGS. 24 and 25, the fluorescent member 414 is disposed in a region on the reflector 430 that includes the focal point F401 of the reflective surface 431, and the center O401 of the fluorescent member 414 approximately coincides with the focal point F401 of the reflective surface 431.

Moreover, the fluorescent member 414 is, as in Embodiments 2 and 3 described previously, formed, for example, by dispersing, in UV-curing resin, about 30% by weight of mixed powder of phosphor particles of $Ce^{3+}$-activated α-SiAlON and phosphor particles of $CaAlSiN_3:Eu^{2+}$, then applying the UV-curing resin on the holding member 415 in a layer with a thickness of about 0.2 mm, and then curing the UV-curing resin.

In Embodiment 5, as in Embodiments 2 and 3 described previously, semiconductor laser devices 111 are used as a laser light source.

In other respects, the design and operation in Embodiment 5 are similar to those in Embodiment 2 described previously.

In Embodiment 5, as described above, the reflective surface 431 (reflector 430) is formed in the shape of a paraboloid divided on a plane crossing the axis through the focal point F401 and the vertex V401 and further divided on a plane parallel to the axis through the focal point F401 and the vertex V401. This makes it possible to make the reflector 430 and the headlamp compact.

In other respects, the benefits of Embodiment 5 are similar to those of Embodiment 2 described previously.

Embodiment 6

As a sixth embodiment (Embodiment 6) of the invention, with reference to FIGS. 26 to 31, a description will be given of a case where, as distinct from in Embodiment 5 described previously, the fluorescent member 514 is so formed as to extend in the depth direction of the reflective surface 531 of the reflector 530.

First, with reference to FIGS. 26 and 27, the design of a headlamp according to Embodiment 6 will be described.

Figure 26:
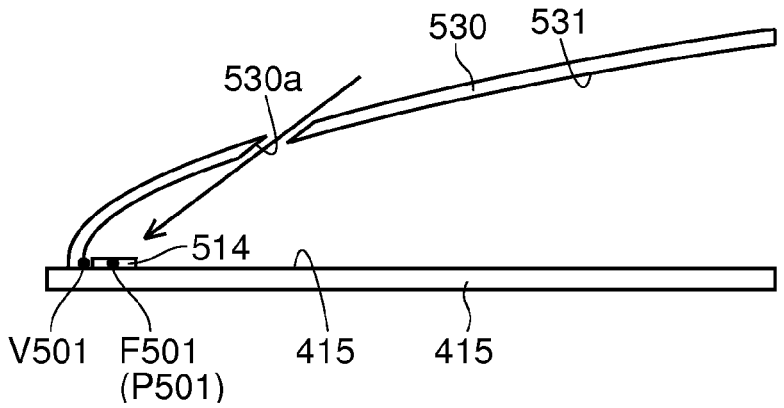
FIG. 26 is a sectional view showing the structure of the reflector and the fluorescent member in a headlamp according to Embodiment 6 of the invention as seen from a side.
Figure 27:
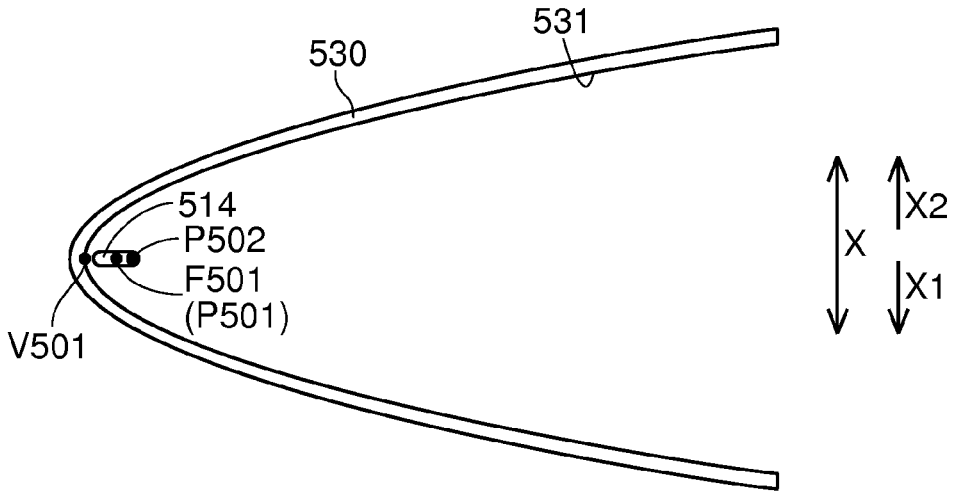
FIG. 27 is a sectional view showing the structure of the reflector and the fluorescent member shown in FIG. 26 as seen from above.

In the headlamp according to Embodiment 6, as shown in FIGS. 26 and 27, the fluorescent member 514 is formed in an elongate shape extending in the depth direction of the reflective surface 531 of the reflector 530 (the direction in which the axis through the vertex V501 and the focal point F501 extends). The fluorescent member 514 is an example of a "light emitting member," and the reflector 530 is an example of a "light projecting member" and a "first reflector."

Moreover, in Embodiment 6, the irradiated position on the fluorescent member 514 is changed (moved) in the depth direction of the reflective surface 531. The irradiated position on the fluorescent member 514 can be changed (moved) in the depth direction of the reflective surface 531 by, for example, rotating the collimator lens 22 in the up/down direction with the actuator 16.

In other respects, the design in Embodiment 6 is similar to that in Embodiment 5 described previously.

Next, with reference to FIGS. 26 to 31, how the headlamp operates will be described.

Figure 28:
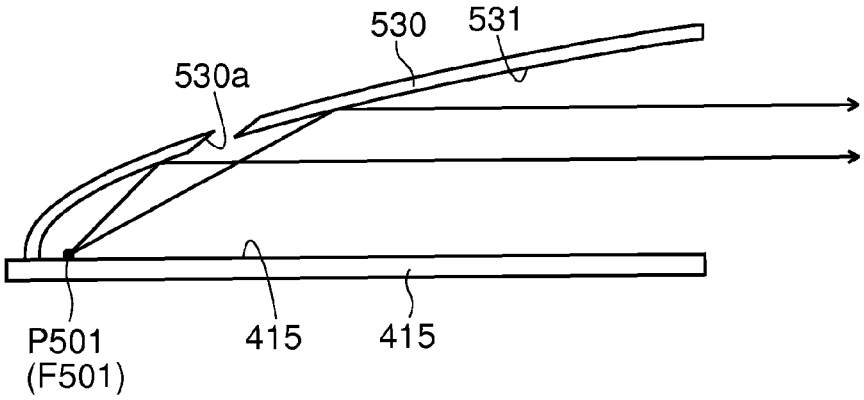
FIG. 28 is a sectional view showing the light reflected on the reflective surface of the reflector shown in FIG. 26 as seen from a side.
Figure 29:
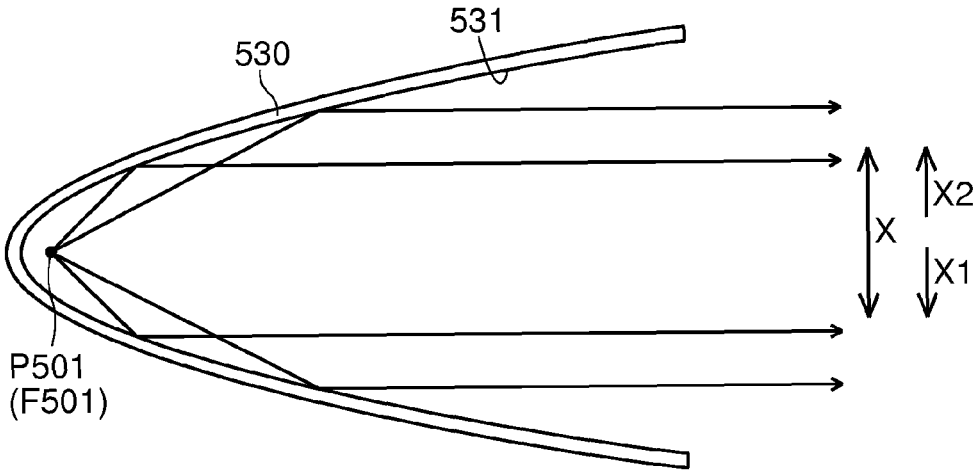
FIG. 29 is a sectional view showing the light reflected on the reflective surface of the reflector shown in FIG. 26 as seen from above.

When the headlamp is set for, for example, a driving beam (high beam), as shown in FIGS. 28 and 29, laser light is applied to the portion of the fluorescent member 514 (see FIGS. 26 and 27) corresponding to the focal point F501 of the reflective surface 531 (that is, the irradiated position P501). Thus, the light reflected from the reflector 530 is made into a parallel beam and emitted forward with respect to the automobile. In this state, the illuminated region illuminated by the headlamp is comparatively narrow.

Figure 30:
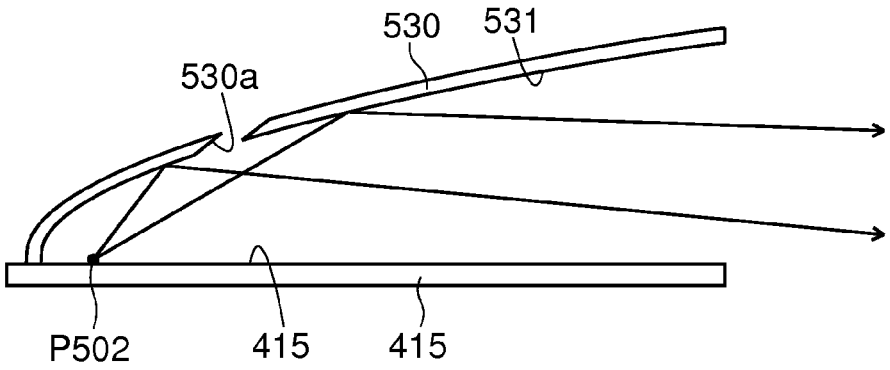
FIG. 30 is a sectional view showing the light reflected on the reflective surface of the reflector shown in FIG. 26 as seen from a side.
Figure 31:
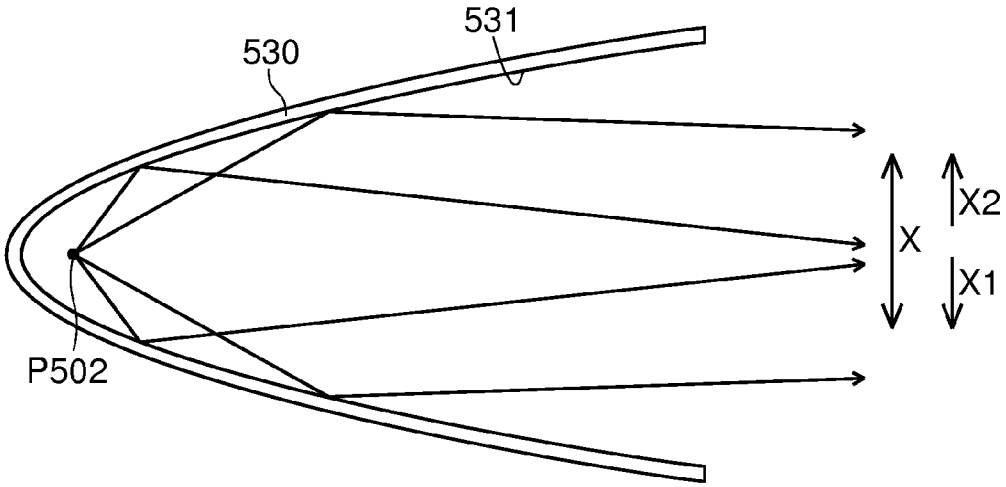
FIG. 31 is a sectional view showing the light reflected on the reflective surface of the reflector shown in FIG. 26 as seen from above.

By contrast, when the driver operates a switch (unillustrated) for switching between a driving beam (high beam) and a passing beam (low beam) so that the headlamp is set for a passing beam (low beam), the irradiated position on the fluorescent member 514 is changed (moved) from P501 to P502 (see FIGS. 30 and 31).

In Embodiment 6, between the switch (unillustrated) and the actuator 16, a controller (unillustrated) may be provided so that, in accordance with a switching signal from the switch, the controller feeds a control signal to the actuator 16.

Then, as shown in FIG. 30, the light reflected from the reflector 530 is emitted in a descending direction with respect to the horizontal direction.

Moreover, as shown in FIG. 31, the light reflected from the reflector 530 is emitted forward right (in the X1 direction) and forward left (in the X2 direction). This widens the illuminated region illuminated by the headlamp.

In other respects, the operation in Embodiment 6 is similar to that in Embodiment 5 described previously.

In Embodiment 6, as described above, the irradiated position on the fluorescent member 514 is changed in the depth direction of the reflective surface 531. Also with this design, it is possible to change the illuminating direction of the headlamp.

In other respects, the benefits of Embodiment 6 are similar to those of Embodiment 5 described previously.

Embodiment 7

As a seventh embodiment (Embodiment 7) of the invention, with reference to FIGS. 32 to 39, a description will be given of a case where, as distinct from in Embodiments 1 to 6 described previously, the area (size) of the irradiated region on the fluorescent member 614 is changed as well.

First, with reference to FIGS. 32 to 34, the design of an automobile 601 provided with a headlamp 602 according to Embodiment 7 will be described.

Figure 32:
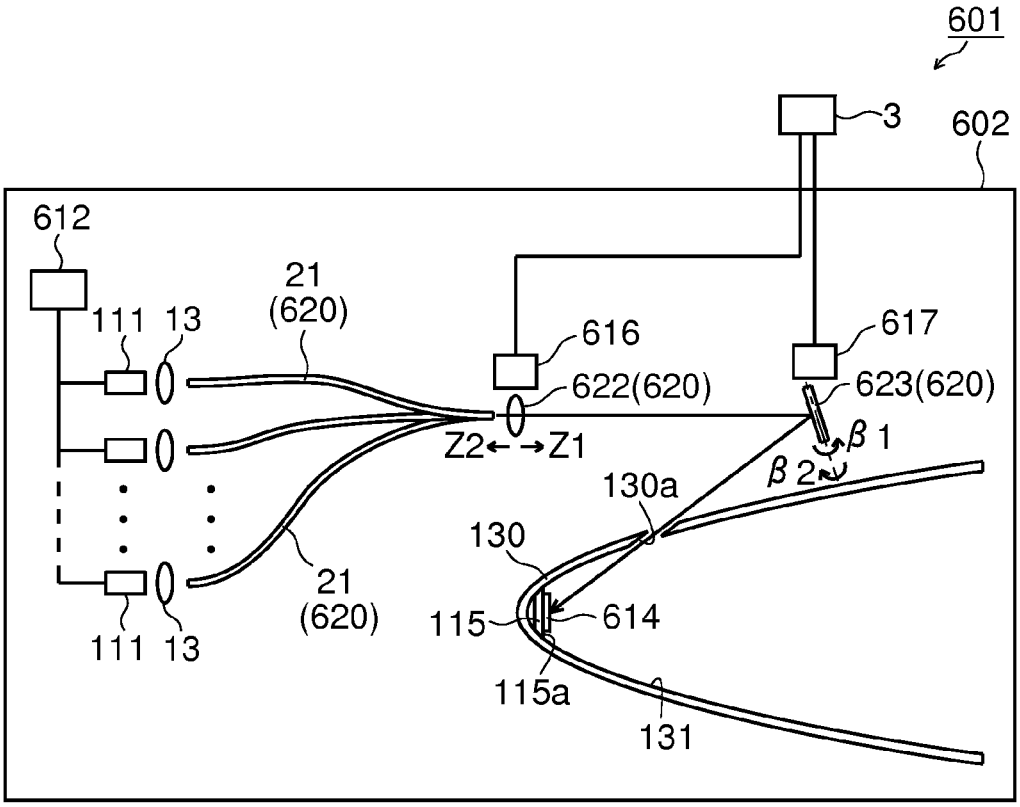
FIG. 32 is a side view schematically showing an overall design of an automobile provided with a headlamp according to Embodiment 7 of the invention.

As shown in FIG. 32, the automobile 601 according to Embodiment 7 is provided with a headlamp 602 and a steering angle detector 3 which detects the steering angle of the automobile 601. The automobile 601 is an example of a "mobile body" according to the invention, and the headlamp 602 is an example of a "lighting apparatus" according to the invention.

The headlamp 602 includes: a plurality of (for example, ten) semiconductor laser devices 111; an output adjuster 612; light guide members 620; condenser lenses 13; a fluorescent member 614; a holding member 115; and a reflector 130 having a reflective surface 131. The fluorescent member 614 is an example of a "light emitting member" according to the invention.

As will be described later, the output adjuster 612 has the function of adjusting the output of the semiconductor laser devices 111 in synchronism with the change of the area of the irradiated region on the fluorescent member 614 in which it is irradiated with laser light and the change of the irradiated position on the fluorescent member 614.

The light guide members 620 are composed of a plurality of optical fibers 21, a collimator lens 622, and a reflector 623. The reflector 623 is an example of a "second reflector" according to the invention.

As shown in FIG. 32, the collimator lens 622 is so arranged as to be movable, by an actuator 616, within a predetermined distance in the front/rear direction (Z1 and Z2 directions) in the axial direction of the optical fibers 21. The actuator 616 is an example of an "irradiated area changer" according to the invention.

The actuator 616 is electrically connected to the steering angle detector 3, and has the function of adjusting the position of the collimator lens 622 in the axial direction of the optical fibers 21 in accordance with the steering angle detected by the steering angle detector 3. This permits, as will be described later, the area of the irradiated region on the fluorescent member 614 in which it is irradiated with laser light to be changed by the actuator 616.

The reflector 623 has the function of reflecting the laser light from the collimator lens 622 toward the fluorescent member 614.

Moreover, in Embodiment 7, the reflector 623 is so arranged as to be rotatable, by an actuator 617, within a predetermined range of angles in the left/right direction (β1 and β2 directions). The actuator 617 is an example of an "irradiation position changer" according to the invention.

The actuator 617 is electrically connected to the steering angle detector 3, and has the function of adjusting the angle of the reflector 623 in accordance with the steering angle detected by the steering angle detector 3. This permits the irradiated position on the fluorescent member 614 to be changed, for example, in the X direction by the actuator 617.

Figure 33:
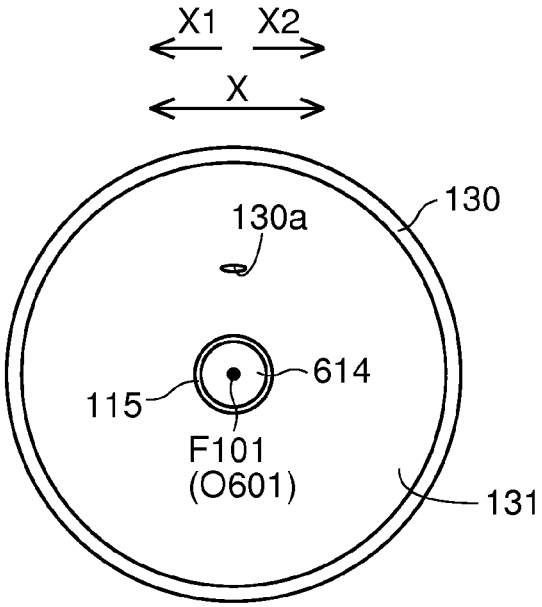
FIG. 33 is a front view showing the structure of the reflector and the fluorescent member shown in FIG. 32.

As shown in FIG. 33, the fluorescent member 614 is formed, for example, in a circular shape as seen from in front.

Moreover, the fluorescent member 614 is, as in Embodiments 2, 3, 5, and 6 described previously, formed by dispersing, in UV-curing resin, about 30% by weight of mixed powder of phosphor particles of $Ce^{3+}$-activated α-SiAlON and phosphor particles of $CaAlSiN_3:Eu^{2+}$, then applying the UV-curing resin on the holding member 415 in a layer with a thickness of about 0.2 mm, and then curing the UV-curing resin.

In other respects, the design in Embodiment 7 is similar to that in Embodiment 2 described previously.

Next, with reference to FIGS. 32 and 34 to 39, how the headlamp 602 operates will be described.

Figure 34:
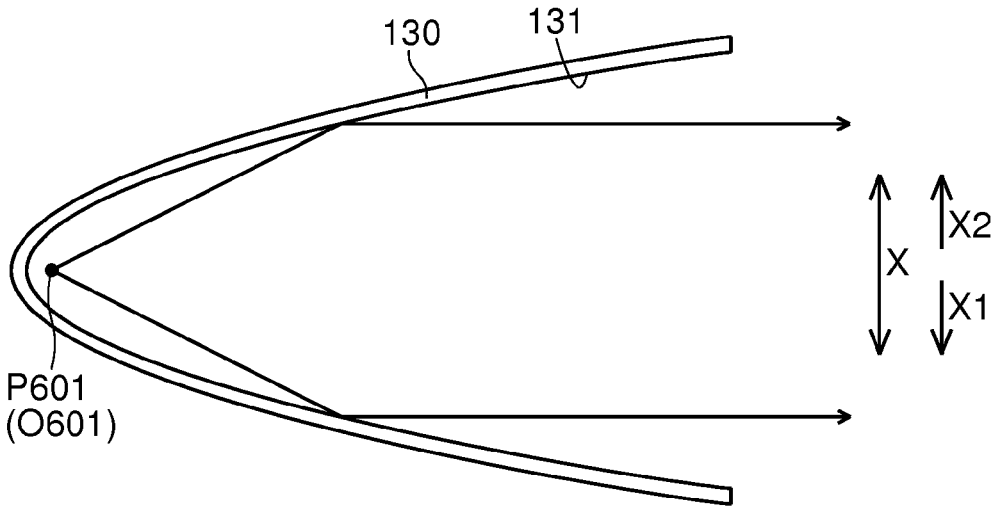
FIG. 34 is a sectional view showing the light reflected on the reflective surface of the reflector shown in FIG. 32 as seen from above.

When the automobile 601 is traveling straight forward, as shown in FIGS. 32 and 34, the laser light emitted from the semiconductor laser devices 111 and guided through the light guide members 620 is applied to the center O601 of the fluorescent member 614 (the irradiated position P601 on the fluorescent member 614). Thus, as shown in FIG. 34, the light reflected from the reflector 130 is made into an approximately parallel beam and emitted forward with respect to the automobile 601 (in the direction perpendicular to the X direction).

By contrast, when the automobile 601 turns right, for instance, the driver operates the steering wheel (unillustrated) to give the automobile 601 a steering angle. The steering angle detector 3 (see FIG. 32) then detects the steering angle of the automobile 601. In accordance with the steering angle detected by the steering angle detector 3, the angle of the reflector 623 (see FIG. 32) is changed by the actuator 617 (see FIG. 32).

Specifically, when the automobile 601 is given a steering angle to the right (in the X1 direction), the angle of the reflector 623 to the left (in the β1 direction (see FIG. 32)) is changed by the actuator 617.

Figure 35:
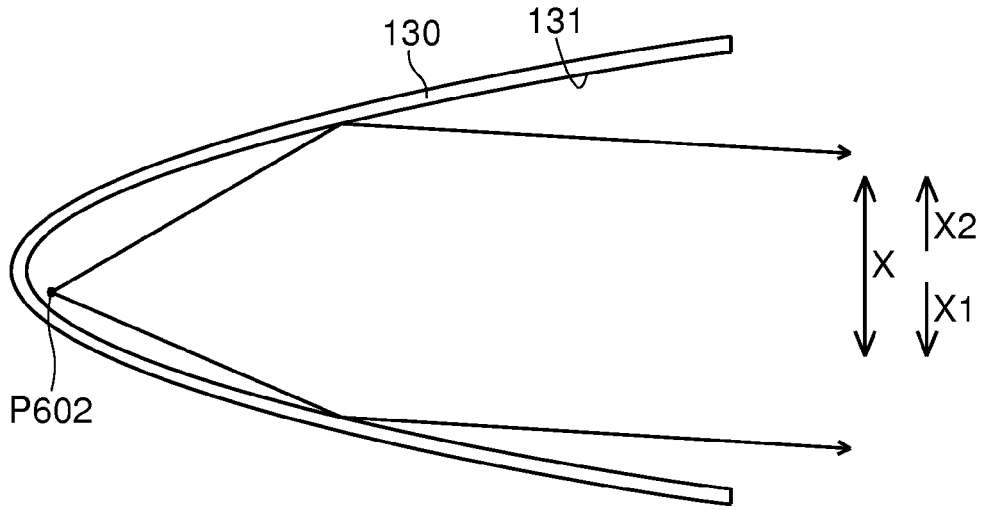
FIG. 35 is a sectional view showing the light reflected on the reflective surface of the reflector shown in FIG. 32 as seen from above.
Figure 36:
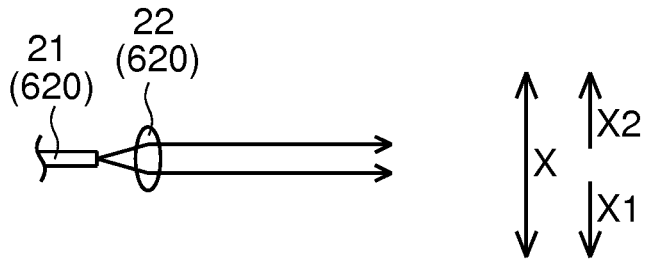
FIG. 36 is a plan view illustrating the laser light passing through the collimator lens shown in FIG. 32.

As a result, the irradiated position on the fluorescent member 614 is changed (moved) from P601 (see FIG. 34) to P602 (see FIG. 35). Now, as shown in FIG. 35, the light reflected from the reflector 130 is emitted obliquely forward right.

Here, in Embodiment 7, when the steering angle detector 3 (see FIG. 32) detects a steering angle of the automobile 601, in accordance with the steering angle detected by the steering angle detector 3, the position of the collimator lens 622 is changed by the actuator 616 (see FIG. 32).

Specifically, when the automobile 601 is given, for example, a steering angle to the right (in the X1 direction), the collimator lens 622 is moved within a predetermined distance in the front/rear direction (Z1 or Z2 direction) in the axial direction of the optical fibers 21 by the actuator 616. That is, the collimator lens 622 is moved, for example, from its position in FIG. 36 to its position in FIG. 37.

Figure 37:
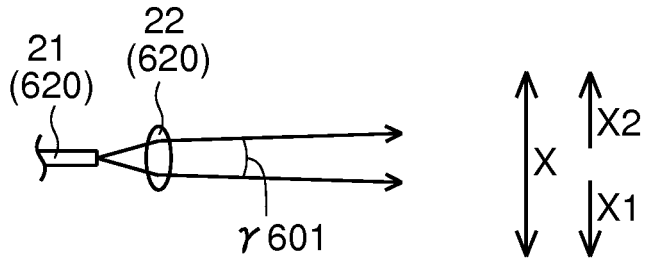
FIG. 37 is a plan view illustrating the laser light passing through the collimator lens shown in FIG. 32.
Figure 38:
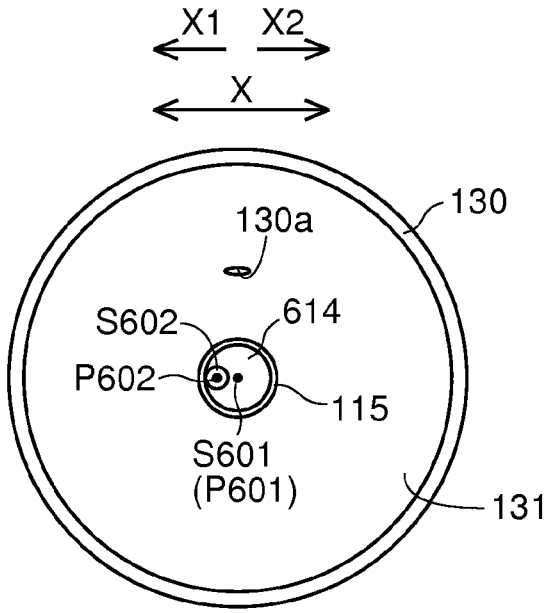
FIG. 38 is a front view showing the structure of the reflector and the fluorescent member shown in FIG. 32.

As a result, as shown in FIG. 37, the laser light that has passed through the collimator lens 622 travels with a predetermined fanning angle γ601. Thus, as shown in FIGS. 38 and 39, the irradiated region S602 on the fluorescent member 614 has a larger area than the irradiated region S601.

Figure 39:
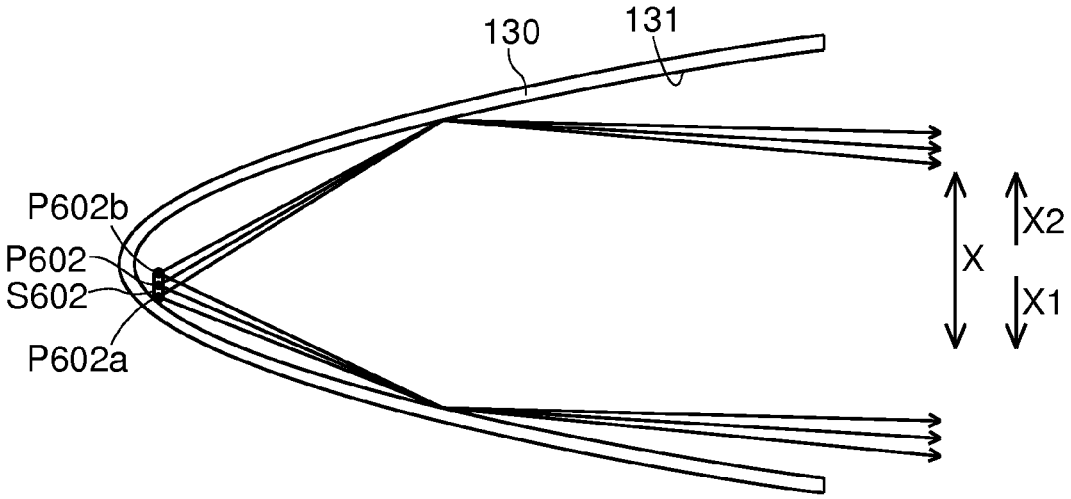
FIG. 39 is a sectional view showing the light reflected on the reflective surface of the reflector shown in FIG. 32 as seen from above.

Here, as shown in FIG. 39, for example, the light emitted from position P602*a* in the irradiated region 5602 on the fluorescent member 614 is emitted on the right side of the light emitted from the center position (irradiated position) P602 of the irradiated region S602; likewise, the light emitted from position P602*b* in the irradiated region S602 on the fluorescent member 614 is emitted on the left side of the light emitted from the center position (irradiated position) P602 of the irradiated region 5602. Thus, the illuminated region of the headlamp 602 has a larger area.

That is, in Embodiment 7, by increasing (or decreasing) the area of the irradiated region on the fluorescent member 614, it is possible to increase (or decrease) the area of the illuminated region of the headlamp 602.

In other respects, the operation in Embodiment 7 is similar to that in Embodiment 2 described previously.

In Embodiment 7, as described above, there are provided an actuator 617 for changing the angle of the reflector 623 and an actuator 616 for changing the area of the irradiated region on the fluorescent member 614. This makes it possible to control (change) both the illuminating direction and the area of the illuminated region of the headlamp 602.

In other respects, the benefits of Embodiment 7 are similar to those of Embodiment 2 described previously.

It should be understood that Embodiments 1 to 7 described above are in every respect illustrative and not restrictive. The scope of the present invention is defined not by Embodiments 1 to 7 described above but by the appended claims, and encompasses any variations and modifications made within the sense and scope equivalent to those of the claims.

For example, although Embodiments 1 to 7 described above deal with examples where a headlamp according to the invention is used in an automobile, this is not meant to be a limitation; a headlamp according to the invention may be used in aircraft, ships, robots, motorcycles, bicycles, and any other mobile bodies.

Although Embodiments 1 to 7 described above deal with examples where the semiconductor laser devices and the fluorescent member are designed to emit white light, this is not meant to be a limitation; the semiconductor laser devices and the fluorescent member may be designed to emit visible light other than white light.

Although Embodiments 1 to 7 described above deal with examples where semiconductor laser devices are used as a laser generator that emits laser light, this is not meant to be a limitation; any laser generator other than a semiconductor laser device may be used.

All values specifically given in connection with Embodiments 1 to 7 described above are merely examples, which are not meant to be any limitation.

In Embodiments 1 to 7, the center wavelength of the laser light emitted from the semiconductor laser devices and the kind of phosphor constituting the fluorescent member may be changed as necessary.

Although Embodiments 1 to 7 described above deal with examples where the light guide members are composed of an optical fiber, a collimator lens, and a reflector, this is not meant to be a limitation; the light guide members may be composed of one or two of an optical fiber, a collimator lens, and a reflector as necessary.

Although Embodiments 1 to 7 described above deal with examples where, to apply the laser light emitted from the semiconductor laser devices to the fluorescent member, light guide members are provided, this is not meant to be a limitation; no light guide members need to be provided.

Although Embodiments 1 to 7 described above deal with examples where, the angle of the collimator lens or the reflector is changed to change the irradiated position on the fluorescent member, this is not meant to be a limitation; the angle of the laser light exit ends of the optical fibers or the angle of the semiconductor laser devices may be changed to change the irradiated position on the fluorescent member.

Although Embodiments 1 to 7 described above deal with examples where the irradiated position on the fluorescent member is changed in the depth direction of the reflective surface or in the direction perpendicular to the depth direction of the reflective surface, this is not meant to be a limitation; instead, it is possible to tilt the holding surface of the holding member, or to make the surface of the fluorescent member (or the holding surface of the holding member) spherical so that the irradiated position on the fluorescent member is changed both in the depth direction of the reflective surface and in the direction perpendicular to the depth direction of the reflective surface.

Although Embodiments 1 to 7 described above deal with examples where the fluorescent member is disposed in a region that includes the focal point of the reflective surface, this is not meant to be a limitation; the fluorescent member may be disposed near the focal point of the reflective surface.

Although Embodiments 1 to 7 described above deal with examples where the reflective surface of the reflector is formed in the shape of a paraboloid, this is not meant to be a limitation; the reflective surface may be formed in the shape of part of an ellipsoid. It is also possible to design the reflector as a CPC (compound parabolic concentrator) type reflector.

Although Embodiments 1 to 7 described above deal with examples where, when the light emitted from the fluorescent member in the direction opposite from the direction from which it is irradiated with laser light is reflected on the reflector (as in Embodiments 1 and 4 described above), the fluorescent member is formed of the phosphor $(Y,Gd)_3Al_5O_{12}$:Ce and, when the light emitted from the fluorescent member in the direction from which it is irradiated with the laser light is reflected on the reflector (as in Embodiments 2, 3, 5, 6, and 7 described above), the fluorescent member is formed of the phosphors $Ce^{3+}$-activated α-SiAlON and $CaAlSiN_3:Eu^{2+}$, this is not meant to be a limitation; when the light emitted from the fluorescent member in the direction opposite from the direction from which it is irradiated with laser light is reflected on the reflector, the fluorescent member may be formed of the phosphors $Ce^{3+}$-activated α-SiAlON and $CaAlSiN_3:Eu^{2+}$ and, when the light emitted from the fluorescent member in the direction from which it is irradiated with the laser light is reflected on the reflector, the fluorescent member may be formed of the phosphor $(Y,Gd)_3Al_5O_{12}$:Ce.

Although Embodiments 1 to 7 described above deal with examples where the fluorescent member is formed of phosphor particles and resin, this is not meant to be a limitation; the fluorescent member may be formed of any of various materials by any of various methods so long as it contains a phosphor (phosphorescent or fluorescent substance or material). For example, the fluorescent member may be formed of phosphor particles and any material other than resin, such as adhesive or glass. The fluorescent member may be formed by sintering or pressing phosphor particles.

Although Embodiments 1 to 7 described above deal with examples where the fluorescent member (the focal point of the reflective surface) is disposed at the boundary between the inside and outside of the reflective surface or near the vertex of the reflective surface, this is not meant to be a limitation; the fluorescent member (the focal point of the reflective surface) may be disposed anywhere between the boundary between the inside and outside of the reflective surface and near the vertex of the reflective surface. That is, the fluorescent member (the focal point of the reflective surface) may be disposed in a central portion of the reflective surface (reflector). In that case, the holding member may be formed of a sheet of metal.

For example, in Embodiments 2 and 7 described above, the holding member may be formed of a light transmitting material such as a sheet of glass. In Embodiments 1 to 7, the holding member may be formed of any material other than a sheet of glass or a sheet of metal.

Figure 40:
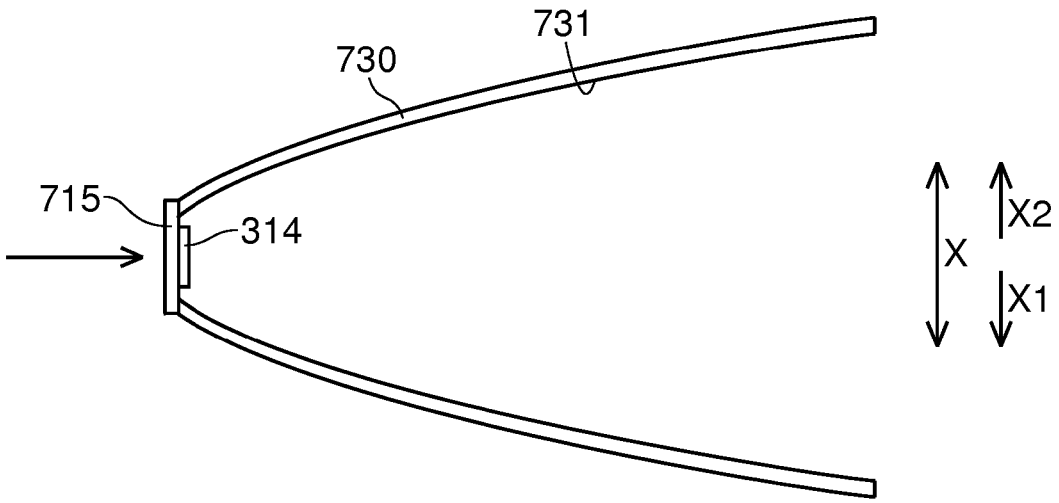
FIG. 40 is a sectional view showing the structure of the reflector and the holding member in a headlamp according to a first modified example of the invention as seen from above.

Although, for example, Embodiment 4 described above deals with an example where, as shown in FIG. 23, the holding member is disposed inside the reflector (reflective surface), this is not meant to be a limitation; the headlamp may be designed as shown in FIG. 40, which shows a first modified example of the invention. Specifically, the portion of the reflector 730 located behind the fluorescent member 314 may be cut off so that the holding member 715 is disposed outside the reflector 730 (reflective surface 731).

Although Embodiments 5 and 6 deal with examples where, when the focal point of the reflective surface is located near the vertex, the reflective surface of the reflector is formed in the shape of a paraboloid divided on a plane perpendicular to (crossing) the axis through the vertex and the focal point and further divided on a plane parallel to the axis through the vertex and the focal point, this is not meant to be a limitation. For example, as in a headlamp according to a second modified example of the invention shown in FIG. 41, when the focal point F801 of the reflective surface 831 of the reflector 830 is located at the boundary between the inside and outside of the reflective surface 831, the reflective surface 831 may be formed in the shape of a paraboloid divided on a plane perpendicular to (crossing) the axis through the vertex V801 and the focal point F801 and further divided on a plane parallel to the axis through the vertex V801 and the focal point F801.

Figure 41:
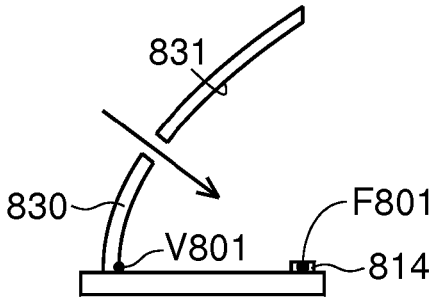
FIG. 41 is a sectional view showing the structure of the reflector in a headlamp according to a second modified example of the invention as seen from a side.

As shown in FIG. 41, the laser light may be applied to the fluorescent member 814 obliquely from behind.

Although Embodiment 7 described above deals with an example where, to control (change) both the area of the illuminated region and the illuminating direction of the headlamp, the collimator lens 622 is moved in the Z1 (or Z2) direction by use of the actuator 616 and the angle of the reflector 623 is changed by use of the actuator 617, this is not meant to be a limitation. For example, the actuator 616 may be so designed as to move the collimator lens 622 in the Z1 (or Z2) direction and also change the angle of the collimator lens 622.

Although Embodiments 1 to 7 described above deal with examples where, in accordance with the steering angle of the automobile, the irradiated position on the fluorescent member (the illuminating direction of the headlamp) is changed, this is not meant to be a limitation; the irradiated position on the fluorescent member (the illuminating direction of the headlamp) may be changed in accordance with the steering angle and the traveling speed of the automobile. In that case, a speed detector for detecting the traveling speed of the automobile may be provided.

Figure 42:
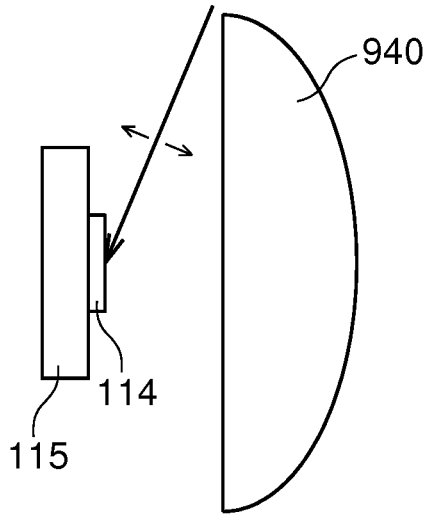
FIG. 42 is a sectional view showing the structure of and around the fluorescent member in a headlamp according to a third modified example of the invention as seen from above.
Figure 43:
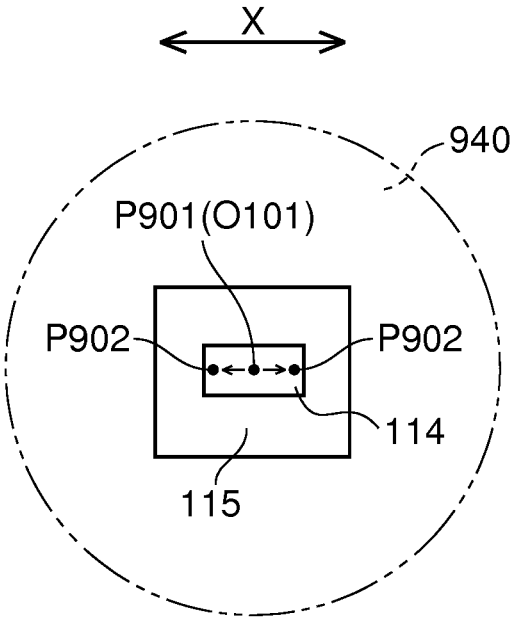
FIG. 43 is a front view showing the structure of the reflector and the fluorescent member shown in FIG. 42.

Although Embodiments 1 to 7 described above deal with examples where, as a light projecting member, a reflector (first reflector) is used, this is not meant to be a limitation. For example, as in a headlamp according to a third modified example of the invention shown in FIG. 42, as a light projecting member, a light projecting lens 940 (for example, a convex lens) may be used which controls and projects the light emitted from the fluorescent member 114. In that case, the light projecting lens 940 may be arranged in such a way that the center of the projecting lens 940 coincides with the center of the fluorescent member 114. As in Embodiment 2 described above, a holding member 115 formed of, for example, a sheet of metal with high thermal conductivity and a fluorescent member 114 may be used. Laser light may be applied to the fluorescent member 114 from in front. As shown in FIG. 43, the irradiated position on the fluorescent member 114 is changed (moved) from P901 to P902 and is then stopped there. Even in a case where, as in the third modified example of the invention, a projecting lens 940 is used as a light projecting member, by changing the irradiated position on the fluorescent member 114, it is possible to change the illuminating direction of the headlamp.

Figure 44:
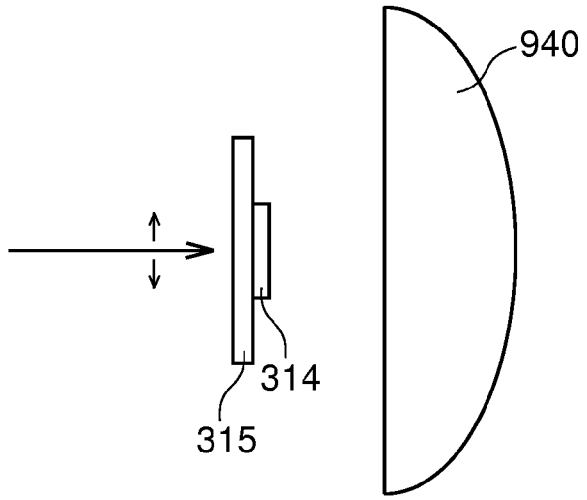
FIG. 44 is a sectional view showing the structure of and around the fluorescent member in a headlamp according to a fourth modified example of the invention as seen from above.

For example, as in a headlamp according to a fourth modified example of the invention shown in FIG. 44, a light projecting lens 940, a fluorescent member 314, and a holding member 315 may be used to apply laser light to the fluorescent member 314 from behind.

Figure 45:
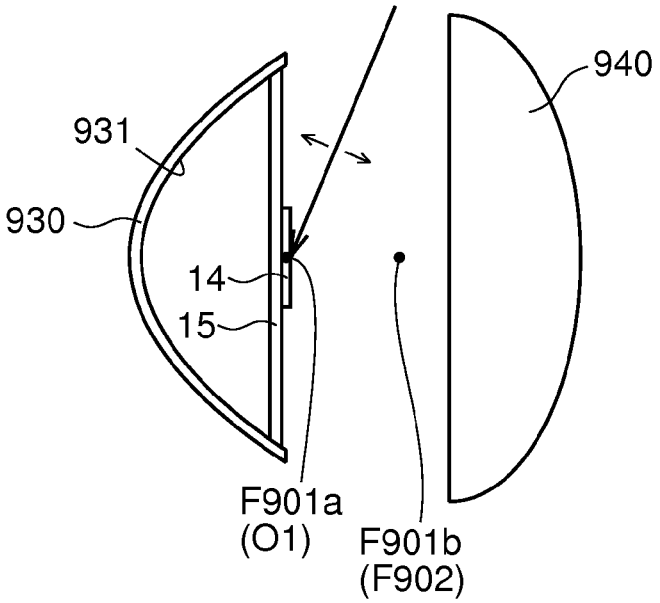
FIG. 45 is a sectional view showing the structure of and around the fluorescent member in a headlamp according to a fifth modified example of the invention as seen from above.

For example, as in a headlamp according to a fifth modified example of the invention shown in FIG. 45, as a light projecting member, a reflector 930 and a light projecting lens 940 may be used. In that case, the reflective surface 931 of the reflector 930 may be formed in the shape of an ellipsoid. The first focal point F901*a* (the one closer to the reflective surface 931) of the reflective surface (ellipsoid) 931 may be made to coincide with the center O1 of the fluorescent member 14, and the second focal point F901*b* (the one farther from the reflective surface 931) of the reflective surface (ellipsoid) 931 may be made to coincide with the focal point F902 of the light projecting lens 940. With this design, the light that has passed through the focal point F901*b* (F902) and entered the light projecting lens 940 is formed into a parallel beam and emitted from the light projecting lens 940 forward.

Although Embodiments 1 to 7 described above deal with examples where as a light emitting member, a fluorescent member containing particles of a phosphor that emits light (fluorescence) having a center wavelength longer (greater) than that of the excitation light is used, this is not meant to be a limitation. It is also possible to use a light emitting member containing a wavelength converting member that emits light (for example, visible light) having a center wavelength shorter (smaller) than that of the excitation light (for example, red light), such as a substance that emits light by multiple photon excitation or a so-called up-conversion phosphor. No wavelength converting member needs to be used; instead, it is possible to use, for example, a light emitting member that contains a scattering material that simply scatters visible laser light.

Figure 46:
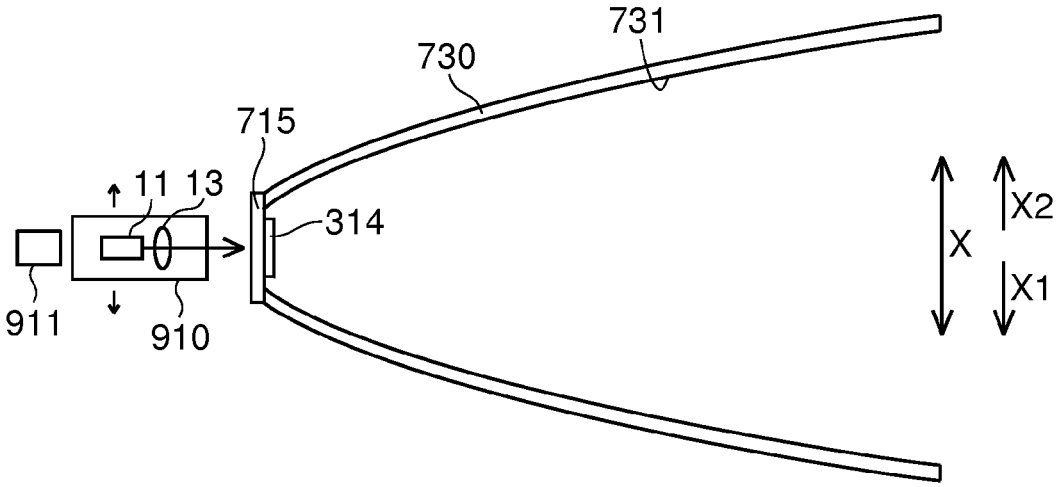
FIG. 46 is a sectional view showing the structure of a headlamp according to a sixth modified example of the invention as seen from above.

Although Embodiments 1 to 7 described above deal with examples where, to change the irradiated position on the fluorescent member, the collimator lens 22 or the reflector 623 is rotated, this is not meant to be a limitation. For example, as in a headlamp according to a sixth modified example of the invention shown in FIG. 46, a laser device unit 910 having semiconductor laser devices 11 and condenser lenses 13 integrated into a single unit may be slid in the X direction by use of a motor 911 or the like (an irradiated position changer) so as to change (move) the irradiated position on the fluorescent member 314.

Figure 47:
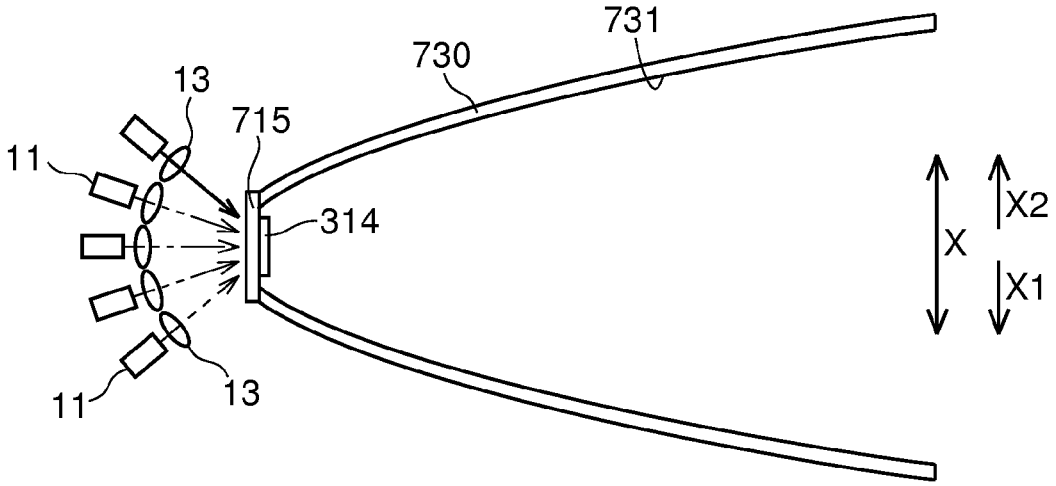
FIG. 47 is a sectional view showing the structure of a headlamp according to a seventh modified example of the invention as seen from above.

It is possible to adopt a design like that of a headlamp according to a seventh modified example of the invention shown in FIG. 47. Specifically, a plurality of semiconductor laser devices 11 are provided, and are so disposed as to irradiate the fluorescent member 314 at different positions respectively. Out of the semiconductor laser devices 11, only one is turned on (made to emit laser light) at a time so as to thereby change (move) the irradiated position on the fluorescent member 314. Needless to say, even in a case where a light projecting lens is used as a light emitting member, the designs shown in FIGS. 46 and 47 can be used.

Embodiment 8

First, with reference to FIGS. 48 to 52, the design of an automobile 1001 provided with a headlamp 1002 according to an eighth embodiment (Embodiment 8) of the invention will be described.

Figure 48:
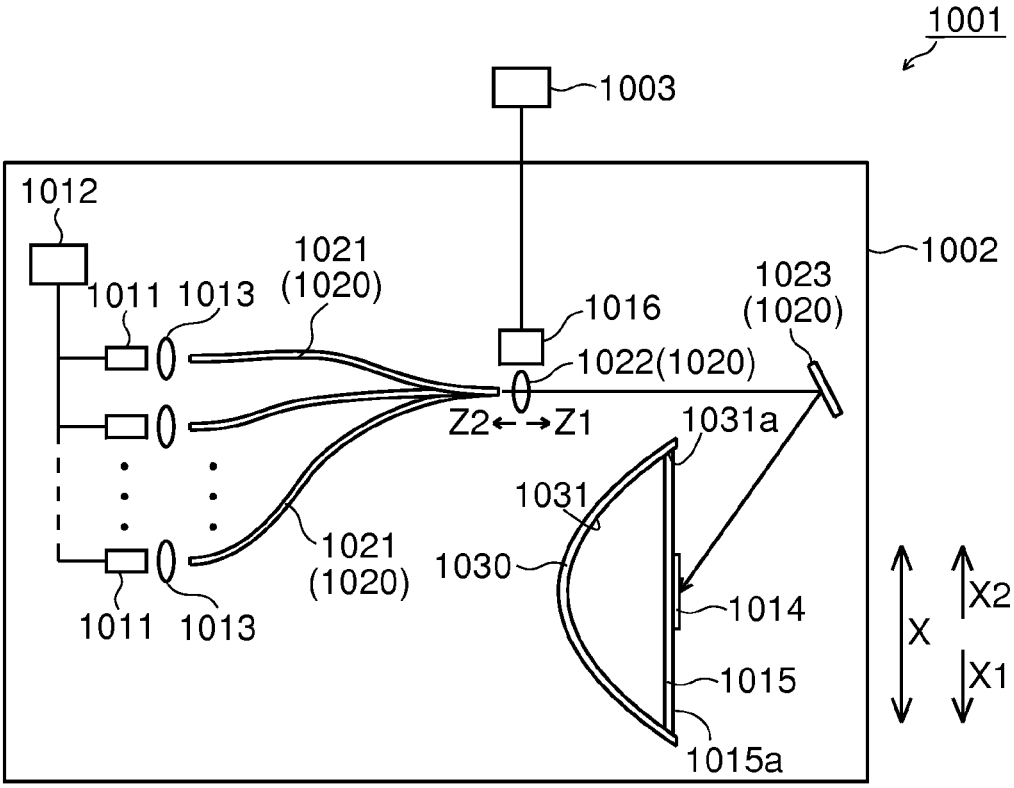
FIG. 48 is a plan view schematically showing an overall design of an automobile provided with a headlamp according to Embodiment 8 of the invention.

As shown in FIG. 48, the automobile 1001 according to Embodiment 8 is provided with a headlamp 1002 which illuminates forward in the traveling direction during traveling at night, for instance, and a switch 1003 for switching between a driving beam (high beam) and a passing beam (low beam). The automobile 1001 is an example of a "mobile body" according to the invention, and the headlamp 1002 is an example of a "lighting apparatus" according to the invention.

The headlamp 1002 includes: a plurality of (for example, ten) semiconductor laser devices 1011 which function as a laser light source; an output adjuster 1012 which adjusts the output of the semiconductor laser devices 1011; light guide members 1020 which are provided on the laser light exit side of the semiconductor laser devices 1011 respectively to guide laser light; condenser lenses 1013 which are provided between the semiconductor laser devices 1011 and the light guide members 1020 respectively; a fluorescent member 1014 which is irradiated with the laser light guided through the light guide members 1020; a holding member 1015 which holds the fluorescent member 1014; and a reflector (reflective mirror) 1030 which has a concave reflective surface 1031 which reflects forward the light emitted from the fluorescent member 1014. The semiconductor laser devices 1011 are an example of a "laser generator" according to the invention, and the fluorescent member 1014 is an example of a "light emitting member" according to the invention. The reflector 1030 is an example of a "light projecting member" according to the invention.

For example, two of the headlamps 1002 are provided at the front end of the automobile 1, one on the left and the other on the right.

The semiconductor laser devices 1011 have the function of emitting coherent laser light. The semiconductor laser devices 1011 are each housed in a package with a diameter of, for example, about 5.6 mm. The semiconductor laser devices 1011 are designed to emit blue laser light with a center wavelength of, for example, about 445 nm. Moreover, the semiconductor laser devices 1011 are designed to yield a high output of about 1 W or more each by CW (continuous wave) driving.

The output adjuster 1012 is designed to adjust the electric power supplied to the semiconductor laser devices 1011 and thereby adjust the output of the laser light emitted from the semiconductor laser devices 1011. The output adjuster 1012 may be so designed as to be connected to a controller (unillustrated) which controls the entire headlamp 1002 so that, in accordance with a control signal from the controller, the output adjuster 1012 adjusts the electric power supplied to the semiconductor laser devices 1011.

As will be described later, the output adjuster 1012 has the function of adjusting the output of the semiconductor laser devices 1011 in synchronism with the change of the area (size) of the irradiated region on the fluorescent member 1014 at which it is irradiated with laser light.

The condenser lenses 1013 have the function of condensing (make into a convergent beam) the laser light emitted from the semiconductor laser devices 1011 to make it enter optical fibers 1021 which constitute the light guide members 1020.

The light guide members 1020 are composed of a plurality of optical fibers 1021 which are disposed opposite the condenser lenses 1013, a collimator lens 1022 which is disposed opposite the laser light exit faces of the optical fibers 1021, and a reflector (reflective mirror) 1023 which is disposed in the optical path of the laser light that has passed through the collimator lens 1022. The collimator lens 1022 is an example of a "lens" according to the invention.

The optical fibers 1021 are each composed of a core portion with a diameter of, for example, about 125 μm and a cladding portion which covers the outer circumferential surface of the core portion. The optical fibers 1021 are, at their laser light exit ends, bundled together.

Figure 49:
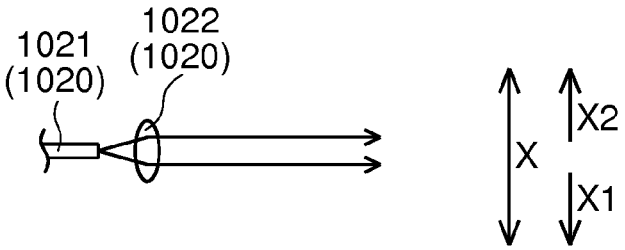
FIG. 49 is a plan view illustrating the laser light passing through the collimator lens shown in FIG. 48.

The collimator lens 1022 has a diameter of, for example, 6 mm. Moreover, as shown in FIG. 49, the collimator lens 1022 has the function of making the laser light emitted from the optical fibers 1021 into a parallel beam with a diameter of, for example, about 2 mm while transmitting it. Moreover, as shown in FIG. 48, the collimator lens 1022 is so arranged as to be movable, by an actuator 1016, within a predetermined distance in the front/rear direction (Z1 and Z2 directions) in the optical axis direction (the axial direction of the optical fibers 1021). The actuator 1016 is an example of an "irradiated area changer" according to the invention.

The actuator 1016 is electrically connected to the switch 1003, and has the function of adjusting (moving) the position of the collimator lens 1022 with respect to the axial direction of the optical fibers 1021 when the driver operates the switch 1003. This permits, as will be described later, the area of the irradiated region on the fluorescent member 1014 in which it is irradiated with laser light to be changed by the actuator 1016. Between the actuator 1016 and the steering angle detector 1003, a controller (unillustrated) which controls the entire headlamp 1002 may be provided so that the controller outputs a control signal to the actuator 1016 in accordance with a detection signal from the steering angle detector 1003.

The reflector 1023 has the function of reflecting the laser light from the collimator lens 1022 toward the fluorescent member 1014.

Moreover, in Embodiment 8, the reflector 1023 is disposed forward of the fluorescent member 1014 (on the light exit side of the reflector 1030). That is, the laser light from the semiconductor laser devices 1011 is applied to the fluorescent member 1014 from in front. Thus, even if the fluorescent member 1014 happens to come off the holding member 1015, the laser light is prevented from being emitted forward intact.

Figure 50:
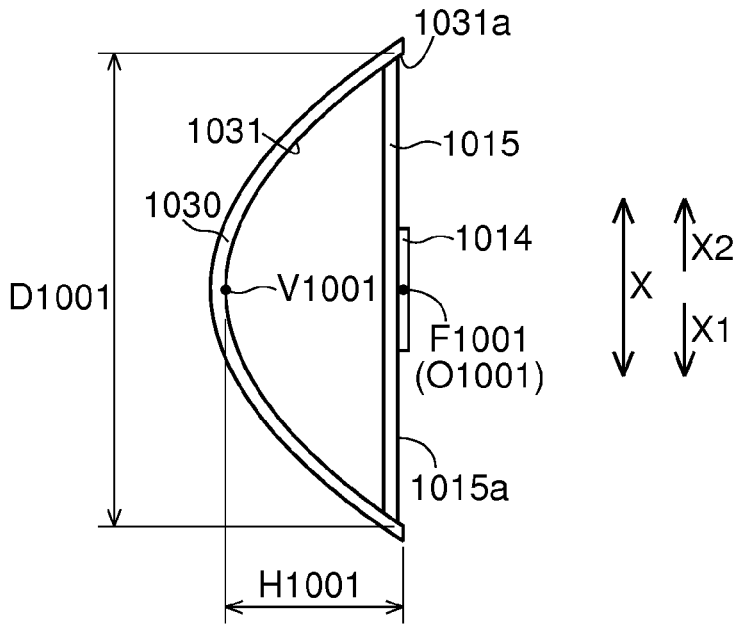
FIG. 50 is a sectional view showing the structure of the reflector and the fluorescent member shown in FIG. 48 as seen from above.
Figure 51:
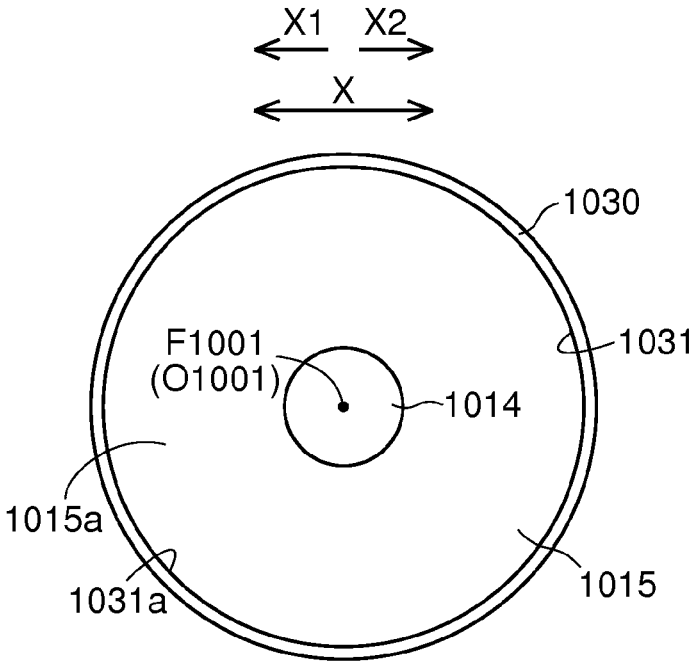
FIG. 51 is a front view showing the structure of the reflector and the fluorescent member shown in FIG. 48.

As shown in FIGS. 50 and 51, the fluorescent member 1014 is so formed as to extend in the direction perpendicular to (crossing) the depth direction of the reflective surface 1031 of the reflector 1030 (the direction in which the axis through the vertex V1001 and the focal point F1001 of the reflective surface 1031 extends). That is, the fluorescent member 1014 is so formed as to extend in the left/right direction (the X direction) and in the up/down direction. The X direction is an example of a "predetermined direction" according to the invention. Moreover, as shown in FIG. 51, the fluorescent member 1014 is formed in a circular shape as seen from in front, with a diameter of, for example, about 20 mm or more.

The light emitted from the fluorescent member 1014 is emitted in all directions from the fluorescent member 1014, and accordingly part of the light is emitted forward (outside) without striking the reflector 1030. The present specification, however, mainly discusses the light that is emitted forward by way of the reflector 1030.

Moreover, as shown in FIG. 50, the fluorescent member 1014 is disposed at the boundary between the inside and outside of the reflective surface 1031 (reflector 1030). Moreover, as shown in FIGS. 50 and 51, the fluorescent member 1014 is disposed in a region that includes the focal point F1001 of the reflective surface 1031 of the reflector 1030, and the center O1001 of the fluorescent member 1014 approximately coincides with the focal point F1001 of the reflective surface 1031. The fluorescent member 1014 may instead be disposed near the focal point F1001 of the reflective surface 1031.

Moreover, the fluorescent member 1014 is formed by dispersing, in UV-curing resin, about 15% by weight of powder of phosphor particles of $(Y,Gd)_3Al_5O_{12}$:Ce, then applying the UV-curing resin on the holding member 1015 in a layer with a thickness of about 0.5 mm, and then curing the UV-curing resin.

The phosphor $(Y,Gd)_3Al_5O_{12}$:Ce has the function of converting part of the laser light from the semiconductor laser devices 1011 into yellow light (visible light). The yellow light mixes with the blue light that has remained unconverted by the phosphor to produce white light.

The holding member 1015 is formed of a light transmitting (transparent or translucent) material, for example a sheet of glass. The holding member 1015 has only to have the function of transmitting at least the light emitted from the fluorescent member 1014.

Moreover, as shown in FIG. 50, the holding member 1015 has a holding surface 1015*a* to which the fluorescent member 1014 is fitted. The holding surface 1015*a* is so formed as to extend in the direction perpendicular to (crossing) the depth direction of the reflective surface 1031 of the reflector 1030. The holding member 1015 is fitted to the opening (brim) 1031*a* of the reflective surface 1031 of the reflector 1030.

The reflector 1030 includes the reflective surface 1031 which has an opening 1031*a* at the front. The reflective surface 1031 is coated with, for example, silver, aluminum, or the like.

Moreover, the reflective surface 1031 is formed in the shape of, for example, a paraboloid. In other words, the reflective surface 1031 is formed in the shape of a paraboloid divided on a plane perpendicular to (crossing) the axis through the focal point F1001 and the vertex V1001.

Moreover, as shown in FIG. 50, the reflective surface 1031 has a diameter (=D1001) of about 90 mm and a depth (=H1001) of about 22.5 mm. Moreover, the reflective surface 1031 has a focal point F1001 and a vertex V1001, the focal point F1001 being about 22.5 mm apart from the vertex V1001.

Figure 52:
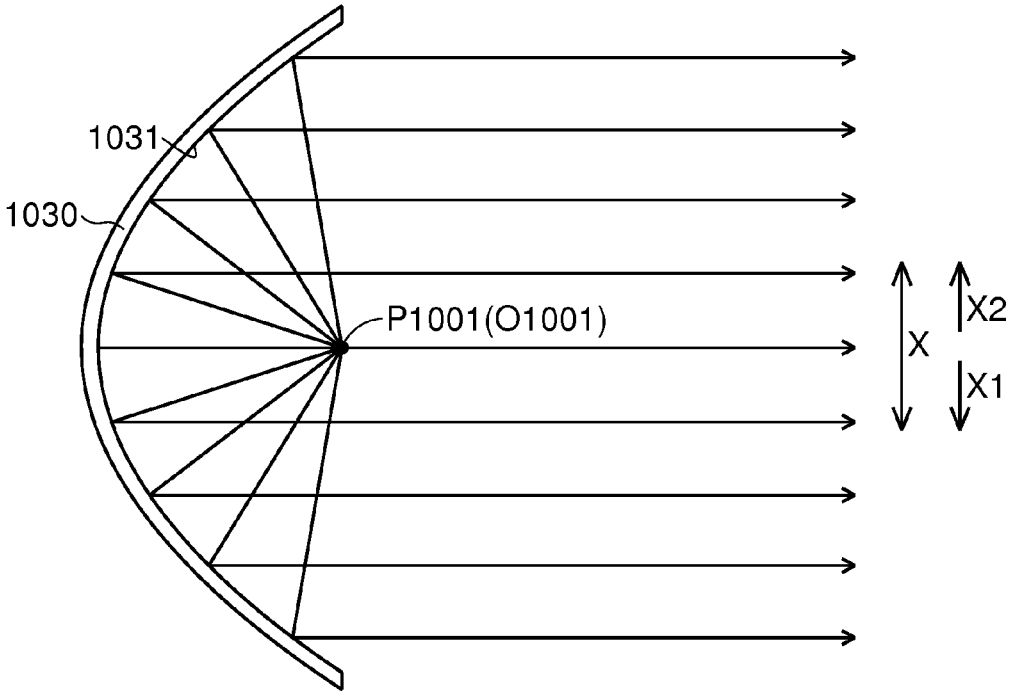
FIG. 52 is a sectional view showing the light reflected on the reflective surface of the reflector shown in FIG. 48 as seen from above.

Moreover, as shown in FIG. 52, the reflector 1030 is so formed as to make the light from the center O1001 of the fluorescent member 1014 (see FIG. 50) (the portion of the fluorescent member 1014 located at the focal point F1001 (see FIG. 50) of the reflective surface 1031) into a parallel beam while reflecting it forward.

In reality, however, the light emitting portion of the fluorescent member 1014 (the irradiated region on the fluorescent member 1014 in which it is irradiated with laser light) has, for example, a diameter of about 2 mm or more, and therefore the light emitted from the reflector 1030 is not a perfectly parallel beam.

Next, with reference to FIGS. 48, 49, and 53 to 60, how the headlamp 1002 operates will be described.

Figure 53:
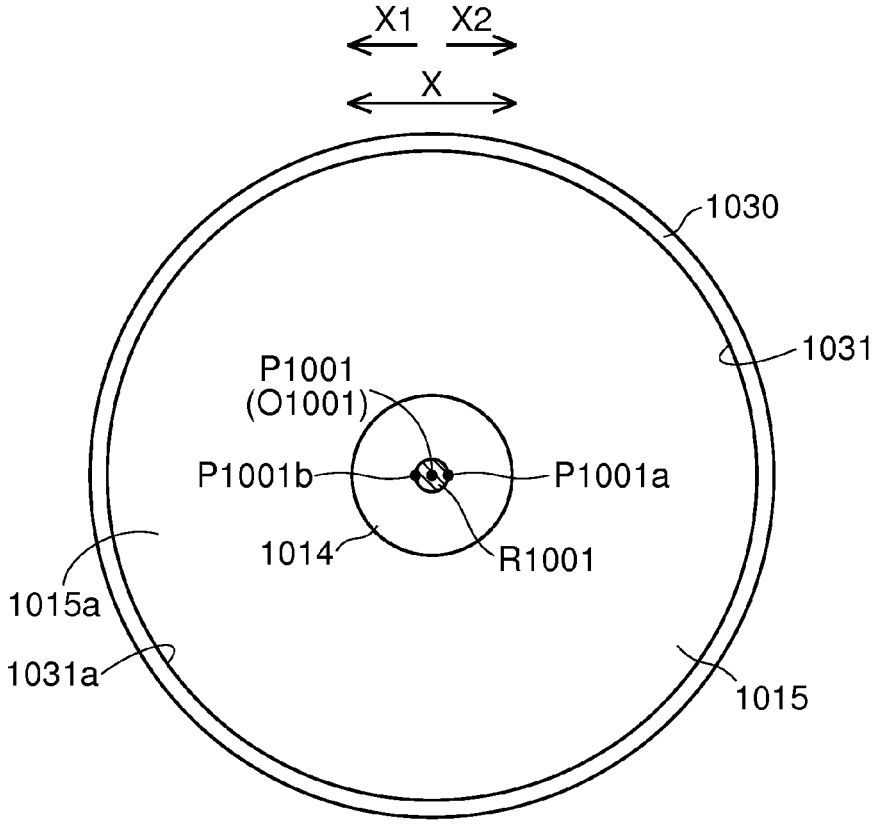
FIG. 53 is a front view showing the structure of the reflector and the fluorescent member shown in FIG. 48.

When the headlamp 1002 is set for, for example, a driving beam (high beam), as shown in FIG. 53, the laser light emitted from the semiconductor laser devices 1011 and guided through the light guide members 1020 is applied to an irradiated region R1001 on the fluorescent member 1014 (a region that includes the center O1001 of the fluorescent member 1014) (the hatched region). When the headlamp 1002 is set for a driving beam, the irradiated region R1001 on the fluorescent member 1014 has a diameter (spot diameter) of, for example, about 2 mm.

Figure 54:
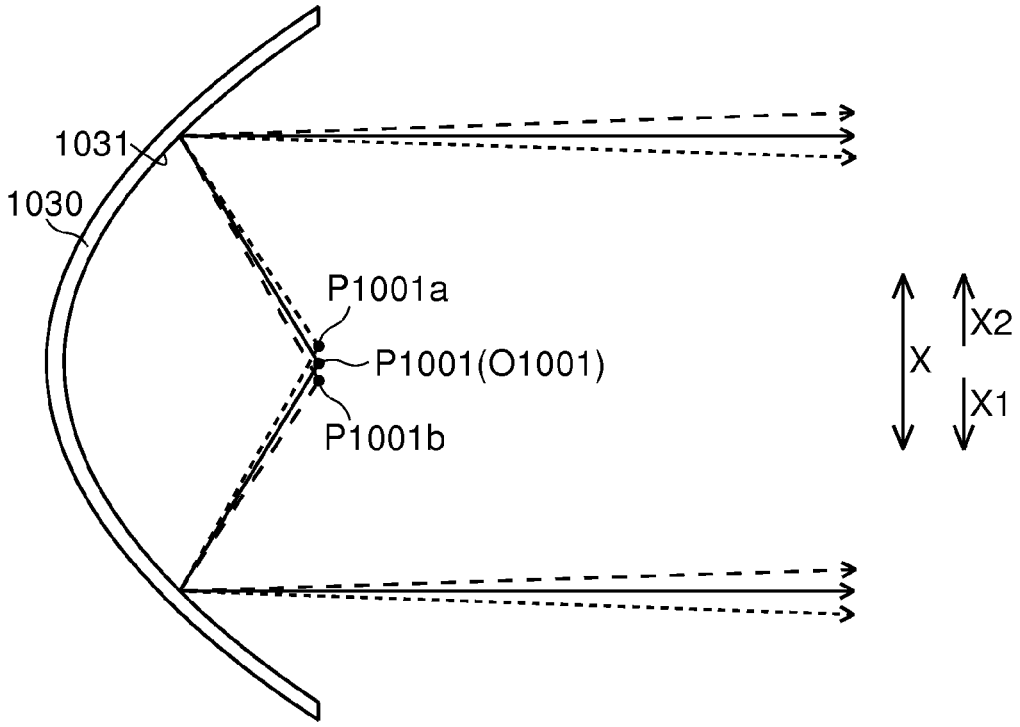
FIG. 54 is a sectional view showing the light reflected on the reflective surface of the reflector shown in FIG. 48 as seen from above.
Figure 55:
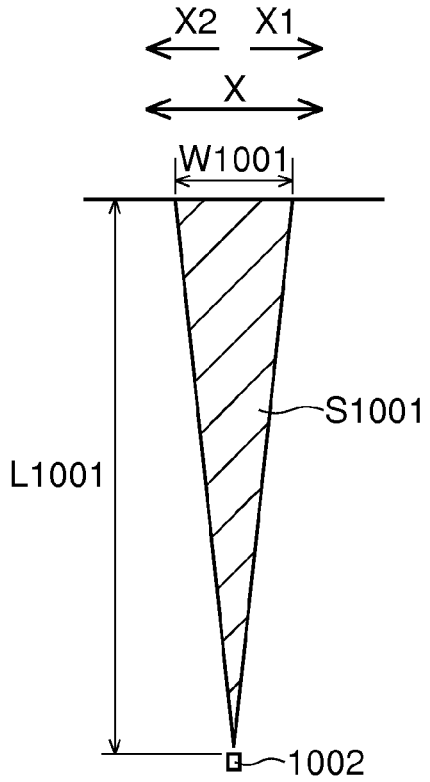
FIG. 55 is a plan view illustrating the illuminated region of the headlamp shown in FIG. 48.

Here, as shown in FIG. 54, the light emitted from position P1001*a* at the left end of the irradiated region R1001 (see FIG. 53) on the fluorescent member 1014 is emitted about 2.5 degrees at most on the right side (in the X1 direction) of the light emitted from the center position (irradiated position) P1001 of the irradiated region R1001. Likewise, the light emitted from position P1001*b* at the right end of the irradiated region R1001 is emitted about 2.5 degrees at most on the left side (in the X2 direction) of the light emitted from the center position (irradiated position) P1001 of the irradiated region R1001. Thus, as shown in FIG. 55, the light reflected from the reflector 1030 illuminates, at about 10 m (=L1001) ahead of the headlamp 1002 (automobile 1001), a region (illuminated region S1001 (the hatched region)) with a width of about 0.9 m (=W1001) in the left/right direction (X direction).

By contrast, when the driver operates the switch 1003 for switching between a driving beam and a passing beam (low beam) so that the headlamp 1002 is set for a passing beam, the position of the collimator lens 1022 is changed (moved) by the actuator 1016 (see FIG. 48).

Specifically, when the headlamp 1002 is set for a passing beam, the collimator lens 1022 is moved within a predetermined distance (for example, about 2 mm to about 3 mm) in the front/rear direction (Z1 or Z2 direction) in the optical axis direction (in the axial direction of the optical fibers 1021) by the actuator 1016. That is, the collimator lens 1022 is moved, for example, from its position in FIG. 49 to its position in FIG. 56.

Figure 56:
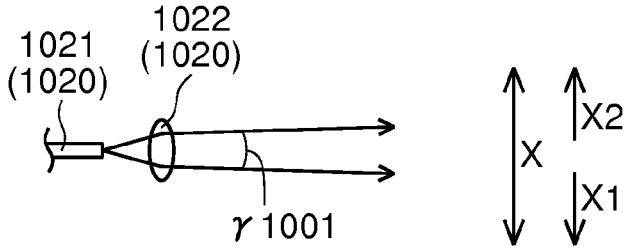
FIG. 56 is a plan view illustrating the laser light passing through the collimator lens shown in FIG. 48.
Figure 57:
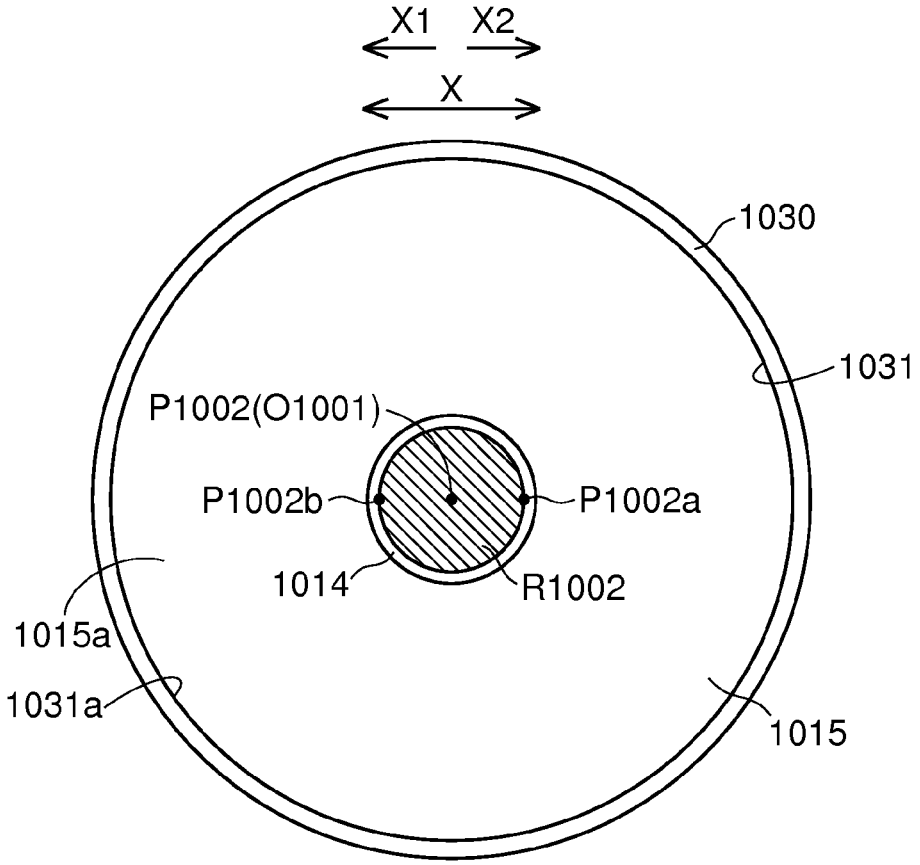
FIG. 57 is a front view showing the structure of the reflector and the fluorescent member shown in FIG. 48.

As a result, as shown in FIG. 56, the laser light that has passed through the collimator lens 1022 now travels with a predetermined fanning angle γ1001. Thus, the irradiated region on the fluorescent member 1014 is changed from R1001 (see FIG. 53) to R1002 (see FIG. 57). When the headlamp 1002 is set for a passing beam, the irradiated region R1002 on the fluorescent member 1014 has a diameter (spot diameter) of, for example, about 20 mm. That is, of the irradiated region on the fluorescent member 1014, the length in the X direction and the length in the direction (up/down direction) perpendicular to the X direction are changed so that the irradiated region R1002 on the fluorescent member 1014 has a larger area than the irradiated region R1001.

Figure 58:
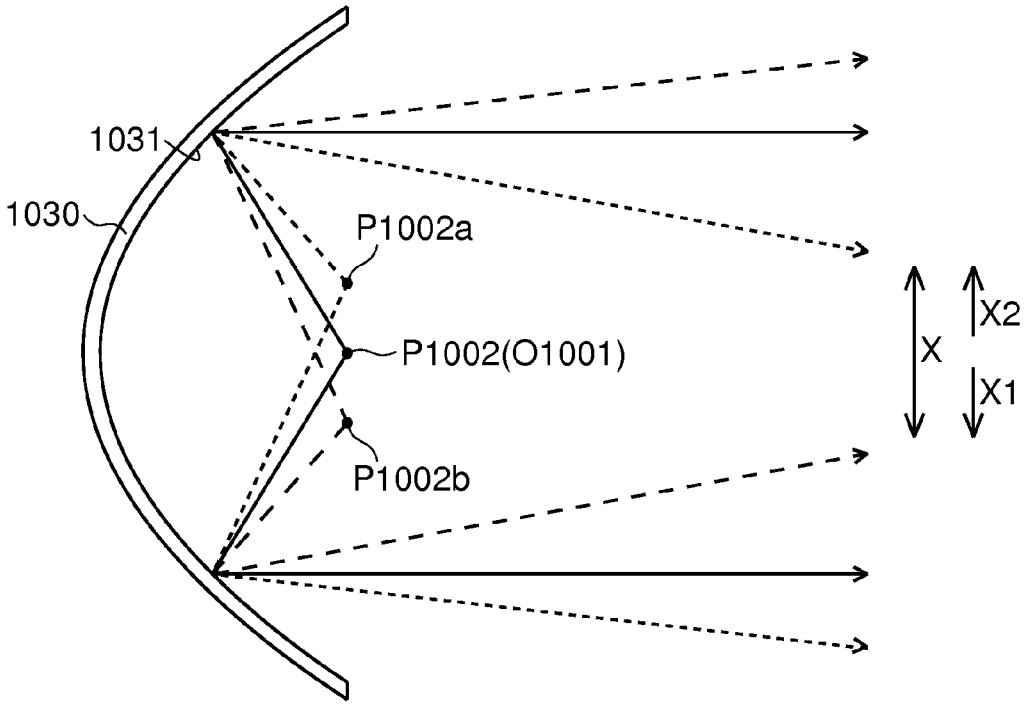
FIG. 58 is a sectional view showing the light reflected on the reflective surface of the reflector shown in FIG. 48 as seen from above.
Figure 59:
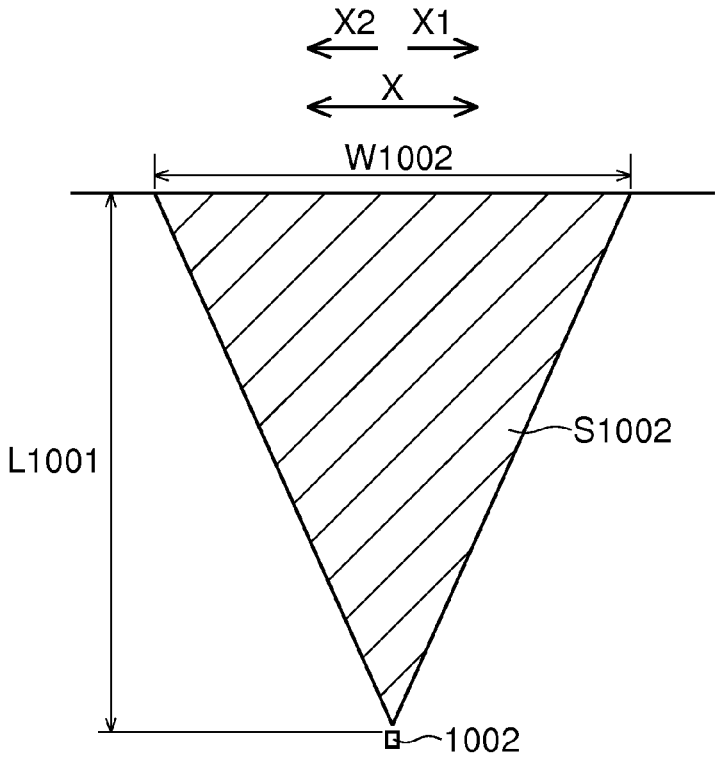
FIG. 59 is a plan view illustrating the illuminated region of the headlamp shown in FIG. 48.

Here, as shown in FIG. 58, for example, the light emitted from position P1002*a* at the left end of the irradiated region R1002 (see FIG. 57) on the fluorescent member 1014 is emitted about 24 degrees at most on the right side (in the X1 direction) of the light emitted from the center position (irradiated position) P1002 of the irradiated region R1002. Likewise, the light emitted from position P1002*b* at the right end of the irradiated region R1002 is emitted about 24 degrees at most on the left side (in the X2 direction) of the light emitted from the center position (irradiated position) P1002 of the irradiated region R1002. Thus, as shown in FIG. 59, the light reflected from the reflector 1030 illuminates, at about 10 m (=L1001) ahead of the headlamp 1002 (automobile 1001), a region (illuminated region S1002 (the hatched region)) with a width of about 9 m (=W1002) in the left/right direction (X direction). In this way, the illuminated region S1002 has a larger area than the illuminated region S1001.

Figure 60:
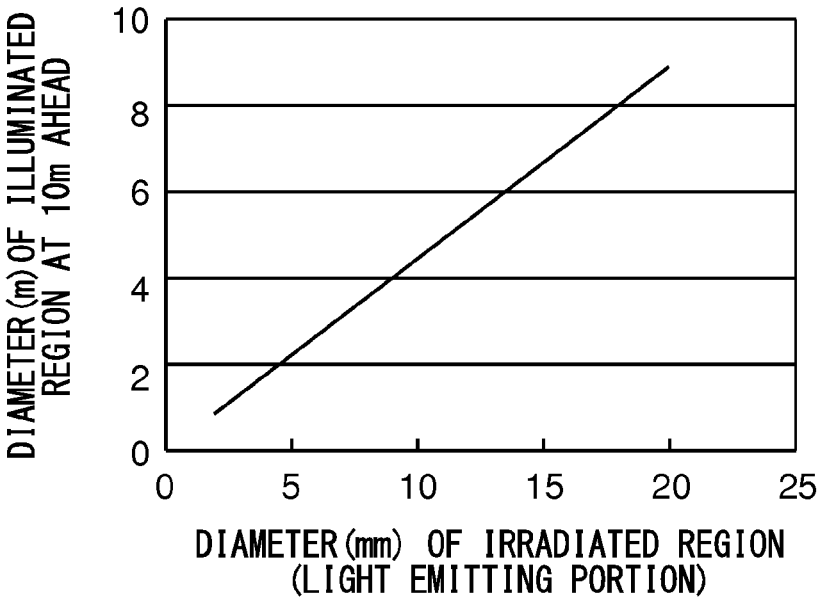
FIG. 60 is a diagram showing the relationship between the diameter of the irradiated region on the fluorescent member in the headlamp shown in FIG. 48 and the diameter of the illuminated region at 10 m ahead.

That is, by increasing (or decreasing) the area of the irradiated region on the fluorescent member 1014, it is possible to increase (or decrease) the area of the illuminated region of the headlamp 1002. The diameter of the irradiated region (light emitting portion) on the fluorescent member 1014 and the diameter (or width) of the illuminated region at 10 m ahead have a relationship as shown in FIG. 60.

Moreover, the change from the state shown in FIG. 55 to the state shown in FIG. 59 increases the area of the illuminated region and accordingly dims the illuminated region S1002. To cope with this, in Embodiment 8, in synchronism with the change of the area of the irradiated region on the fluorescent member 1014, the output adjuster 1012 increases the output of the laser light emitted from the semiconductor laser devices 1011 to keep the illuminance in the illuminated region approximately constant.

Although the above description only mentions the increase in the width (length) of the illuminated region in the X direction (horizontal direction), in reality, also the height (length) of the illuminated region in the up/down direction (the direction perpendicular to the X direction) increases.

In Embodiment 8, as described above, by changing the area of the irradiated region on the fluorescent member 1014 by use of the actuator 1016, it is possible to change the area of the illuminated region of the headlamp 1002 (the region illuminated by the headlamp 1002). Thus, there is no need to provide, for example, a headlamp for a passing beam and a headlamp for a driving beam separately for the purpose of changing the area of the illuminated region of the headlamp 1002. This makes it possible to suppress an increase in the size of the headlamp 1002 as a whole.

Moreover, in Embodiment 8, by using laser light as excited light as described above, it is possible to easily narrow down (reduce) the irradiated region on the fluorescent member 1014. That is, it is easy to irradiate only part of the fluorescent member 1014. Thus, it is possible to easily change the area of the irradiated region on the fluorescent member 1014.

Moreover, in Embodiment 8, as described above, by changing the length of the irradiated region on the fluorescent member 1014 in the horizontal direction (X direction) with the actuator 1016 as described above, it is possible to change the length of the illuminated region of the headlamp 1002 in the horizontal direction (X direction).

Moreover, in Embodiment 8, as described above, the fluorescent member 1014 is disposed in a region that includes the focal point F1001 of the reflective surface 1031. Thus, by changing the area of the irradiated region on the fluorescent member 1014, it is possible to easily change the area of the illuminated region of the headlamp 1002.

Moreover, in a case where the irradiated position on the fluorescent member 1014 is located at the focal point F1001 of the reflective surface 1031 and the irradiated region on the fluorescent member 1014 is narrowed down (reduced), it is possible to easily make the light (illumination light) emitted outside from the headlamp 1002 into an approximately parallel beam. Moreover, in a case where the irradiated position on the fluorescent member 1014 is located at the focal point F1001 of the reflective surface 1031, it is possible to suppress the illuminated region of the headlamp 1002 becoming doughnut-shaped (disc-shaped) or extremely dim.

Moreover, in Embodiment 8, as described above, simply by moving the collimator lens 1022 in the optical axis direction, it is possible to change the fanning angle of the laser light and to change the area of the irradiated region on the fluorescent member 1014.

All that has to be done to change the area of the irradiated region on the fluorescent member 1014 is to move the collimator lens 1022 in the optical axis direction. This makes it possible to make the actuator 1016 sufficiently compact.

Moreover, in Embodiment 8, as described above, a collimator lens 1022 is provided which makes the laser light emitted from the semiconductor laser devices 1011 into a parallel beam. This makes it possible to more easily narrow down (reduce) the irradiated region on the fluorescent member 1014.

Embodiment 9

As a ninth embodiment (Embodiment 9) of the invention, with reference to FIGS. 61 to 70, a description will be given of a case where, as distinct from in Embodiment 8 described previously, the focal point F1101 of the reflective surface 1131 is located near the vertex V1101.

First, with reference to FIGS. 61 to 64, the design of an automobile 1101 provided with a headlamp 1102 according to Embodiment 9 will be described.

Figure 61:
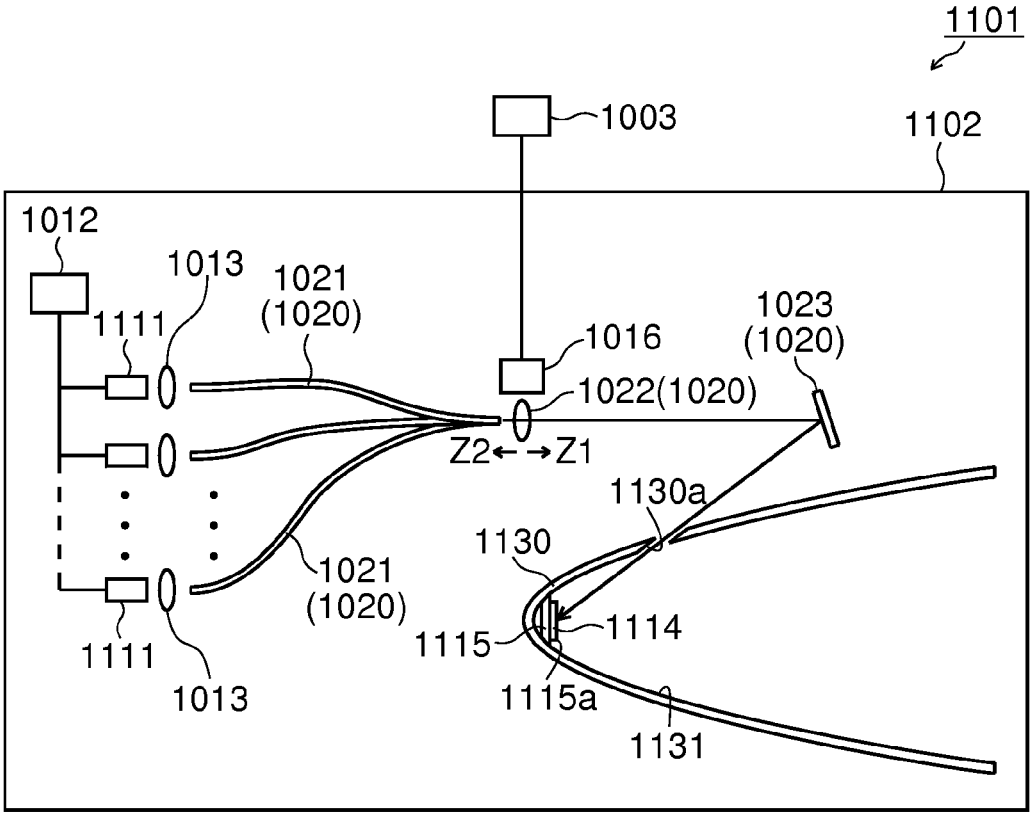
FIG. 61 is a side view schematically showing an overall design of an automobile provided with a headlamp according to Embodiment 9 of the invention.

As shown in FIG. 61, the automobile 1101 according to Embodiment 9 is provided with a headlamp 1102 and a switch 1003. The automobile 1101 is an example of a "mobile body" according to the invention, and the headlamp 1102 is an example of a "lighting apparatus" according to the invention.

The headlamp 1102 includes: a plurality of (for example, ten) semiconductor laser devices 1111; an output adjuster 1012; light guide members 1020; condenser lenses 1013; a fluorescent member 1114; a holding member 1115; and a reflector 1130 which has a reflective surface 1131. The semiconductor laser devices 1111 are an example of a "laser generator" according to the invention, and the fluorescent member 1114 is an example of a "light emitting member" according to the invention. The reflector 1130 is an example of a "light projecting member" according to the invention.

The semiconductor laser devices 1111 are designed to emit blue-violet laser light with a center wavelength of, for example, about 405 nm.

Figure 62:
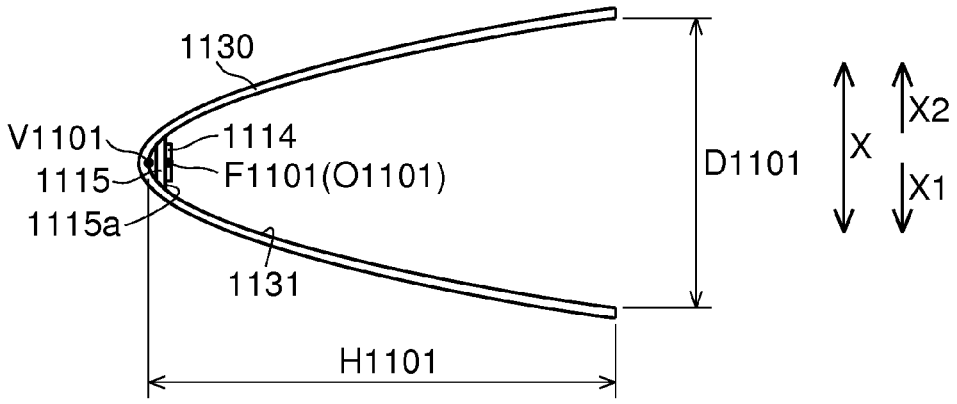
FIG. 62 is a sectional view showing the structure of the reflector and the fluorescent member shown in FIG. 61 as seen from above.

As shown in FIG. 62, the fluorescent member 1114 is so formed as to extend in the direction perpendicular to (crossing) the depth direction of the reflective surface 1131 of the reflector 1130 (the direction in which the axis through the vertex V1101 and the focal point F1101 of the reflective surface 1131 extends). Moreover, as shown in FIG. 63, the fluorescent member 1114 is formed in a circular shape with a diameter of, for example, 10 mm or more.

Figure 63:
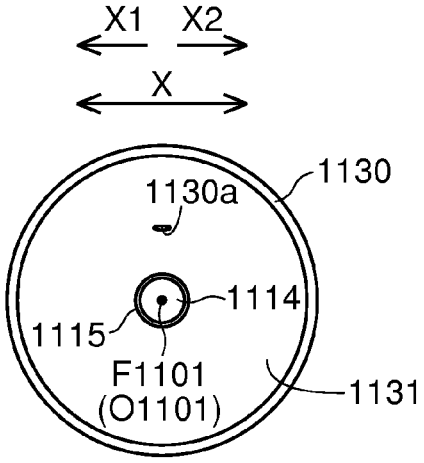
FIG. 63 is a front view showing the structure of the reflector and the fluorescent member shown in FIG. 61.

Moreover, as shown in FIGS. 62 and 63, the fluorescent member 1114 is disposed in a region that includes the focal point F1101 of the reflective surface 1131 of the reflector 1130, and the center O1101 of the fluorescent member 1114 approximately coincides with the focal point F1101 of the reflective surface 1131.

Moreover, the fluorescent member 1114 is formed by dispersing, in UV-curing resin, about 30% by weight of mixed powder of phosphor particles of $Ce^{3+}$-activated α-SiAlON and phosphor particles of $CaAlSiN_3:Eu^{2+}$, then applying the UV-curing resin on the holding member 1115 in a layer with a thickness of about 0.2 mm, and then curing the UV-curing resin.

The phosphor $Ce^{3+}$-activated α-SiAlON has the function of converting the laser light from the semiconductor laser devices 1111 into blue-green light (visible light) with a center wavelength of about 520 nm. On the other hand, the phosphor $CaAlSiN_3:Eu^{2+}$ has the function of converting the laser light from the semiconductor laser devices 1111 into red light (visible light) with a center wavelength of about 630 nm. The light of these different colors mixes to produce white light.

The holding member 1115 is formed of a sheet of metal with high thermal conductivity such as aluminum or copper, and has the function of conducting the heat generated in the fluorescent member 1114 to the reflector 1130. The holding surface 1115*a* of the holding member 1115 may be plated with silver or the like so as to have the function of reflecting the light emitted from the fluorescent member 1114.

Moreover, in Embodiment 9, as shown in FIG. 62, the holding member 1115 is fitted near the vertex V1101 of the reflective surface 1131 of the reflector 1130.

Here, in Embodiment 9, the reflective surface 1131 of the reflector 1130 is formed in the shape of a deep hole with an aspect ratio (depth-to-diameter ratio) of 1 or more. Specifically, the reflective surface 1131 has a diameter (=D1101) of about 60 mm and a depth (=H1101) of about 80 mm. Moreover, the focal point F1101 of the reflective surface 1131 is located near the vertex V1101 of the reflective surface 1131 (the portion of the reflective surface 1131 about 2.8 mm apart from the vertex V1101). That is, the fluorescent member 1114 is disposed near the vertex V1101 of the reflective surface 1131 (reflector 1130).

Moreover, as shown in FIG. 61, the reflector 1130 has a through hole 1130*a* formed in it, and through the through hole 1130*a*, the fluorescent member 1114 is irradiated with laser light.

Moreover, in Embodiment 9, the reflector 1130 is so formed as to reflect forward the light emitted from the fluorescent member 1114 in the direction from which it is irradiated with laser.

Figure 64:
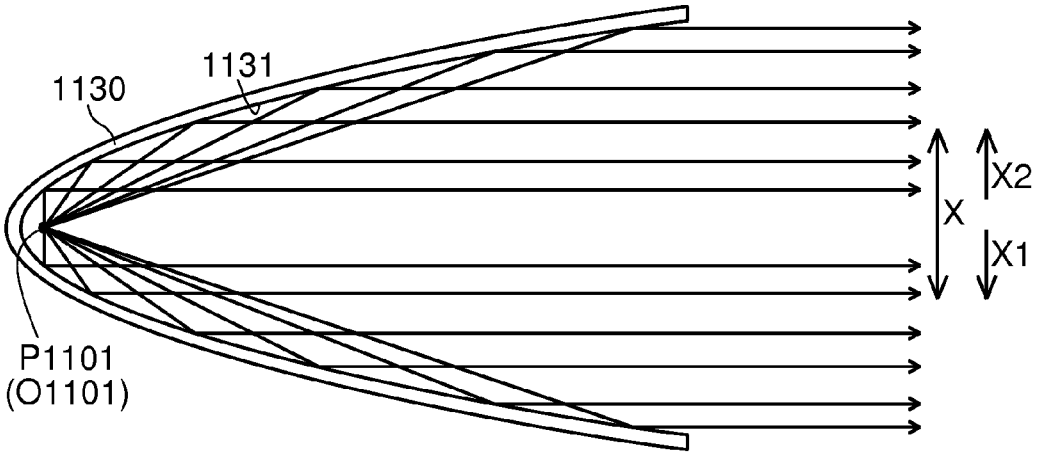
FIG. 64 is a sectional view showing the light reflected on the reflective surface of the reflector shown in FIG. 61 as seen from above.

Moreover, as shown in FIG. 64, the reflector 1130 is so formed as to make the light from the center O1101 of the fluorescent member 1114 (see FIG. 62) (the portion of the fluorescent member 1114 located at the focal point F1101 of the reflective surface 1131) into a parallel beam while reflecting it forward.

In other respects, the design in Embodiment 9 is similar to that in Embodiment 8 described previously.

Next, with reference to FIGS. 61 and 65 to 70, how the headlamp 1102 operates will be described.

Figure 65:
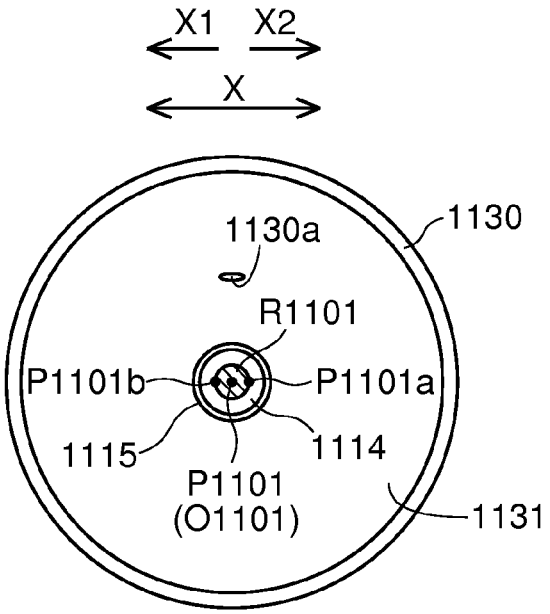
FIG. 65 is a front view showing the structure of the reflector and the fluorescent member shown in FIG. 61.

When the headlamp 1102 is set for, for example, a driving beam (high beam), as shown in FIG. 65, the laser light emitted from the semiconductor laser devices 1111 and guided through the light guide members 1020 is applied to an irradiated region R1101 on the fluorescent member 1114 (a region that includes the center O1101 of the fluorescent member 1114) (the hatched region). When the headlamp 1102 is set for a driving beam, the irradiated region R1101 on the fluorescent member 1114 has a diameter of, for example, about 2 mm.

Figure 66:
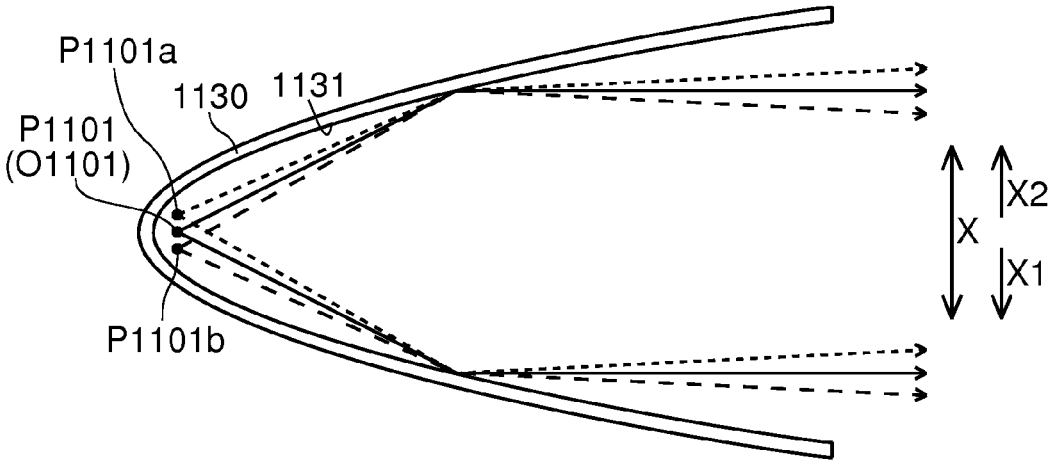
FIG. 66 is a sectional view showing the light reflected on the reflective surface of the reflector shown in FIG. 61 as seen from above.
Figure 67:
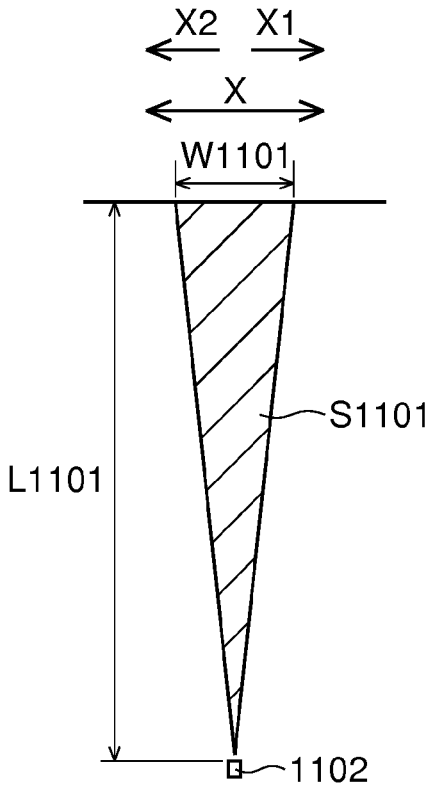
FIG. 67 is a plan view illustrating the illuminated region of the headlamp shown in FIG. 61.

Here, as shown in FIG. 66, for example, the light emitted from position P1101*a* at the left end of the irradiated region R1101 (see FIG. 65) on the fluorescent member 1114 is emitted on the left side (in the X2 direction) of the light emitted from the center position (irradiated position) P1101 of the irradiated region R1101. Likewise, the light emitted from position P1101*b* at the right end of the irradiated region R1101 is emitted on the right side (in the X1 direction) of the light emitted from the center position (irradiated position) P1101 of the irradiated region R1101. Thus, as shown in FIG. 67, the light reflected from the reflector 1130 illuminates, at about 10 m (=L1101) ahead of the headlamp 1102 (automobile 1101), a region (illuminated region S1101 (the hatched region)) with a width of about 0.7 m (=W1101) in the left/right direction (X direction).

By contrast, when the driver operates the switch 1003 for switching between a driving beam and a passing beam (low beam) so that the headlamp 1102 is set for a passing beam, the position of the collimator lens 1022 is changed (moved) by the actuator 1016 (see FIG. 61).

Specifically, when the headlamp 1102 is set for a passing beam, the collimator lens 1022 is moved across a predetermined distance in the front/rear direction (Z1 or Z2 direction) in the axial direction of the optical fibers 1021 by the actuator 1016.

Figure 68:
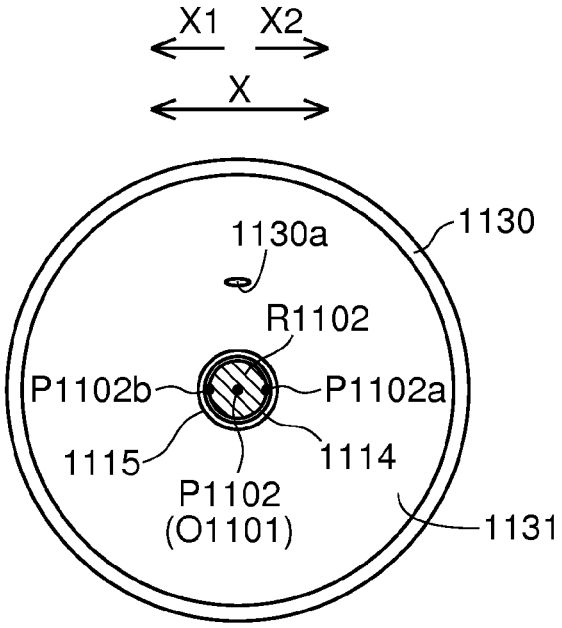
FIG. 68 is a front view showing the structure of the reflector and the fluorescent member shown in FIG. 61.

As a result, the irradiated region on the fluorescent member 1114 is changed from R1101 (see FIG. 65) to R1102 (see FIG. 68). When the headlamp 1102 is set for a passing beam, the irradiated region R1102 on the fluorescent member 1114 has a diameter of, for example, about 10 mm.

Figure 69:
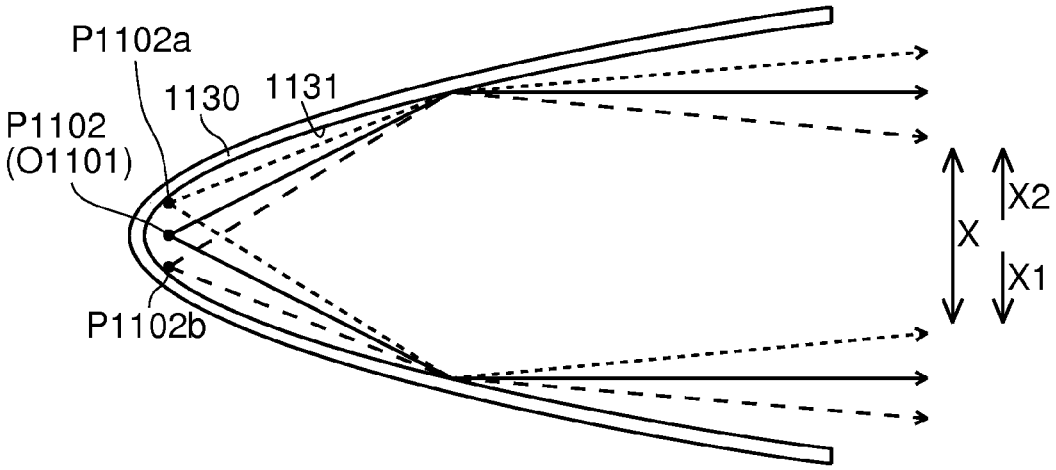
FIG. 69 is a sectional view showing the light reflected on the reflective surface of the reflector shown in FIG. 61 as seen from above.
Figure 70:
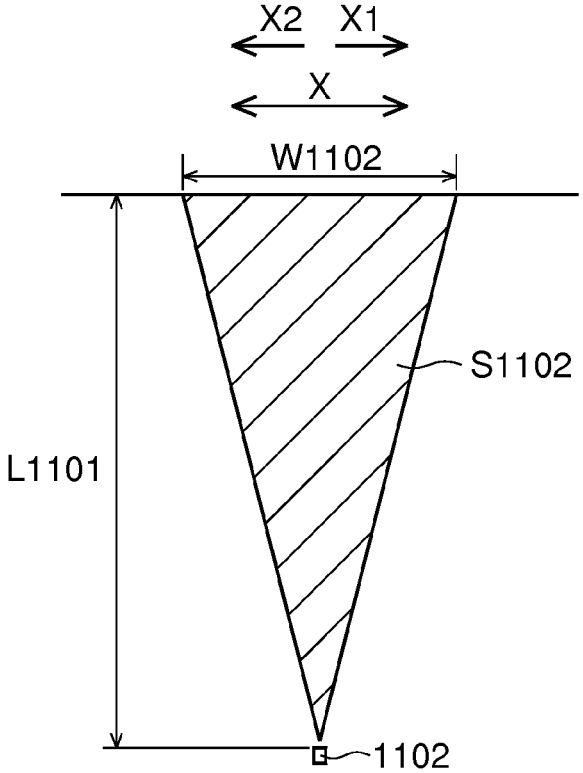
FIG. 70 is a plan view illustrating the illuminated region of the headlamp shown in FIG. 61.

Here, as shown in FIG. 69, for example, the light emitted from position P1102*a* at the left end of the irradiated region R1102 (see FIG. 68) on the fluorescent member 1114 is emitted about 9.4 degrees at most on the left side (in the X2 direction) of the light emitted from the center position (irradiated position) P1102 of the irradiated region R1102. Likewise, the light emitted from position P1102*b* at the right end of the irradiated region R1102 is emitted about 9.4 degrees at most on the right side (in the X1 direction) of the light emitted from the center position (irradiated position) P1102 of the irradiated region R1102. Thus, as shown in FIG. 70, the light reflected from the reflector 1130 illuminates, at about 10 m (=L1101) ahead of the headlamp 1102 (automobile 1101), a region (illuminated region S1102 (the hatched region)) with a width of about 3.3 m (=W1102) in the left/right direction (X direction). In this way, the illuminated region S1102 has a larger area than the illuminated region S1101.

In other respects, the operation in Embodiment 9 is similar to that in Embodiment 8 described previously.

In Embodiment 9, as described above, the holding member 1115 is made of metal, and this makes it possible to reject the heat generated in the fluorescent member 1114 to the holding member 1115. Thus, it is possible to suppress the fluorescent member 1114 becoming hot.

Moreover, in Embodiment 9, as described above, by locating the focal point F1101 of the reflective surface 1131 near the vertex V1101 of the reflective surface 1131, it is possible to form the reflective surface 1131 in the shape of a deep hole having a vertex V1101 (focal point F1101) located deep and having a small diameter (=D1101). This permits a large part of the light emitted from the fluorescent member 1114 to be reflected on the reflective surface 1131 and then emitted outside. In this way, it is possible to effectively change the area of the illuminated region of the headlamp 1102. It is also possible to suppress an increase in the fanning angle of the light emitted outside without striking the reflector 1130.

Moreover, in Embodiment 9, as described above, the light emitted from the fluorescent member 1114 in the direction (forward) from which it is irradiated with laser light is reflected on the reflector 1130. The fluorescent member 1114 is brightest, and hence emits the largest amount of light, in its portion where it is irradiated with laser light. Thus, by reflecting on the reflector 1130 the light emitted from the fluorescent member 1114 in the direction (forward) from which it is irradiated with laser light, it is possible to achieve improved light use efficiency as compared with in Embodiment 8 described previously (where the light emitted from the fluorescent member 1014 in the direction (backward) opposite from the direction from which it is irradiated with laser light is reflected on the reflector 1030).

In other respects, the benefits of Embodiment 9 are similar to those of Embodiment 8 described previously.

Embodiment 10

As a tenth embodiment (Embodiment 10) of the invention, with reference to FIG. 71, a description will be given of a case where, as distinct from in Embodiment 8 described previously, laser light is applied to the fluorescent member 1214 from behind.

Figure 71:
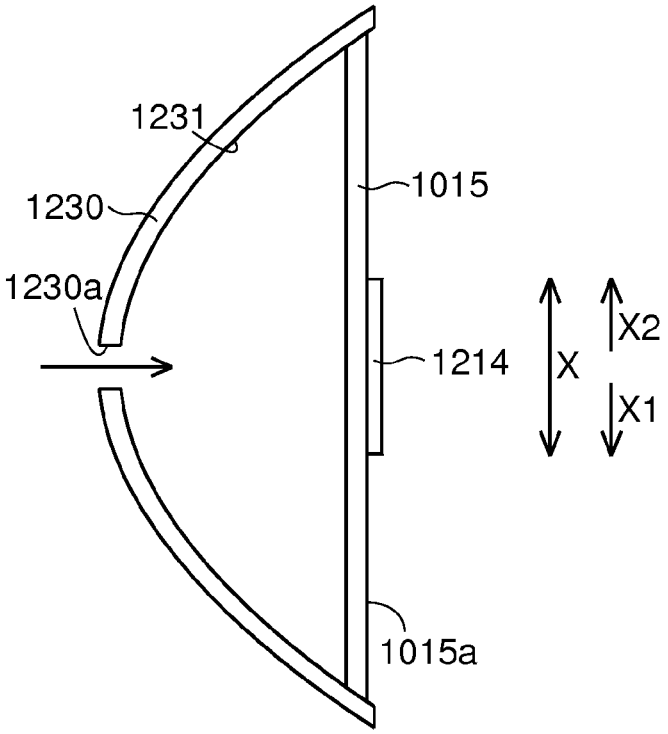
FIG. 71 is a sectional view showing the structure of the reflector and the fluorescent member in a headlamp according to Embodiment 10 of the invention as seen from above.

In the headlamp according to Embodiment 10, as shown in FIG. 71, in a portion of the reflector 1230 including the vertex of the reflective surface 1231, an opening 1230*a* is formed.

The reflector 1230 is an example of a "light projecting member" according to the invention.

The fluorescent member 1214 here is, like the fluorescent member 1114 in Embodiment 9 described previously, formed by dispersing, in UV-curing resin, about 30% by weight of mixed powder of phosphor particles of $Ce^{3+}$-activated α-SiAlON and phosphor particles of $CaAlSiN_3:Eu^{2+}$, then applying the UV-curing resin on the holding member 1015 in a layer with a thickness of about 0.2 mm, and then curing the UV-curing resin. The fluorescent member 1214 is an example of a "light emitting member" according to the invention.

In Embodiment 10, as in Embodiment 9 described previously, semiconductor laser devices 1111 are used as a laser light source.

In Embodiment 10, laser light is applied through the opening 1230*a* in the reflector 1230 to the fluorescent member 1214 from behind.

In other respects, the design in Embodiment 10 is similar to that in Embodiment 8 described previously.

The operation in and benefits of Embodiment 10 are similar to those in and of Embodiments 8 and 9 described previously.

Embodiment 11

As an eleventh embodiment (Embodiment 11) of the invention, with reference to FIG. 72, a description will be given of a case where, as distinct from in Embodiment 9 described previously, laser light is applied to the fluorescent member 1314 from behind.

Figure 72:
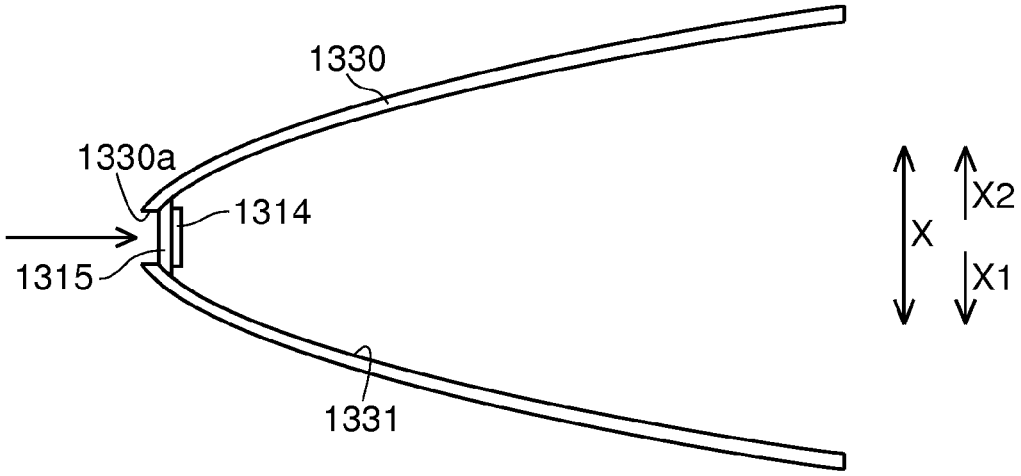
FIG. 72 is a sectional view showing the structure of the reflector and the fluorescent member in a headlamp according to Embodiment 11 of the invention as seen from above.

In the headlamp according to Embodiment 11, as shown in FIG. 72, in a portion of the reflector 1330 including the vertex of the reflective surface 1331, an opening 1330*a* is formed. The reflector 1330 is an example of a "light projecting member" according to the invention.

The fluorescent member 1314 here is, like the fluorescent member 1014 in Embodiment 8 described previously, formed, for example, by dispersing, in UV-curing resin, about 15% by weight of powder of phosphor particles of $(Y,Gd)_3Al_5O_{12}:Ce$, then applying the UV-curing resin on the holding member 1315 in a layer with a thickness of about 0.5 mm, and then curing the UV-curing resin. The fluorescent member 1314 is an example of a "light emitting member" according to the invention.

In Embodiment 11, as in Embodiment 8 described previously, semiconductor laser devices 1011 are used as a laser light source.

Moreover, the holding member 1315 is formed of a light transmitting material, for example a sheet of glass. The holding member 1315 has only to have the function of transmitting at least laser light.

In Embodiment 11, laser light is applied through the opening 1330*a* in the reflector 1330 to the fluorescent member 1314 from behind.

In other respects, the design in Embodiment 11 is similar to that in Embodiment 9 described previously.

The operation in and benefits of Embodiment 11 are similar to those of Embodiments 8 and 9 described previously.

Embodiment 12

As a twelfth embodiment (Embodiment 12) of the invention, with reference to FIGS. 73 and 74, a description will be given of a case where, as distinct from in Embodiment 9 described previously, no reflector 1430 is provided below the fluorescent member 1414.

Figure 73:
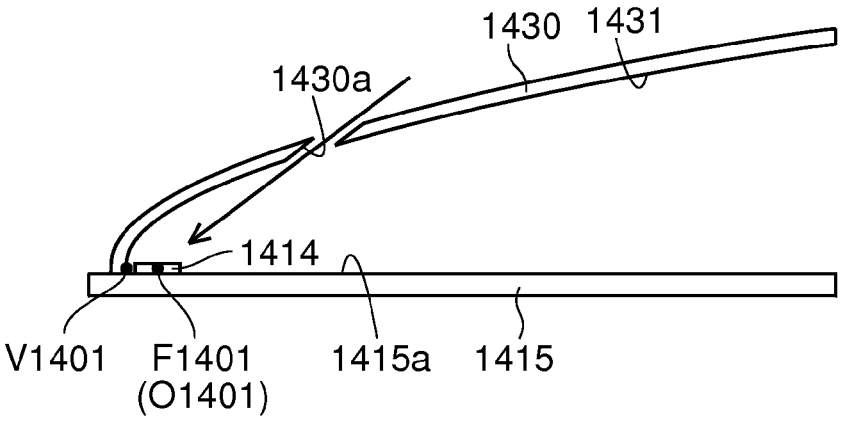
FIG. 73 is a sectional view showing the structure of the reflector and the fluorescent member in a headlamp according to Embodiment 12 of the invention as seen from a side.

In the headlamp according to Embodiment 12, as shown in FIG. 73, the reflective surface 1431 of the reflector 1430 is formed in the shape of a paraboloid divided on a plane perpendicular to (crossing) the axis through the vertex V1401 and the focal point F1401 and further divided on a plane parallel to the axis through the vertex V1401 and the focal point F1401.

That is, the reflector 1430 is formed in the shape of the reflector 1130 in Embodiment 9 described previously with its approximately the lower half cut off. Thus, no portion of the reflector 1430 lies below the fluorescent member 1414. The fluorescent member 1414 is an example of a "light emitting member" according to the invention, and the reflector 1430 is an example of a "light projecting member" according to the invention.

Moreover, the reflector 1430 has a through hole 1430*a* formed in it, and through the through hole 1430*a*, laser light is applied to the fluorescent member 1414.

Moreover, in Embodiment 12, the holding member 1415 is disposed so as to cover the bottom of the reflector 1430. That is, the holding surface 1415*a* of the holding member 1415 is so formed as to extend both in the depth direction of the reflective surface 1431 of the reflector 1430 (the direction in which the axis through the vertex V1401 and the focal point F1401 extends) and in the X direction (see FIG. 74).

The holding member 1415 is formed of a sheet of metal, and has the function of rejecting, and conducting to the reflector 1430, the heat generated in the fluorescent member 1414. The holding surface 1415*a* of the holding member 1415 may be given the function of reflecting the light emitted from the fluorescent member 1414.

Figure 74:
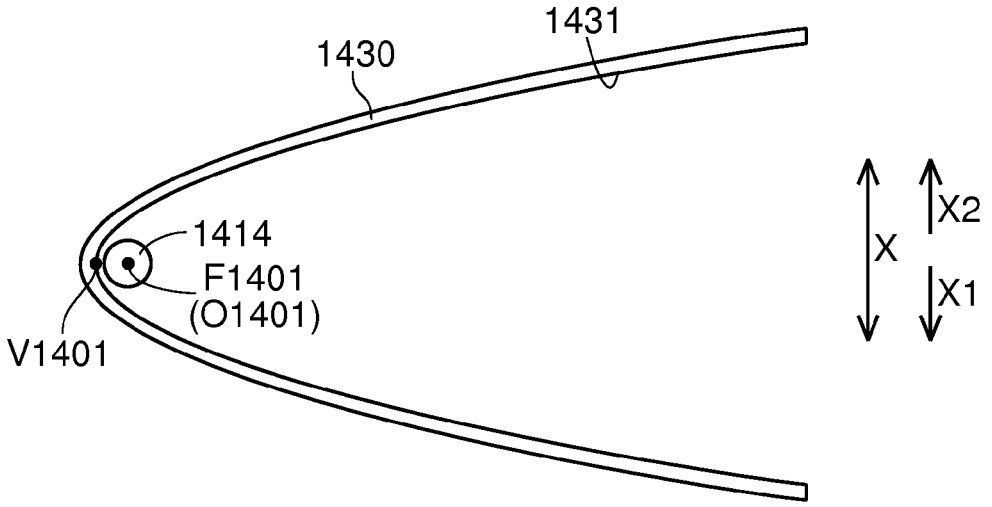
FIG. 74 is a sectional view showing the structure of the reflector and the fluorescent member shown in FIG. 73 as seen from above.

Moreover, as shown in FIGS. 73 and 74, the fluorescent member 1414 is disposed in a region on the reflective surface 1431 including the focal point F1401, and the center O1401 of the fluorescent member 1414 approximately coincides with the focal point F1401 of the reflective surface 1431.

Moreover, in Embodiment 12, the fluorescent member 1414 is so formed as to extend in the depth direction of the reflective surface 1431 and in the X direction. By changing, of the irradiated region on the fluorescent member 1414, the length in the depth direction of the reflective surface 1431 and the length in the X direction, the area of the irradiated region on the fluorescent member 1414 is changed.

Moreover, the fluorescent member 1414 is, as in Embodiments 9 and 10 described previously, formed, for example, by dispersing, in UV-curing resin, about 30% by weight of mixed powder of phosphor particles of $Ce^{3+}$-activated α-SiAlON and phosphor particles of $CaAlSiN_3:Eu^{2+}$, then applying the UV-curing resin on the holding member 1415 in a layer with a thickness of about 0.2 mm, and then curing the UV-curing resin.

In Embodiment 12, as in Embodiments 9 and 10 described previously, semiconductor laser devices 1111 are used as a laser light source.

In other respects, the design and operation in Embodiment 12 are similar to those in Embodiment 9 described previously.

In Embodiment 12, as described above, the reflective surface 1431 (reflector 1430) is formed in the shape of a paraboloid divided on a plane crossing the axis through the focal point F1401 and vertex V1401 and further divided on a plane parallel to the axis through the focal point F1401 and vertex V1401. This makes it possible to make the reflector 1430 and hence the headlamp compact.

In other respects, the benefits of Embodiment 12 are similar to those of Embodiment 9 described previously.

Embodiment 13

As a thirteenth embodiment (Embodiment 13) of the invention, with reference to FIGS. 75 to 78, a description will be given of a case where, as distinct from in Embodiments 8 to 12 described previously, the irradiated region on the fluorescent member 1514 is changed into a laterally long shape.

First, with reference to FIGS. 75 and 76, the design of an automobile 1501 provided with a headlamp 1502 according to Embodiment 13 will be described.

Figure 75:
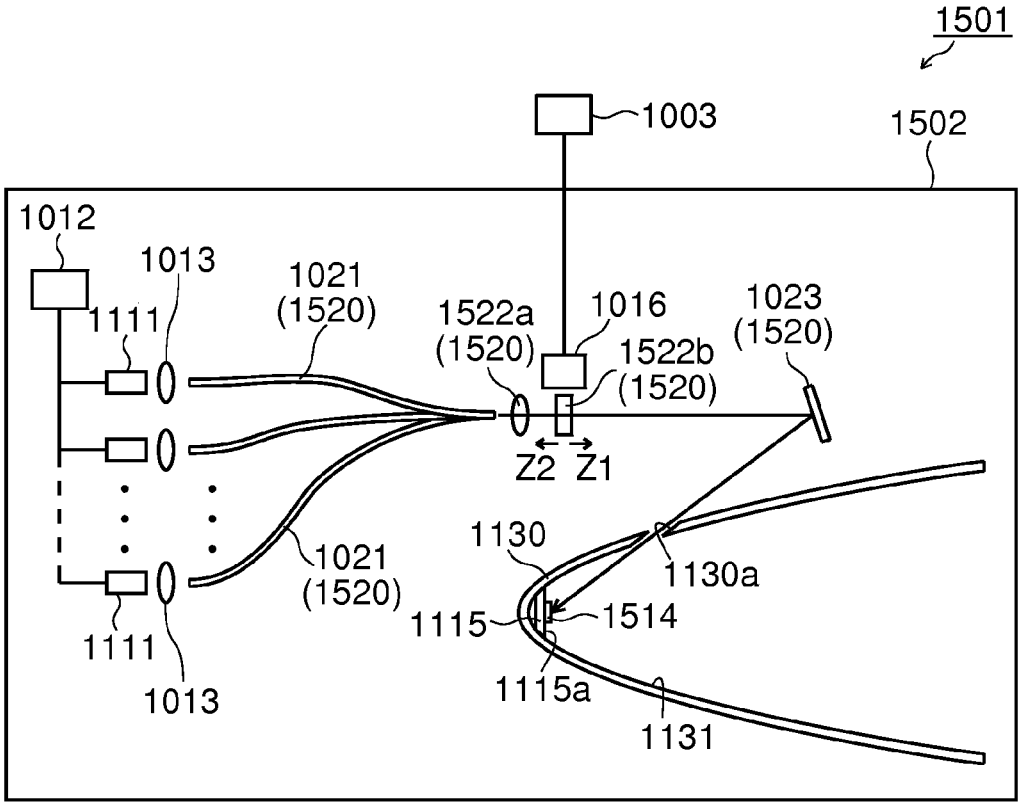
FIG. 75 is a side view schematically showing an overall design of an automobile provided with a headlamp according to Embodiment 13 of the invention.

As shown in FIG. 75, the automobile 1501 according to Embodiment 13 is provided with a headlamp 1502 and a switch 1003. The automobile 1501 is an example of a "mobile body" according to the invention, and the headlamp 1502 is an example of an "lighting apparatus" according to the invention.

In Embodiment 13, the light guide members 1520 are composed of a plurality of optical fibers 1021, a lens 1522*a* which is disposed opposite the laser light exit faces of the optical fibers 1021, a lens 1522*b* which is disposed in the optical path of the laser light that has passed through the lens 1522*a*, and a reflector 1023. The lens 1522*b* is an example of a "lens" according to the invention.

The lens 1522*a* is constituted by, for example, a cylindrical lens, and has the function of, while transmitting light, condensing it (making it convergent by refraction) in the up/down direction (the direction perpendicular to the X direction). The lens 1522*b* is constituted by, for example, a cylindrical lens, and has the function of, while transmitting light, condensing it (making it convergent by refraction) in the horizontal direction (X direction).

The lenses 1522*a* and 1522*b* function as a collimator lens which makes the laser light emitted from the optical fibers 1021 into a parallel beam while transmitting it.

Moreover, in Embodiment 13, the lens 1522*b* is so arranged as to be movable, by the actuator 1016, within a predetermined distance in the front/rear direction (Z1 and Z2 directions) in the axial direction of the optical fibers 1021.

Figure 76:
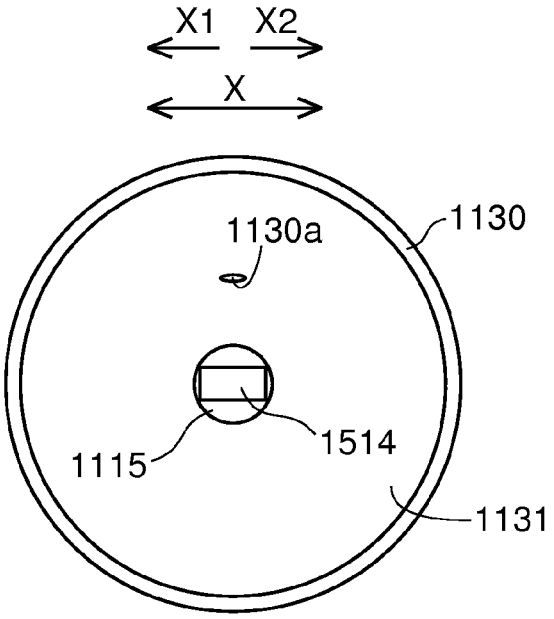
FIG. 76 is a front view showing the structure of the reflector and the fluorescent member shown in FIG. 75.

Moreover, in Embodiment 13, as shown in FIG. 76, the fluorescent member 1514 is formed in a laterally long (elongate) shape extending in the left/right direction (horizontal direction, X direction). The fluorescent member 1514 is an example of a "light emitting member" according to the invention.

In other respects, the design in Embodiment 13 is similar to that in Embodiment 9 described previously.

Next, with reference to FIGS. 75, 77, and 78, how the headlamp 1502 operates will be described.

Figure 77:
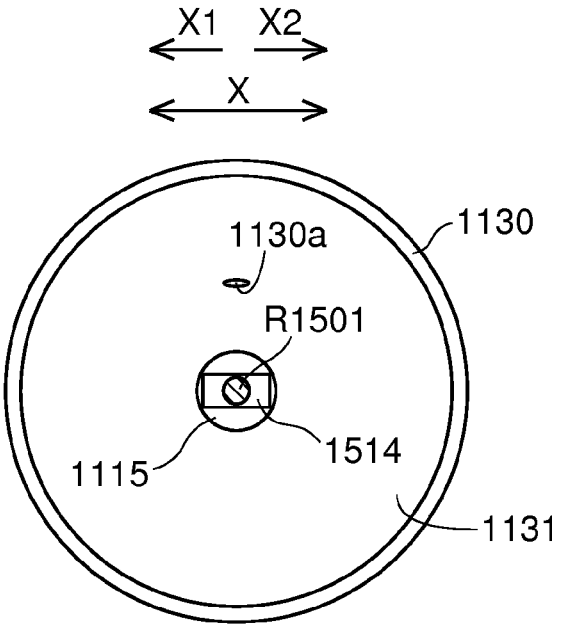
FIG. 77 is a front view showing the structure of the reflector and the fluorescent member shown in FIG. 75.
Figure 78:
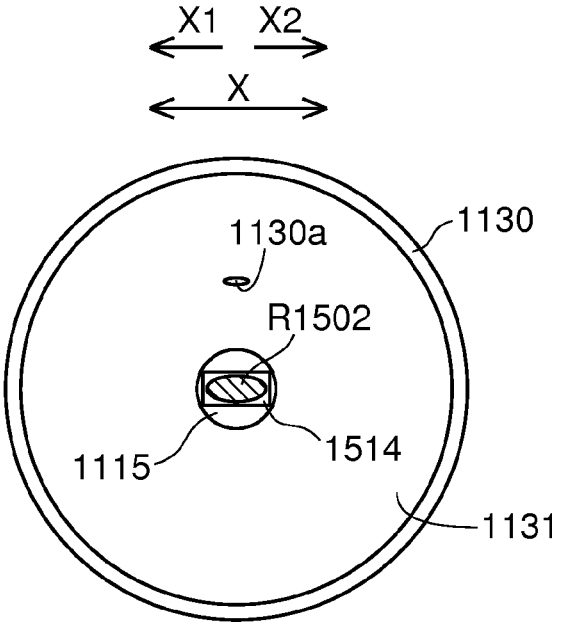
FIG. 78 is a front view showing the structure of the reflector and the fluorescent member shown in FIG. 75.

When the headlamp 1502 is set, for example, for a driving beam (high beam), as shown in FIG. 77, the irradiated region R1501 (the hatched region) on the fluorescent member 1514 has an approximately circular shape.

By contrast, when the headlamp 1502 is set for a passing beam (low beam), the position of the lens 1522*b* is changed (moved) by the actuator 1016 (see FIG. 75).

Specifically, when the headlamp 1502 is set for a passing beam, the lens 1522*b* is moved across a predetermined distance in the front/rear direction (Z1 or Z2 direction) in the axial direction of the optical fibers 1021 by the actuator 1016.

Thus, the laser light that has passed through that lens 1522*b* now travels with a predetermined fanning angle in the horizontal direction (X direction). Accordingly, as shown in FIG. 78, the irradiated region R1502 (the hatched region) on the fluorescent member 1514 comes to have an elliptic shape (laterally long shape) extending in the horizontal direction (X direction). Here, whereas the length of the irradiated region on the fluorescent member 1514 in the horizontal direction (the X direction) increases, the length of the irradiated region on the fluorescent member 1514 in the up/down direction (the direction perpendicular to the X direction) remains unchanged.

Thus, the illuminated region of the headlamp 1502 broadens (becomes larger) in the horizontal direction (X direction).

In other respects, the operation in Embodiment 13 is similar to that in Embodiment 8 described previously.

In Embodiment 13, as described above, by changing the irradiated region R1502 on the fluorescent member 1514 into a laterally long shape extending in the horizontal direction (X direction), it is possible to broaden the illuminated region of the headlamp 1002 in the horizontal direction while suppressing it broadening in the up/down direction.

In other respects, the benefits of Embodiment 13 are similar to those of Embodiment 9 described previously.

Embodiment 14

As a fourteenth embodiment (Embodiment 14) of the invention, with reference to FIGS. 79 to 83, a description will be given of a case where, as distinct from in Embodiments 8 to 13 described previously, the irradiated position on the fluorescent member 1014 is changed as well.

First, with reference to FIG. 79, the design of an automobile 1601 provided with a headlamp 1602 according to Embodiment 14 will be described.

Figure 79:
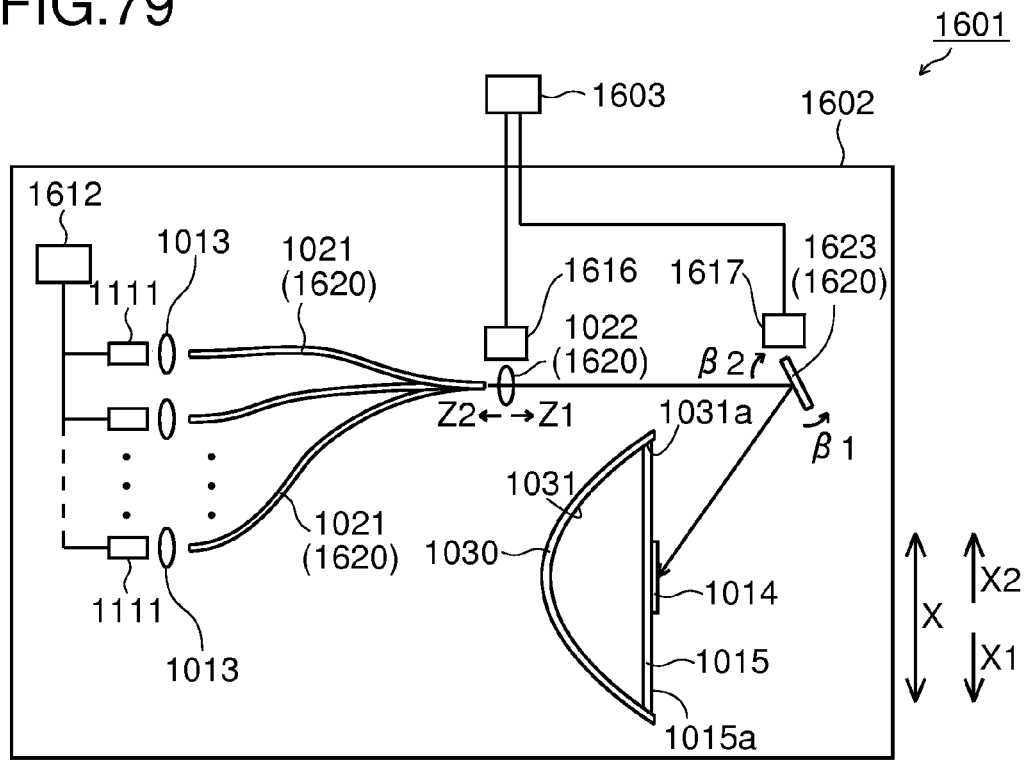
FIG. 79 is a plan view schematically showing an overall design of an automobile provided with a headlamp according to Embodiment 14 of the invention.

As shown in as shown in FIG. 79, the automobile 1601 according to Embodiment 14 is provided with a headlamp 1602 and a steering angle detector 1603 which detects the steering angle of the automobile 1601. The automobile 1601 is an example of a "mobile body" according to the invention, and the headlamp 1602 is an example of a "lighting apparatus" according to the invention.

The headlamp 1602 includes: a plurality of (for example, ten) semiconductor laser devices 1011; an output adjuster 1612; light guide members 1620; condenser lenses 1013; a fluorescent member 1014; a holding member 1015; and a reflector 1030 having a reflective surface 1031.

As will be described later, the output adjuster 1612 has the function of adjusting the output of the semiconductor laser devices 1011 in synchronism with the change of the area of the irradiated region on the fluorescent member 1014 and the change of the irradiated position (the center position of the irradiated region) on the fluorescent member 1014 at which it is irradiated with laser light.

The light guide members 1620 are composed of a plurality of optical fibers 1021, a collimator lens 1022, and a reflector 1623.

The collimator lens 1022 is so arranged as to be movable, by an actuator 1616, within a predetermined distance in the front/rear direction (Z1 and Z2 directions) in the axial direction of the optical fibers 1021. The actuator 1616 is an example of an "irradiated area changer" according to the invention.

The actuator 1616 is electrically connected to the steering angle detector 1603, and has the function of adjusting (moving) the position of the collimator lens 1022 in the axial direction of the optical fibers 1021 in accordance with the steering angle detected by the steering angle detector 1603.

The reflector 1623 has the function of reflecting the laser light from the collimator lens 1022 toward the fluorescent member 1014.

Here, in Embodiment 14, the reflector 1623 is so arranged as to be rotatable, by an actuator 1617, within a predetermined range of angles in the left/right direction (β1 and β2 directions). The actuator 1617 is an example of an "irradiation position changer" according to the invention.

The actuator 1617 is electrically connected to the steering angle detector 1603, and has the function of adjusting the angle of the reflector 1623 with respect to the axial direction of the optical fibers 1021 in accordance with the steering angle detected by the steering angle detector 1603. Thus, the irradiated position on the fluorescent member 1014 is changed (moved), for example, in the X direction and thereafter stopped by the actuator 1617. Between the actuator 1617 and the steering angle detector 1603, a controller (unillustrated) which controls the entire headlamp 1602 may be provided so that the controller outputs a control signal to the actuator 1617 in accordance with a detection signal from the steering angle detector 1603.

Here, "moving and thereafter stopping the irradiated position" means, instead of keeping the irradiated position scanned with laser light, moving the irradiated position to a desired position and then keeping it substantially at rest there. Here, "keeping it substantially at rest" includes swinging the irradiated position at the movement destination within a range smaller than the movement distance. The phrase even embraces, for example, keeping the irradiated position momentarily at rest at the movement destination and then moving it back.

In other respects, the design in Embodiment 14 is similar to that in Embodiment 8 described previously.

Next, with reference to FIGS. 79 to 83, how the headlamp 1602 operates will be described.

Figure 80:
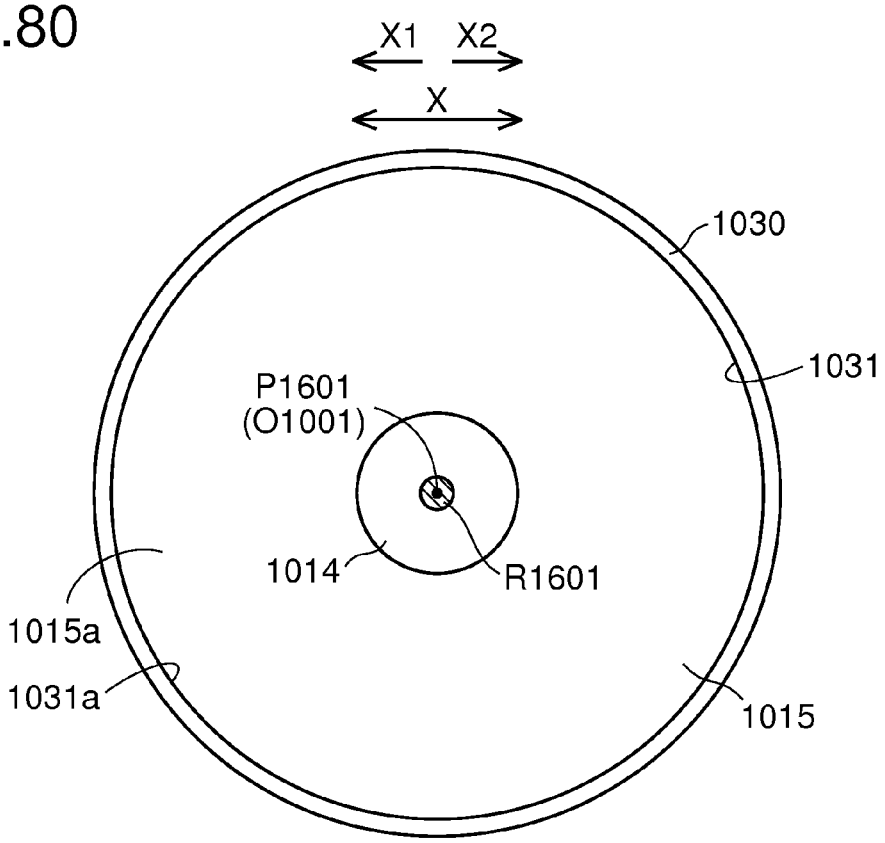
FIG. 80 is a front view showing the structure of the reflector and the fluorescent member shown in FIG. 79.
Figure 81:
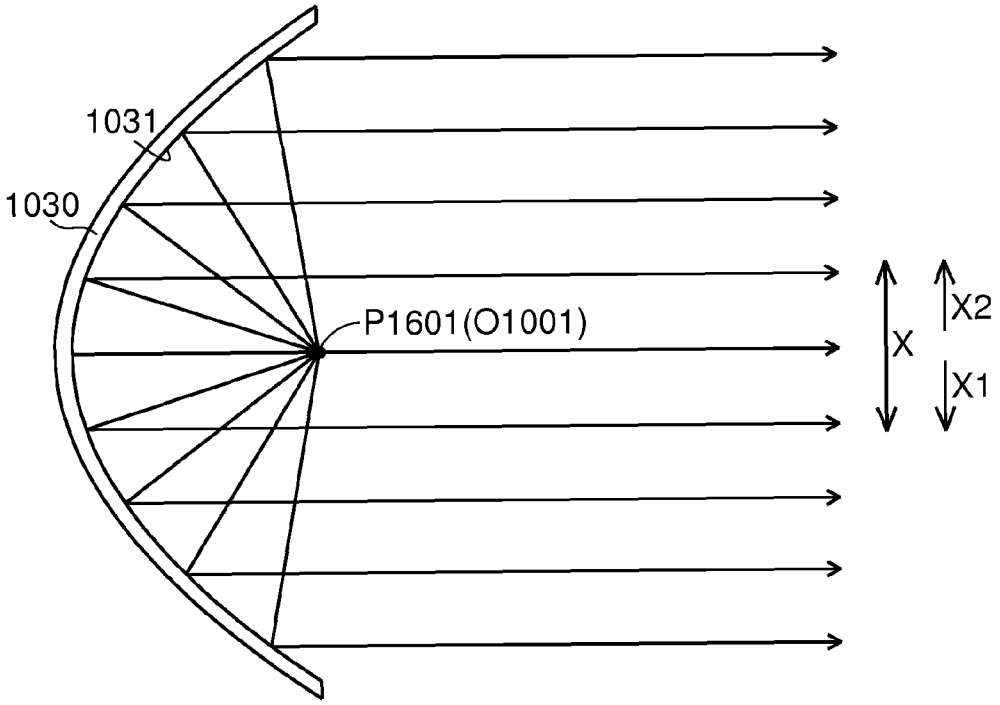
FIG. 81 is a sectional view showing the light reflected on the reflective surface of the reflector shown in FIG. 79 as seen from above.

When the automobile 1601 is traveling straight forward, as shown in FIG. 80, the center position (irradiated position) P1601 of the irradiated region R1601 (the hatched region) on the fluorescent member 1014 is located at the focal point F1001 (center O1001) of the reflective surface 1031 of the reflector 1030. Thus, as shown in FIG. 81, the light emitted from the irradiated position P1601 is reflected on the reflector 1030 and made into a parallel beam, so as to be emitted forward with respect to the automobile 1601 (in the direction perpendicular to the X direction). As described above, the light emitted from the irradiated region R1601 (see FIG. 80) is emitted outside the headlamp 1602 with a predetermined fanning angle.

By contrast, when the automobile 1601 turns right, for instance, the driver operates the steering wheel (unillustrated) to give the automobile 1601 a steering angle. The steering angle detector 1603 (see FIG. 79) then detects the steering angle of the automobile 1601.

Here, in Embodiment 14, in accordance with the steering angle detected by the steering angle detector 1603, the angle of the reflector 1623 is changed by the actuator 1616 (see FIG. 79).

Specifically, when the automobile 1601 is given, for example, a steering angle to the right (the X1 direction), the angle of the reflector 1623 to the right (in the β2 direction (see FIG. 79)) is changed by the actuator 1617.

Figure 82:
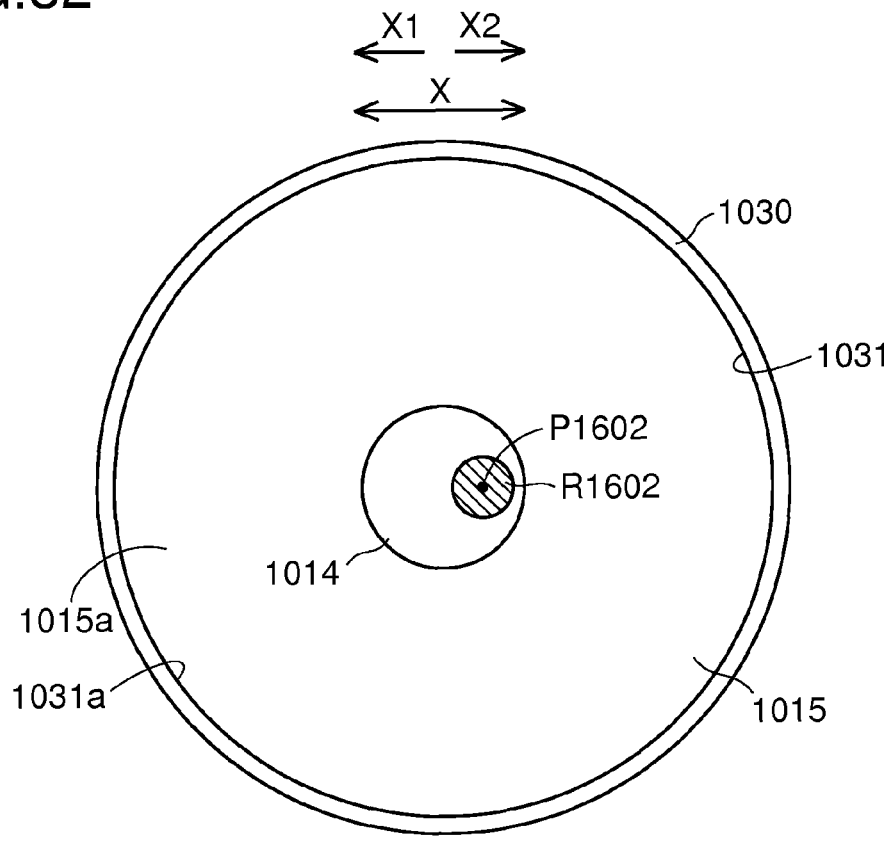
FIG. 82 is a front view showing the structure of the reflector and the fluorescent member shown in FIG. 79.
Figure 83:
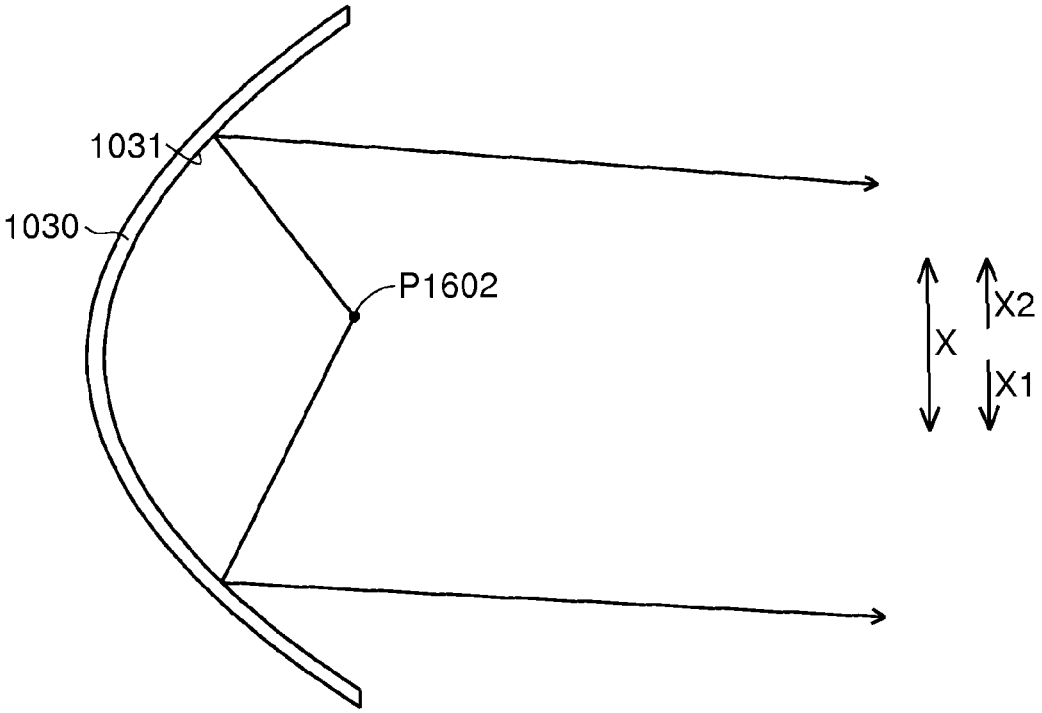
FIG. 83 is a sectional view showing the light reflected on the reflective surface of the reflector shown in FIG. 79 as seen from above.

As a result, the traveling direction of the laser light is changed so that the irradiated position on the fluorescent member 1014 is changed (moved) from P1601 (see FIG. 80) to P1602 (see FIG. 82). Then, as shown in FIG. 83, the light emitted from the irradiated position P1602 is reflected from the reflector 1030 so as to be emitted obliquely forward right. In this way, the illuminating direction of the headlamp 1602 (the direction in which the headlamp 1602 illuminates) is changed.

Moreover, at this time, in accordance with the steering angle detected by the steering angle detector 1603, the position of the collimator lens 1022 is changed by the actuator 1616 (see FIG. 79). As a result, the irradiated region R1602 (see FIG. 82) on the fluorescent member 1014 comes to have a larger area than the irradiated region R1061 (see FIG. 80). This further increases the illuminated region of the headlamp 1602. The irradiated region R1602 on the fluorescent member 1014 has a diameter of, for example, about 2 mm or larger but about 10 mm or smaller.

In other respects, the operation in Embodiment 14 is similar to that in Embodiment 8 described previously.

In Embodiment 14, as described above, there are provided an actuator 1617 for changing the irradiated position on the fluorescent member 1014 and an actuator 1616 for changing the area of the irradiated region on the fluorescent member 1014. This makes it possible to control (change) both the illuminating direction of the headlamp 1602 and the area of the illuminated region.

In other respects, the benefits of Embodiment 14 are similar to those of Embodiment 8 described previously.

It should be understood that Embodiments 8 to 14 described above are in every respect illustrative and not restrictive. The scope of the present invention is defined not by Embodiments 8 to 14 described above but by the appended claims, and encompasses any variations and modifications made within the sense and scope equivalent to those of the claims.

For example, although Embodiments 8 to 14 described above deal with examples where a headlamp according to the invention is used in an automobile, this is not meant to be a limitation; a headlamp according to the invention may be used in aircraft, ships, robots, motorcycles, bicycles, and any other mobile bodies.

Although Embodiments 8 to 14 described above deal with examples where a lighting apparatus according to the invention is applied to a headlamp, this is not meant to be a limitation; a lighting apparatus according to the invention may be applied to downlights, spotlights, and any other lighting apparatus.

Although Embodiments 8 to 14 described above deal with examples where the semiconductor laser devices and the fluorescent member are designed to emit white light, this is not meant to be a limitation; the semiconductor laser devices and the fluorescent member may be designed to emit visible light other than white light.

Although Embodiments 8 to 14 described above deal with examples where semiconductor laser devices are used as a laser generator for emitting laser light, this is not meant to be a limitation; any laser generator other than a semiconductor laser device may be used.

All values specifically given in connection with Embodiments 8 to 14 described above are merely examples, which are not meant to be any limitation.

In Embodiments 8 to 14, the center wavelength of the laser light emitted from the semiconductor laser devices and the kind of phosphor constituting the fluorescent member may be changed as necessary.

Although Embodiments 8 to 14 described above deal with examples where the light guide members are composed of an optical fiber, a lens (collimator lens), and a reflector, this is not meant to be a limitation; the light guide members may be composed of one or two of an optical fiber, a collimator lens, and a reflector as necessary.

Although Embodiments 8 to 14 described above deal with examples where, to apply the laser light emitted from the semiconductor laser devices to the fluorescent member, light guide members are provided, this is not meant to be a limitation; no light guide members need to be provided.

Although Embodiments 8 to 14 described above deal with examples where, by changing the position of the lens (collimator lens), the area of the irradiated region on the fluorescent member is changed, this is not meant to be a limitation; it is also possible to change the area of the irradiated region on the fluorescent member by changing the position of the laser light exit ends of the optical fibers. No collimator lens needs to be used; instead, it is possible to adopt a design in which laser light with a fanning angle is applied to the fluorescent member so that, by changing the position of the reflector 1023 (or the semiconductor laser devices or the like), the area of the irradiated region on the fluorescent member is changed.

Although Embodiments 8 to 14 described above deal with examples where the holding surface of the holding member and the fluorescent member are formed so as to extend in the depth direction of the reflective surface or in the direction perpendicular to the depth direction of the reflective surface, this is not meant to be a limitation; for example, it is also possible to tilt the holding surface of the holding member, or to make the surface of the fluorescent member (or the holding surface of the holding member) spherical, so that the fluorescent member is so formed as to extend both in the depth direction of the reflective surface and in the direction perpendicular to the depth direction of the reflective surface.

Although Embodiments 8 to 14 described above deal with examples where the fluorescent member is disposed in a region that includes the focal point of the reflective surface, this is not meant to be a limitation; the fluorescent member may be disposed near the focal point of the reflective surface.

Although Embodiments 8 to 14 described above deal with examples where the reflective surface of the reflector is formed in the shape of a paraboloid, this is not meant to be a limitation; the reflective surface may be formed in the shape of part of an ellipsoid. It is also possible to design the reflector as a CPC (compound parabolic concentrator) type reflector.

Although Embodiments 8 to 14 described above deal with examples where, when the light emitted from the fluorescent member in the direction opposite from the direction from which it is irradiated with laser light is reflected on the reflector (as in Embodiments 8, 11, and 14 described above), the fluorescent member is formed of the phosphor $(Y,Gd)_3Al_5O_{12}$:Ce and, when the light emitted from the fluorescent member in the direction from which it is irradiated with the laser light is reflected on the reflector (as in Embodiments 9, 10, 12, and 13 described above), the fluorescent member is formed of the phosphors $Ce^{3+}$-activated α-SiAlON and $CaAlSiN_3$:$Eu^{2+}$, this is not meant to be a limitation; when the light emitted from the fluorescent member in the direction opposite from the direction from which it is irradiated with laser light is reflected on the reflector, the fluorescent member may be formed of the phosphors $Ce^{3+}$-activated α-SiAlON and $CaAlSiN_3$:$Eu^{2+}$ and, when the light emitted from the fluorescent member in the direction from which it is irradiated with the laser light is reflected on the reflector, the fluorescent member may be formed of the phosphor $(Y,Gd)_3Al_5O_{12}$:Ce.

Although Embodiments 8 to 14 described above deal with examples where the fluorescent member is formed of phosphor particles and resin, this is not meant to be a limitation; the fluorescent member may be formed of any of various materials by any of various methods so long as it contains a phosphor (phosphorescent or fluorescent substance or material). For example, the fluorescent member may be formed of phosphor particles and any material other than resin, such as adhesive or glass. The fluorescent member may be formed by sintering or pressing phosphor particles.

Figure 84:
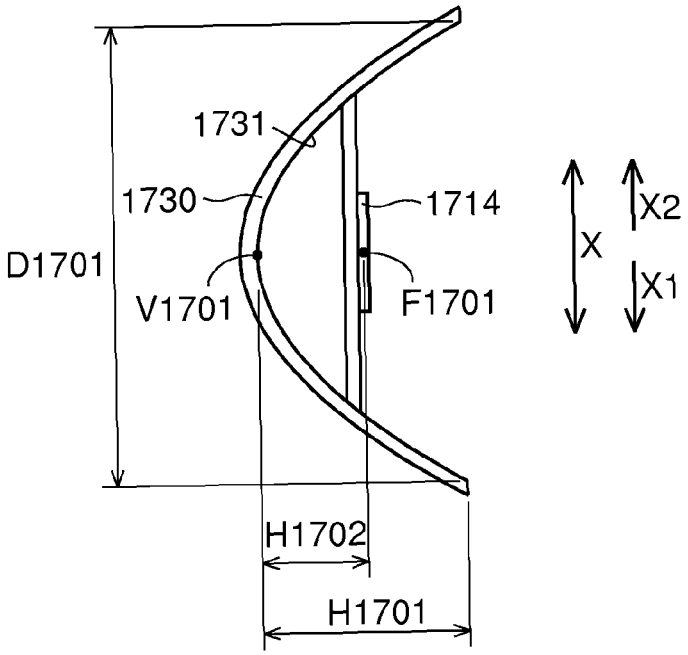
FIG. 84 is a sectional view showing the structure of the reflector and the fluorescent member in a headlamp according to an eighth modified example of the invention as seen from above.

Although Embodiments 8 to 14 described above deal with examples where the fluorescent member (the focal point of the reflective surface) is disposed at the boundary between the inside and outside of the reflective surface or near the vertex of the reflective surface, this is not meant to be a limitation; the fluorescent member (the focal point of the reflective surface) may be disposed anywhere between the boundary between the inside and outside of the reflective surface and near the vertex of the reflective surface. Specifically, as in a headlamp according to an eighth modified example of the invention shown in FIG. 84, the fluorescent member 1714 (the focal point F1701 of the reflective surface 1731) may be disposed in a central part of the reflective surface 1731 (reflector 1730). In a case where the reflective surface 1731 is formed to have a diameter of about 100 mm (=D1701) and a depth of about 35 mm (=H1701), the distance (=H1702) between the focal point F1701 of the reflective surface 1731 and the vertex V1701 of the reflective surface 1731 is about 17.9 mm.

For example, in Embodiment 9 described above, the holding member may be formed of a light transmitting material such as a sheet of glass. In Embodiments 8 to 14, the holding member may be formed of any material other than a sheet of glass or a sheet of metal.

Figure 85:
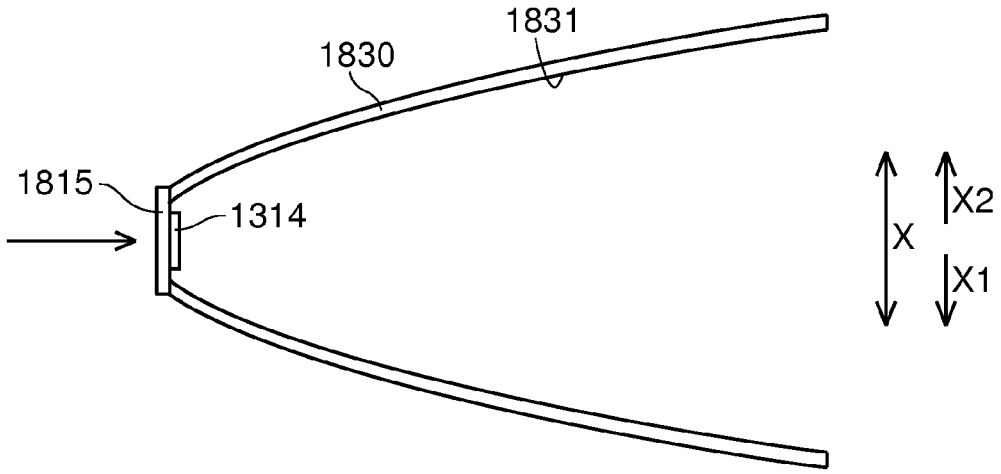
FIG. 85 is a sectional view showing the structure of the reflector and the holding member in a headlamp according to a ninth modified example of the invention as seen from above.

Although, for example, Embodiment 11 described above deals with an example where, as shown in FIG. 72, the holding member is disposed inside the reflector (reflective surface), this is not meant to be a limitation; the headlamp may be designed as shown in FIG. 85, which shows a ninth modified example of the invention. Specifically, the portion of the reflector 1830 located behind the fluorescent member 1314 may be cut off so that the holding member 1815 is disposed outside the reflector 1830 (reflective surface 1831).

Although Embodiments 12 and 13 deal with examples where, when the focal point of the reflective surface is located near the vertex, the reflective surface of the reflector is formed in the shape of a paraboloid divided on a plane perpendicular to (crossing) the axis through the vertex and the focal point and further divided on a plane parallel to the axis through the vertex and the focal point, this is not meant to be a limitation. For example, as in a headlamp according to a tenth modified example of the invention shown in FIG. 86, when the focal point F1901 of the reflective surface 1931 of the reflector 1930 is located at the boundary between the inside and outside of the reflective surface 1931, the reflective surface 1931 may be formed in the shape of a paraboloid divided on a plane perpendicular to (crossing) the axis through the vertex V1901 and the focal point F1901 and further divided on a plane parallel to the axis through the vertex V1901 and the focal point F1901.

Figure 86:
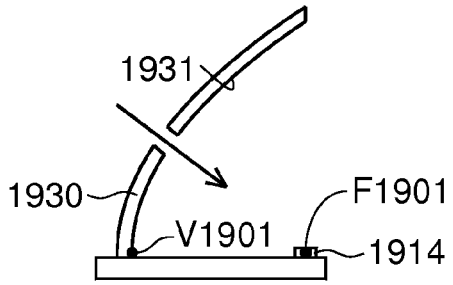
FIG. 86 is a sectional view showing the structure of the reflector in a headlamp according to a tenth modified example of the invention as seen from a side.

As shown in FIG. 86, laser light may be applied to the fluorescent member 1914 obliquely from behind.

Figure 87:
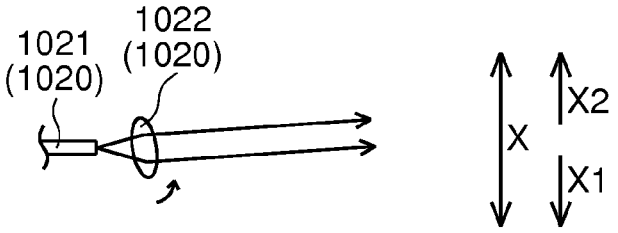
FIG. 87 is a plan view illustrating the laser light passing through a collimator lens.

Although Embodiment 14 described above deals with an example where, to control (change) both the area of the illuminated region and the illuminating direction of the headlamp, the collimator lens 1022 is moved in the Z1 (or Z2) direction by use of the actuator 1616 and the angle of the reflector 1623 is changed by use of the actuator 1617, this is not meant to be a limitation. For example, the actuator 1616 may be so designed as to move the collimator lens 1022 in the Z1 (or Z2) direction and also change the angle of the collimator lens 1022. As shown in FIG. 87, in a case where the angle of the collimator lens 1022 with respect to the axial direction of the optical fibers 1021 is changed, the traveling direction of the laser light passing through the collimator lens 1022 is changed. In this way, it is possible to change the irradiated position on the fluorescent member, and also to change the illuminating direction of the headlamp.

Although Embodiments 8 to 14 described above deal with examples where, in accordance with the operation of the switch by the driver and the steering angle of the automobile, the area of the irradiated region on the fluorescent member (the area of the illuminated region of the headlamp) is changed, this is not meant to be any limitation; the area of the irradiated region on the fluorescent member (the area of the illuminated region of the headlamp) may be changed in accordance with, at least, the traveling speed of the automobile. In that case, a speed detector for detecting the traveling speed of the automobile may be provided.

Figure 88:
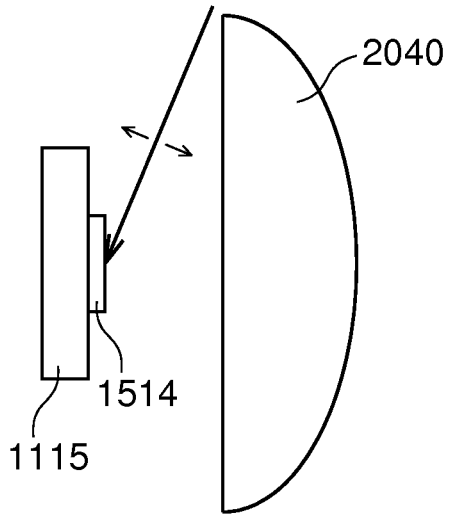
FIG. 88 is a sectional view showing the structure of and around the fluorescent member in a headlamp according to an eleventh modified example of the invention as seen from above.
Figure 89:
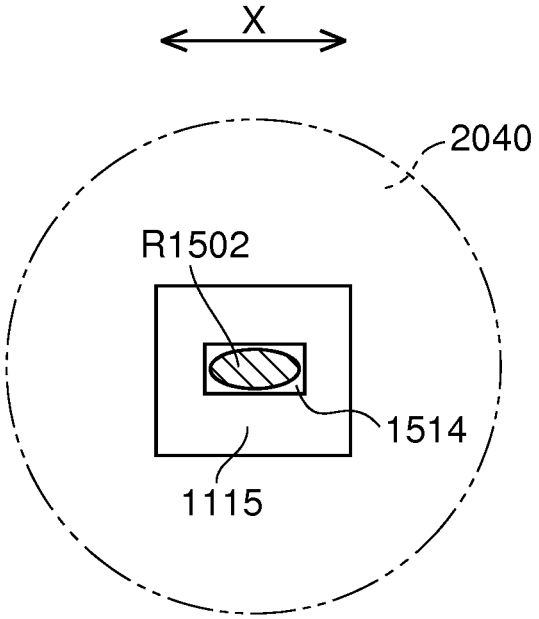
FIG. 89 is a front view showing the structure of the reflector and the fluorescent member shown in FIG. 88.

Although Embodiments 8 to 14 described above deal with examples where, as a light projecting member, a reflector is used, this is not meant to be a limitation. For example, as in a headlamp according to an eleventh modified example of the invention shown in FIG. 88, as a light projecting member, a light projecting lens 2040 (for example, a convex lens) may be used which controls and projects the light emitted from the fluorescent member 1514. In that case, the light projecting lens 2040 may be arranged in such a way that the center of the projecting lens 2040 coincides with the center of the fluorescent member 1514 as seen from in front. As in Embodiment 13 described above, a holding member 1115 formed of, for example, a sheet of metal with high thermal conductivity and a fluorescent member 1514 may be used. Laser light may be applied to the fluorescent member 1514 from in front. As shown in FIG. 89, the irradiated region R1502 (the hatched region) on the fluorescent member 1514 may be changed into an elliptic (laterally long) shape extending in the horizontal direction (X direction). Even in a case where, an in the eleventh modified example of the invention, a projecting lens 2040 is used as a light projecting member, by changing the area of the irradiated region on the fluorescent member 1514, it is possible to change the area of the illuminated region of the headlamp.

Figure 90:
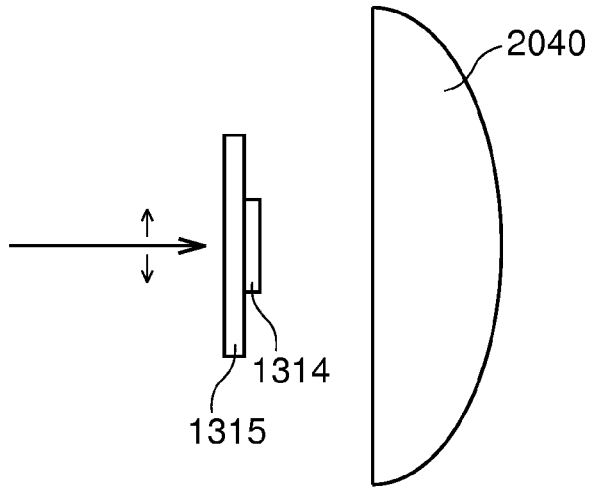
FIG. 90 is a sectional view showing the structure of and around the fluorescent member in a headlamp according to a twelfth modified example of the invention as seen from above.

For example, as in a headlamp according to a twelfth modified example of the invention shown in FIG. 90, a light projecting lens 2040, a fluorescent member 1314, and a holding member 1315 may be used to apply laser light to the fluorescent member 1314 from behind.

Figure 91:
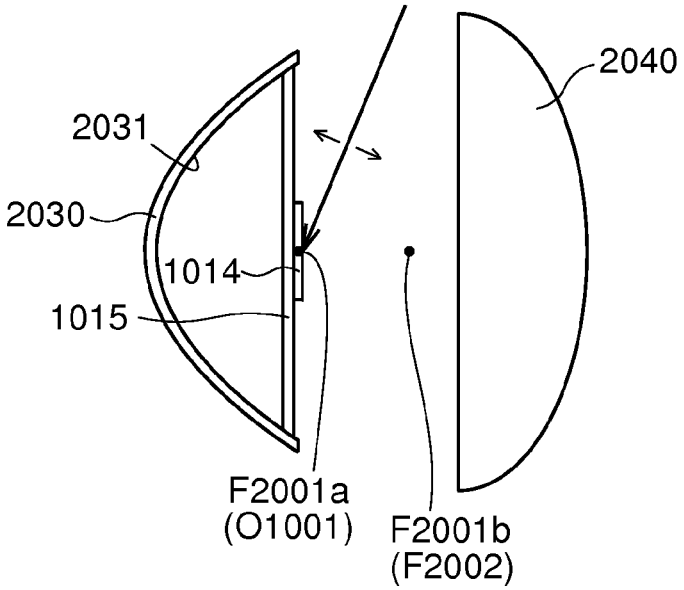
FIG. 91 is a sectional view showing the structure of and around the fluorescent member in a headlamp according to a thirteenth modified example of the invention as seen from above.

For example, as in a headlamp according to a thirteenth modified example of the invention shown in FIG. 91, as a light projecting member, a reflector 2030 and a light projecting lens 2040 may be used. In that case, the reflective surface 2031 of the reflector 2030 may be formed in the shape of an ellipsoid. The first focal point F2001*a* (the one closer to the reflective surface 2031) of the reflective surface (ellipsoid) 2031 may be made to coincide with the center O1001 of the fluorescent member 1014, and the second focal point F2001*b* (the one farther from the reflective surface 2031) of the reflective surface (ellipsoid) 2031 may be made to coincide with the focal point F2002 of the light projecting lens 2040. With this design, the light that has passed through the focal point F2001*b* (F2002) and entered the light projecting lens 2040 is formed into a parallel beam and emitted from the light projecting lens 2040 forward.

Although Embodiments 8 to 14 described above deal with examples where, as a light emitting member, a fluorescent member containing particles of a phosphor that emits light (fluorescence) having a center wavelength longer (greater) than that of the excitation light is used, this is not meant to be a limitation. It is also possible to use a light emitting member containing a wavelength converting member that emits light (for example, visible light) having a center wavelength shorter (smaller) than that of the excitation light (for example, red light), such as a substance that emits light by multiple photon excitation or a so-called up-conversion phosphor. No wavelength converting member needs to be used; instead, it is possible to use, for example, a light emitting member that contains a scattering material that simply scatters visible laser light.

Figure 92:
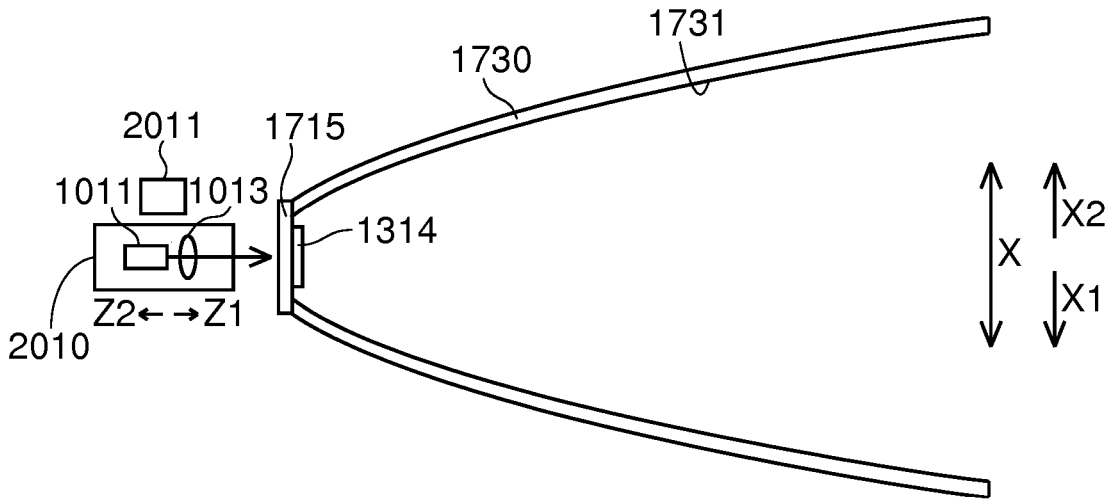
FIG. 92 is a sectional view showing the structure of a headlamp according to a fourteenth modified example of the invention as seen from above.

Although Embodiments 8 to 14 described above deal with examples where, to change the irradiated area on the fluorescent member, the collimator lens 1022 or the lens 1522*b* is moved, this is not meant to be a limitation. For example, as in a headlamp according to a fourteenth modified example of the invention shown in FIG. 92, a laser device unit 2010 having semiconductor laser devices 1011 and condenser lenses 1013 integrated into a single unit may be slid in the Z direction by use of a motor 2011 or the like (an irradiated area changer) so as to change the irradiated area on the fluorescent member 1314. Only the semiconductor laser devices 1011 may be slid in the Z direction (Z1 or Z2 direction). Needless to say, even in a case where a light projecting lens is used as a light projecting member, the design shown in FIG. 92 can be used.

What is claimed is:

1. A lighting apparatus comprising:

a laser generator which emits laser light;

a light emitting member which is irradiated with the laser light emitted from the laser generator to emit light;

an irradiated position changer which moves and thereafter stops an irradiated position at which the light emitting member is irradiated with the laser light; and a light projecting member which projects the light emitted from the light emitting member, wherein the light projecting member comprises a first reflector having a reflective surface which reflects the light emitted from the light emitting member, the reflective surface is formed in a shape having a focal point, and the light emitting member is disposed in a region including the focal point of the reflective surface or near the focal point of the reflective surface.

2. The lighting apparatus according to claim 1, wherein the light emitting member comprises a fluorescent member.

3. The lighting apparatus according to claim 1, wherein the light emitting member is so formed as to extend in a predetermined direction crossing a depth direction of the reflective surface, and the irradiated position on the light emitting member is changed at least in the predetermined direction by the irradiated position changer.

4. The lighting apparatus according to claim 1, further comprising a light guide member which guides the laser light emitted from the laser generator to the light emitting member, wherein the irradiated position changer changes the irradiated position on the light emitting member by changing an angle of the light guide member.

5. The lighting apparatus according to claim 1, further comprising an output adjuster which adjusts an output of the laser generator, wherein the output adjuster adjusts the output of the laser generator in synchronism with the change of the irradiated position on the light emitting member.

6. A headlamp comprising the lighting apparatus according to claim 1.

7. A mobile body comprising the headlamp according to claim 6.

8. A lighting apparatus comprising:

a laser generator which emits laser light;

a light emitting member which is irradiated with the laser light emitted from the laser generator to emit light;

an irradiated position changer which moves and thereafter stops an irradiated position at which the light emitting member is irradiated with the laser light;

a light projecting member which projects the light emitted from the light emitting member; and a light guide member which guides the laser light emitted from the laser generator to the light emitting member, wherein the light guide member includes a lens that transmits the laser light, and the irradiated position changer changes the irradiated position on the light emitting member by changing an angle of the lens.

9. The lighting apparatus according to claim 8, wherein the light emitting member comprises a fluorescent member.

10. The lighting apparatus according to claim 8, further comprising an output adjuster which adjusts an output of the laser generator, wherein the output adjuster adjusts the output of the laser generator in synchronism with the change of the irradiated position on the light emitting member.

11. A headlamp comprising the lighting apparatus according to claim 8.

12. A mobile body comprising the headlamp according to claim 11.

13. A lighting apparatus comprising:

a laser generator which emits laser light;

a light emitting member which is irradiated with the laser light emitted from the laser generator to emit light;

an irradiated position changer which moves and thereafter stops an irradiated position at which the light emitting member is irradiated with the laser light; and a light projecting member which projects the light emitted from the light emitting member, wherein the light projecting member comprises a light projecting lens which controls the light emitted from the light emitting member, and the light projecting member is configured so that the light emitted from the laser generator enters the light projecting lens through a region including a focal point of the light projecting lens or near the focal point of the light projecting lens.

14. The lighting apparatus according to claim 13, wherein the light emitting member comprises a fluorescent member.

15. The lighting apparatus according to claim 13, further comprising a light guide member which guides the laser light emitted from the laser generator to the light emitting member, wherein the irradiated position changer changes the irradiated position on the light emitting member by changing an angle of the light guide member.

16. The lighting apparatus according to claim 13, further comprising an output adjuster which adjusts an output of the laser generator, wherein the output adjuster adjusts the output of the laser generator in synchronism with the change of the irradiated position on the light emitting member.

17. A headlamp comprising the lighting apparatus according to claim 13.

18. A mobile body comprising the headlamp according to claim 17.

* * * * *